US011336986B2

(12) United States Patent
Grinker

(10) Patent No.: US 11,336,986 B2
(45) **Date of Patent: *May 17, 2022**

(54) IN-EAR SPEAKER HYBRID AUDIO TRANSPARENCY SYSTEM

(71) Applicant: Apple Inc., Cupertino, CA (US)

(72) Inventor: Scott C. Grinker, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/844,604

(22) Filed: Apr. 9, 2020

(65) Prior Publication Data

US 2020/0245052 A1 Jul. 30, 2020

Related U.S. Application Data

(63) Continuation of application No. 16/521,497, filed on Jul. 24, 2019, now Pat. No. 10,652,646, which is a (Continued)

(51) Int. Cl.

| | |
|---|---|
| ***H04R 1/10*** | (2006.01) |
| ***G10K 11/178*** | (2006.01) |
| ***H04R 3/04*** | (2006.01) |

(52) U.S. Cl.

CPC ..... *H04R 1/1041* (2013.01); *G10K 11/1785* (2018.01); *G10K 11/17837* (2018.01); (Continued)

(58) Field of Classification Search

CPC .. H04R 1/1041; H04R 1/1083; H04R 1/1016; H04R 3/04; H04R 2460/11; (Continued)

(56) References Cited

U.S. PATENT DOCUMENTS 3,432,622 A 3/1969 Sebesta et al.
5,694,475 A 12/1997 Boyden
(Continued)

FOREIGN PATENT DOCUMENTS

CN 101133679 A 2/2008
CN 201365329 Y 12/2009
(Continued)

OTHER PUBLICATIONS

Borges, Renata C., et al., "An Adaptive Occlusion Canceller for Heanng Aids", Universidade Federal de Santa Catarina—Florianpolis, Brazil, EUSIPCO, 2013, 5.
(Continued)

*Primary Examiner* — Muhammad N Edun
(74) *Attorney, Agent, or Firm* — Womble Bond Dickinson (US) LLP

(57) ABSTRACT

A user content audio signal is converted into sound that is delivered into an ear canal of a wearer of an in-ear speaker, while the in-ear speaker is sealing off the ear canal against ambient sound leakage. An acoustic or venting valve in the in-ear speaker is automatically signaled to open, so that sound inside the ear canal is allowed to travel out into an ambient environment through the valve, while activating conversion of an ambient content audio signal into sound for delivery into the ear canal. Both user content and ambient content are heard by the wearer. The ambient content audio signal is digitally processed so that certain frequency components have been gain adjusted, based on an equalization profile, so as to compensate for some of the insertion loss that is due to the in-ear speaker blocking the ear canal. Other embodiments are also described and claimed.

19 Claims, 28 Drawing Sheets

Related U.S. Application Data continuation of application No. 16/399,798, filed on Apr. 30, 2019, now abandoned, which is a continuation of application No. 15/713,302, filed on Sep. 22, 2017, now abandoned, which is a continuation of application No. 15/000,994, filed on Jan. 19, 2016, now Pat. No. 9,774,941.

(52) U.S. Cl.
CPC .. *G10K 11/17873* (2018.01); *G10K 11/17881* (2018.01); *G10K 11/17885* (2018.01); *H04R 1/1016* (2013.01); *H04R 1/1083* (2013.01); *H04R 3/04* (2013.01); *G10K 2210/1081* (2013.01); *H04R 2460/11* (2013.01)

(58) Field of Classification Search
CPC ..... G10K 11/178; G10K 2210/1081; G10K 11/17881; G10K 11/17837
See application file for complete search history.

(56) References Cited

U.S. PATENT DOCUMENTS

| | | | | |
|---|---|---|---|---|
| 6,853,735 | B2 | 2/2005 | Imahori et al. | |
| 7,206,425 | B2 | 4/2007 | Vaudrey et al. | |
| 8,098,854 | B2 | 1/2012 | Van Halteren et al. | |
| 8,111,839 | B2 | 2/2012 | Goldstein et al. | |
| 8,340,310 | B2 | 12/2012 | Ambrose et al. | |
| 8,548,186 | B2 | 10/2013 | Alwicker et al. | |
| 8,798,304 | B2 | 8/2014 | Miller et al. | |
| 2006/0023908 | A1 | 2/2006 | Perkins et al. | |
| 2007/0036385 | A1 | 2/2007 | Harvey et al. | |
| 2010/0020982 | A1 | 1/2010 | Brown et al. | |
| 2010/0177904 | A1* | 7/2010 | Sung | G10K 11/17875 381/71.6 |
| 2011/0206214 | A1 | 8/2011 | Christoph et al. | |
| 2012/0057718 | A1 | 3/2012 | Vernon | |
| 2013/0129105 | A1* | 5/2013 | Hua | H04R 1/1083 381/71.6 |
| 2014/0153755 | A1 | 6/2014 | Hug et al. | |
| 2014/0169579 | A1* | 6/2014 | Azmi | G10K 11/16 381/71.6 |
| 2014/0205131 | A1 | 7/2014 | Azmi et al. | |
| 2015/0181338 | A1 | 6/2015 | Hosoi et al. | |
| 2016/0150310 | A1* | 5/2016 | Bakalos | H04R 1/1083 381/372 |

FOREIGN PATENT DOCUMENTS

| | | | |
|---|---|---|---|
| CN | 103339960 | A | 10/2013 |
| CN | 103874003 | A | 6/2014 |
| CN | 104429097 | A | 3/2015 |
| CN | 104871556 | A | 8/2015 |
| CN | 105247885 | A | 1/2016 |
| GB | 1057853 | | 2/1967 |

OTHER PUBLICATIONS

Office Action dated Sep. 4, 2018, issued by SIPO for Chinese Patent Application No. 201710032725.2.
Chinese Notice of Grant dated Jul. 30, 2019 for related Chinese Appln. No. 201710032725.2 4 Pages.
Non-Final Office action dated Jun. 13, 2019 for U.S. Appl. No. 16/399,798.
Non-Final Office action dated Mar. 8, 2018 for U.S. Appl. No. 15/713,302.
Non-Final Office action dated Jun. 26, 2018 for U.S. Appl. No. 15/713,302.
Notice of allowance dated Nov. 2, 2018 for U.S. Appl. No. 15/713,302.
Notice of allowance dated Feb. 4, 2019 for U.S. Appl. No. 15/713,302.
Notice of allowance dated May 19, 2017 for U.S. Appl. No. 15/000,994.
Non-Final Office action dated Aug. 19, 2019 for U.S. Appl. No. 16/521,497.
Notice of allowance dated Jan. 13, 2020 for U.S. Appl. No. 16/521,497.
First Office Action of the China National Intellectual Property Administration dated Jun. 2, 2020 for related Chinese Application No. 201910883991.5.

* cited by examiner

IN-EAR SPEAKER HYBRID AUDIO TRANSPARENCY SYSTEM

CROSS REFERENCE TO RELATED APPLICATIONS

This application is a continuation of U.S. application Ser. No. 16/521,497, filed Jul. 24, 2019, which is a continuation of U.S. patent application Ser. No. 16/399,798, filed Apr. 30, 2019, which is a continuation of U.S. application Ser. No. 15/713,302, filed Sep. 22, 2017, which is a continuation of U.S. application Ser. No. 15/000,994, filed Jan. 19, 2016 and issued as U.S. Pat. No. 9,774,941 on Sep. 26, 2017, which are incorporated herein by reference in their entirety.

FIELD

Embodiments described herein relate to an in-ear speaker (e.g., an earbud). More particularly, the embodiments described herein relate to an insertable in-ear speaker that is configured as a hybrid, audio transparency system. Other embodiments are also described.

BACKGROUND INFORMATION

Wired or wireless in-ear speakers (e.g., earbuds) deliver sounds to one or more ears of a user (also referred to here as a listener or wearer) of such an in-ear speaker. One type of in-ear speaker is designed to be closely coupled to a user's ear canal, referred to as an "insertable in-ear speaker". This type in-ear speaker can be placed inside a concha at the entrance of the user's ear canal or can be inserted into the ear canal to block its entrance.

Generally there are two mutually exclusive types of insertable in-ear speakers, which are as follows: (i) an insertable in-ear speaker that fully seals an ear canal (hereinafter "sealable insertable in-ear speakers"); and (ii) an insertable in-ear speaker that is intentionally designed to allow some sounds from the ambient environment to leak into the user's ear canal during use (hereinafter "leaky insertable in-ear speakers"). Leaky insertable in-ear speakers provide better audio transparency than sealable insertable in-ear speakers. Nevertheless, sounds from the ambient environment may be unwanted to a user. To avoid this scenario, sealable insertable in-ear speakers may be used by the user. Sealable insertable in-ear speakers have some shortcomings. Users of these types of in-ear speakers can be subjected to unwanted sounds resulting from an occlusion effect (OE) during use (e.g., during telephone calls, while running, etc.). Also, a sealable insertable in-ear speaker can prevent its user from perceiving sounds from the ambient environment.

SUMMARY

Embodiments of an insertable in-ear speaker that is configured as a hybrid transparency system are described. Such an in-ear speaker can assist with at least one of: (i) improving a user's isolation from sounds from the ambient environment by preventing those sounds from entering the ear canal; or (ii) improving a user's perception of audio transparency by enabling delivery of sounds from the ambient environment to the ear canal.

An insertable in-ear speaker is configured as a hybrid transparency system that combines the use of an active, venting or acoustic pass valve, with an ambient sound pickup and production (also referred to here as ambient sound augmentation) system. A user content sound system, e.g., having an electro-acoustic transducer (speaker driver) that is integrated within a housing of the in-ear speaker, generates user content sound, in accordance with a first audio signal, e.g., containing user content such as an ongoing telephone conversation between the wearer of the in-ear speaker and a far end user, music playback, or playback of another audio-containing work. The user content sound is produced for delivery into an ear canal of a wearer of the in-ear speaker. The in-ear speaker may be a sealing type, which seals the ear canal. The in-ear speaker housing also contains the venting or acoustic pass valve which can be configured (alternately) into a state in which it enables sound waves inside the ear canal to travel to an ambient environment, and into another state in which it restricts the sound waves from traveling to the ambient environment. An external microphone is configured to produce a second audio signal (ambient content signal) from sound waves in the ambient environment. The external microphone may also be integrated into the in-ear speaker housing, in such a way that it becomes positioned in a concha, close to the ear canal, when the in-ear speaker is worn; it is referred to as "external" since its primary acoustic input port may be facing outward into the ambient environment. There is also logic circuitry, e.g., as part of a programmed processor, which may or may not be installed within the in-ear speaker housing, that is configured to implement an equalizer (e.g., a spectral shaping digital filter) that adjusts a frequency component of the second audio signal (representing the ambient sound as picked up by the external microphone). The adjustment can be based on an equalization profile of the ear canal. After the adjustment, the second audio signal can be delivered to the ear canal by being converted into sound waves, e.g., by being combined with the second audio signal and then converted into sound using the user content sound system, or the same electro-acoustic transducer that is being used to convert the user content into sound.

The equalization profile may be a collection of one or more acoustic characteristics or properties, associated with the ear canal. These may include, but are not limited to, a sound pressure associated with the ear canal; a particle velocity associated with the ear canal; a particle displacement associated with the ear canal; an acoustic intensity associated with the ear canal; an acoustic power associated with the ear canal; a sound energy associated with the ear canal; a sound energy density associated with the ear canal; a sound exposure associated with the ear canal; an acoustic impedance associated with the ear canal; an audio frequency associated with the ear canal; or a transmission loss associated with the ear canal. For one embodiment, the one or more acoustic properties are determined by an ear canal identification module, based on an acoustic test signal picked up by a microphone of the in-ear speaker, while the in-ear speaker is being worn by its end user. In another embodiment, the one or more acoustic properties are computed based on an average of multiple acoustic properties associated with multiple ear canals, e.g., as determined in a laboratory setting.

For one embodiment, the logic is further configured to activate or trigger operation of an ambient sound augmentation system that uses the external microphone, only when the valve is enabling sound waves of the first audio signal inside the ear canal to travel to the ambient environment, e.g., the valve is in its open state. In one embodiment, the in-ear speaker that is configured as a hybrid transparency system also operates as part of an active noise control (ANC)

system that performs acoustic noise cancellation upon any unwanted sound in the ear canal. The ANC system may also be used to compute one or more acoustic properties of the ear canal that are part of the equalization profile (which is used to configure the spectral shaping function of the equalizer.)

For one embodiment, a computer implemented method of using an insertable in-ear speaker as a hybrid transparency system is as follows. One or more user content audio signals are converted into sound that is delivered into an ear canal of the wearer by the in-ear speaker, while the in-ear speaker is sealing off the ear canal against ambient sound leakage. During this playback, the sound inside the ear canal (including the playback of the user content audio signal) is either allowed to travel to an ambient environment or is restricted, by an active, venting/acoustic pass valve. When the valve is open, an ambient content audio signal that contains pickup of sound in the ambient environment surrounding the in-ear speaker is generated and converted into sound, that is also delivered into the ear canal, so that both user content and ambient content can be heard by the wearer. While doing so, a frequency component of the ambient content audio signal is adjusted based on an equalization profile of the ear canal. This hybrid approach of opening a venting/acoustic pass valve combined with ambient sound augmentation aims to improve transparency of the in-ear speaker, so that the wearer can more comfortably perceive the ambient sound content over a broader frequency range (despite wearing the in-ear speaker.) The ambient sound augmentation may be deactivated, and acoustic noise cancellation (ANC) is activated, when the valve is closed (while there may or may not be simultaneous playback of the user content). The ANC in that case aims to produce an anti-noise or anti-phase sound field within the ear canal that is designed to destructively interfere with unwanted sounds that may be generated within the ear canal such as due to walking or physical activity of the wearer.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Figure 1A:
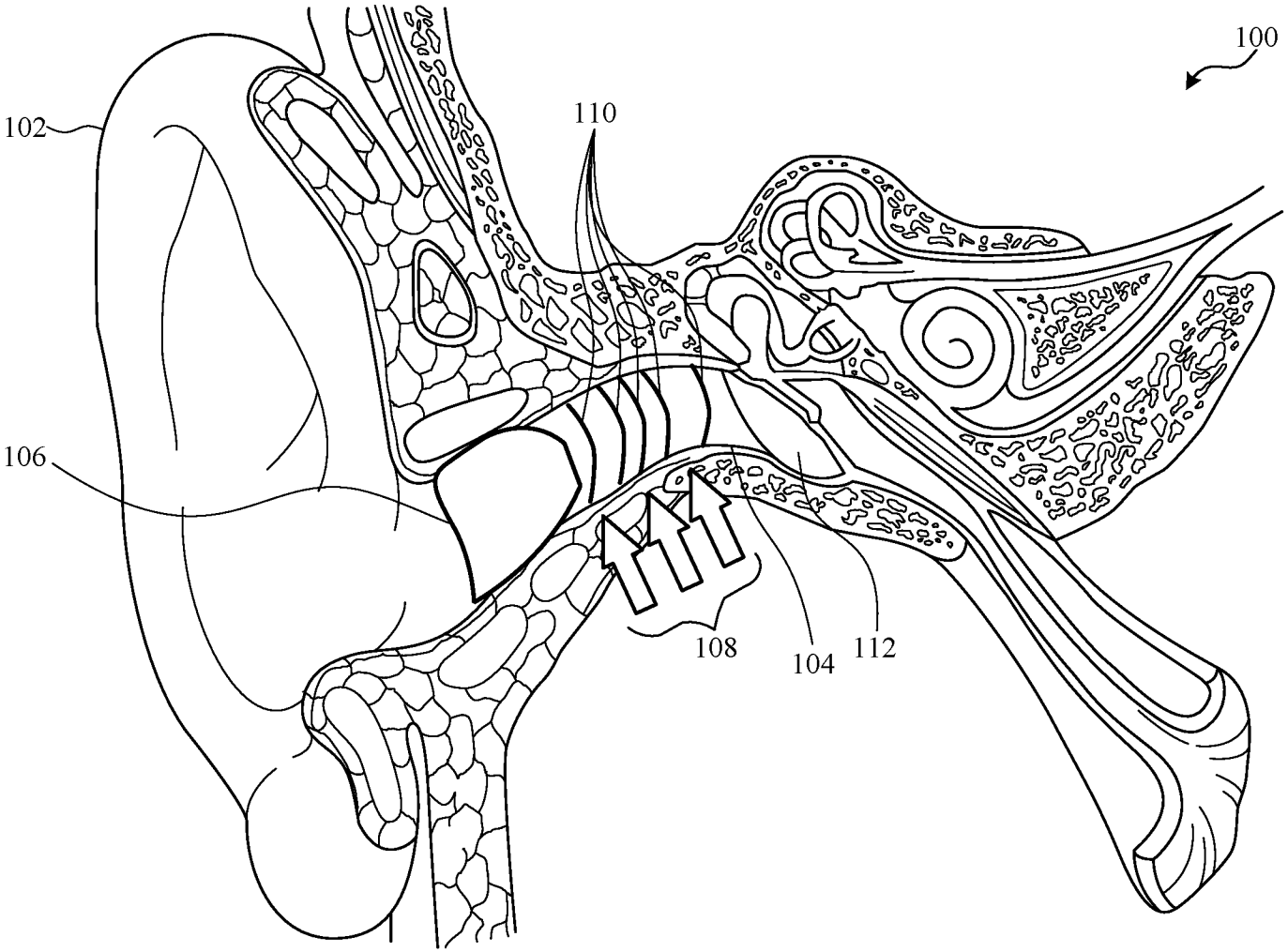
FIGS. 1A-1B are illustrations of occlusion and isolation effects in an ear canal.

Embodiments of an insertable in-ear speaker that is configured as a hybrid transparency system are described. Such an in-ear speaker can assist with at least one of: (i) improving a user's isolation from sounds from the ambient environment by preventing those sounds from entering the ear canal; or (ii) improving a user's perception of audio transparency by enabling delivery of sounds from the ambient environment to the ear canal.

Description of at least one of the embodiments set forth herein is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the embodiments. In other instances, well-known processes and manufacturing techniques have not been described in particular detail in order to not unnecessarily obscure the embodiments. Reference throughout this specification to "one embodiment," "an embodiment," "another embodiment," "other embodiments," "some embodiments," and their variations means that a particular feature, structure, configuration, or characteristic described in connection with the embodiment is included in at least one embodiment. Thus, the appearances of the phrase "for one embodiment," "for an embodiment," "for another embodiment," "in other embodiments," "in some embodiments," or their variations in various places throughout this specification are not necessarily referring to the same embodiment. Furthermore, the particular features, structures, configurations, or characteristics may be combined in any suitable manner in one or more embodiments.

The terms "over," "to," "between," and "on" as used herein may refer to a relative position of one layer with respect to other layers. One layer "over" or "on" another layer or bonded "to" or in "contact" with another layer may be directly in contact with the other layer or may have one or more intervening layers. One layer "between" layers may be directly in contact with the layers or may have one or more intervening layers.

For one embodiment, a "valve," and its variations refer to a bi-stable electrical device or system that includes a motor or actuator, e.g., a micro-electromechanical system (MEMS) actuator, or an electro-dynamic actuator having a coil assembly and a magnetic system, such as a balanced armature (BA) system. The valve may be part of an "active vent system" and its variations, which refer to an acoustic system that acoustically couples a sealed ear canal volume to a volume representing an external ambient environment (outside of an ear or outside of an electronic device) using a venting or acoustic pathway. For one embodiment, a "pathway" and its variations refer to a simple network of volumes connected to the valve. For example, and for one embodiment, an active vent system requires a minimal amount of pathways (i.e., volumes) to connect a sealed ear canal volume with a volume representing an external ambient environment (outside of an ear or an electronic device).

For one embodiment, a "volume" and its variations refer to a dynamic air pressure confined within a specified three-dimensional space, wherein the volume may be represented as an acoustic impedance. Depending on a geometry of the volume, the volume's acoustic impedance can behave like a compliance, inertance, (also known as "acoustic mass"), or combination of both. The specified three dimensional space can be expressed in a tangible form as a tubular structure, a cylindrical structure, or any other type of structure with a defined boundary.

For one embodiment, an "in-ear speaker" and its variations refer to electronic devices for providing sound to a user's ear. In-ear speakers are aimed into an ear canal of the user's ear and may or may not be inserted into the ear canal. An in-ear speaker may include acoustic drivers, microphones and other electronic devices. In-ear speakers may be wired or wireless (for purposes of receiving a user content audio signal from an external device). In-ear speakers include, but are not limited to, earphones, earbuds, hearing aids, hearing instruments, in-ear headphones, in-ear monitors, canalphones, personal sound amplifiers (PSAPs), and headsets.

For one embodiment, an "insertable in-ear speaker" and its variations refer to an in-ear speaker that is inserted into an ear canal. This can be achieved via a specified three dimensional space (e.g., a tubular structure, a cylindrical structure, any other type of structure known for facilitating insertion into an ear canal, etc.).

For one embodiment, a "sealable insertable in-ear speaker" and its variations refer to an insertable in-ear speaker that fully seals an ear canal. Sealable insertable in-ear speakers prevent sounds from an ambient environment from leaking into an ear canal during use in an ear canal. Sealable insertable in-ear speakers can also result in an occlusion effect during use in an ear canal.

For one embodiment, a "leaky insertable in-ear speaker" and its variations refer to insertable in-ear speaker that is intentionally designed to allow some sounds from the ambient environment to leak into the user's ear canal during use. Leaky insertable in-ear speakers provide better natural audio transparency than sealable insertable in-ear speakers.

For one embodiment, "audio transparency" and its variations refer to a phenomenon that occurs when a user can hear all of the sounds around him including sounds from the ambient environment, as well as any user content sound that may or may not be produced and delivered into his ear canal (by a user content sound system of the in-ear speaker.)

For one embodiment, an "acoustic driver" and its variations refer to a device including one or more transducers for converting electrical signals into sound. Acoustic drivers include, and are not limited to, a moving coil driver/receiver, a balanced armature (BA) receiver, an electrostatic driver/receiver, an electret driver/receiver, and an orthodynamic driver/receiver. Acoustic drivers can be included in the in-ear speaker, as part of the user content sound system.

For one embodiment, a "hybrid transparency system" and its variations refer to a system that assists with enabling a user of such a system to achieve at least one of (i) isolation from sounds from the ambient environment by preventing those sounds from entering the user's ear canal; or (ii) perception of audio transparency by enabling delivery of sounds from the ambient environment to the ear canal. A hybrid transparency system can include at least one processor that is configured (e.g., programmed) to perform one or more computational functions of the hybrid transparency system. A hybrid transparency system can be implemented as an in-ear speaker, which may be in combination with a personal communication device such as a smartphone, or which may be part of any portable electronic device that converts between electric signals and sound such as a headset or other head worn device.

In one aspect, the hybrid transparency system includes at least one of the embodiments of the balanced armature (BA) based valve described herein. In one aspect, at least one of the embodiments of a BA based valve as described herein are incorporated into a driver assembly comprised of one or more acoustic drivers (which form the user content sound system). In one aspect, the driver assembly includes at least one embodiment of a BA based valve as described herein and at least one of (i) one or more BA receivers known in the art; or (ii) one or more acoustic drivers that are not BA receivers (e.g., one or more acoustic drivers that are of the electrodynamic type, etc.) For example, one embodiment of a BA based valve as described herein is included in a driver assembly, such as one of the driver assemblies described in U.S. patent application Ser. No. 13/746,900 (filed Jan. 22, 2013), which was published on Jul. 24, 2014 as U.S. Patent Application Publication No. 20140205131 A1.

For one embodiment, the valve and the acoustic driver included in the driver assembly are housed in a single housing of the driver assembly. For one embodiment, a first spout is formed on or coupled to a housing of the driver assembly and is shared by the valve and the acoustic driver. For one embodiment, the first spout is to deliver sound that is output or generated by the acoustic driver housed in the driver assembly, to an ear canal. The driver assembly includes a second spout that is formed on the housing of the driver assembly and is primarily used by the valve described herein. For one embodiment, the second spout is to deliver sound from an ear canal into an ambient environment. For one embodiment, the second spout assists with delivering unwanted sound created by an occlusion effect, into the ambient environment that is outside of the ear canal. For one embodiment, the second spout assists with manipulation of the listener or wearer's perceived audio transparency. For one embodiment, the second spout assists with regulation of ear pressure caused by pressure differences in the listener's ear.

At least one of the aspects described above enables a single electric signal input (that corresponds to the desired sound) to be fed into one or multiple acoustic drivers in a driver assembly. Furthermore, the single electric signal input can be electrically filtered using different filters (e.g., a high-pass filter, a low-pass filter, a band-pass filter, etc.) and each of the different types of signals can be fed to the one or more corresponding multiple acoustic drivers in the driver assembly (e.g., tweeters, woofers, super woofers, etc.). The filtering can be performed using a crossover circuit that filters the signal input and feeds the different types of signals to the one or more corresponding multiple acoustic drivers in the driver assembly. Moreover, a driver assembly that includes at least one of the embodiments of a valve described herein can assist with reduction or elimination of amplified or echo-like sounds created by an occlusion effect, as well as, manipulation of perceived audio transparency.

Figure 1B:
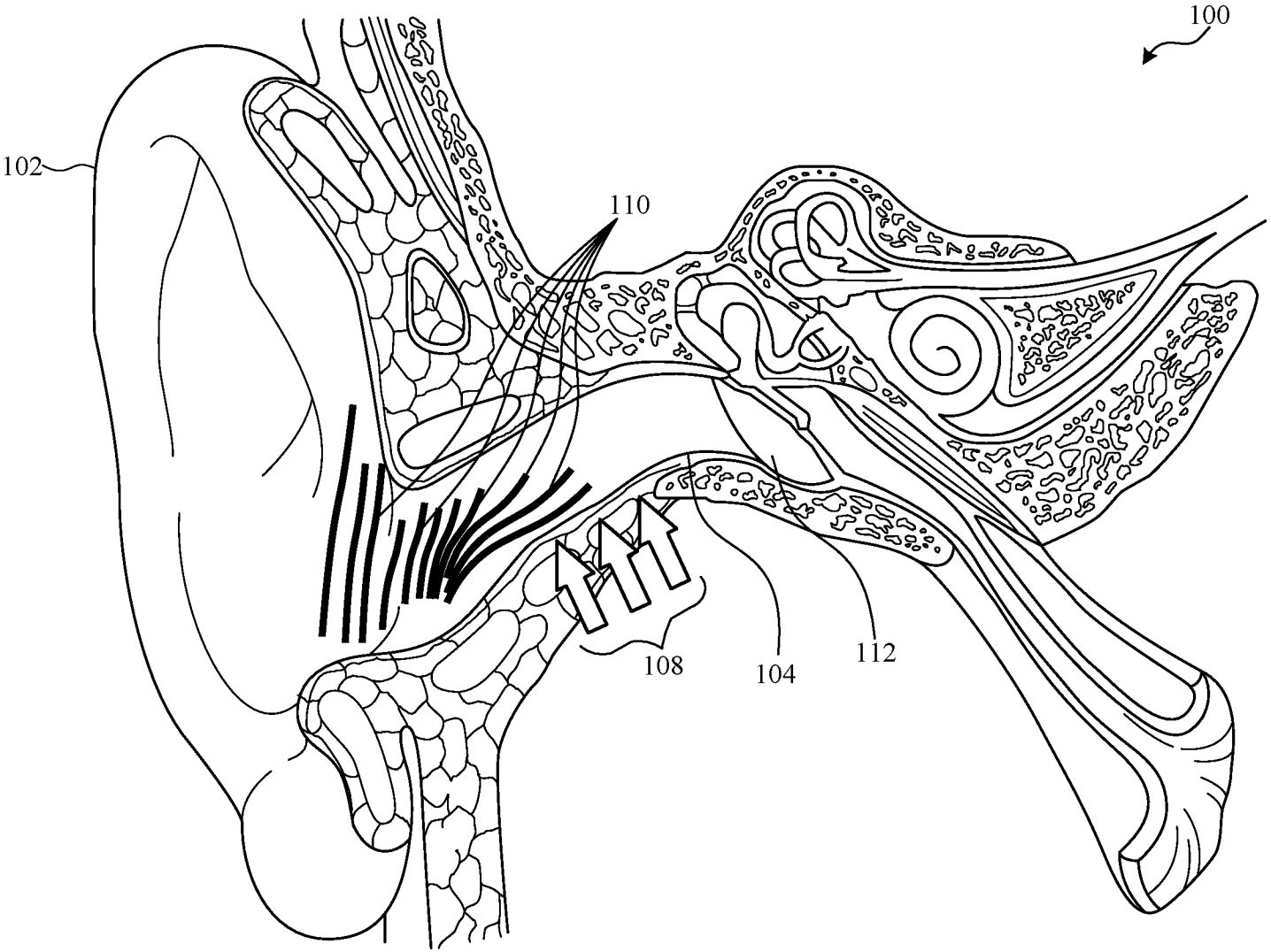

FIGS. 1A-1B are illustrations of occlusion and isolation effects 100 in an ear canal 104 of a listener's ear 102. The in-ear speaker 106 can be sealable insertable in-ear speaker or a leaky insertable in-ear speaker that includes at least one acoustic driver—e.g., a BA receiver, a moving coil driver/receiver, an electrostatic driver/receiver, an electret driver/receiver, an orthodynamic driver/receiver, etc.

With regard to FIG. 1A, the occlusion and isolation effects 100 occur when an in-ear speaker 106 seals the ear canal 104. In order to deliver a desired sound that is produced by the in-ear speaker 106 to a listener's eardrum 112, the in-ear speaker 106 can partially or fully seal the ear canal 104. In other words, the in-ear speaker 106 fills at least some portion of the ear canal 104 to prevent one or more sounds from escaping outside the ear 102. The sealing of the ear canal 104 can be beneficial for preventing loss of low frequency sounds, whose absence can affect the quality of the desired sound being delivered to the ear. Nevertheless, consequences of a sealed ear condition include occlusion and isolation effects 100, which can interfere with a listener's ability to enjoy or perceive the desired audio.

With regard to an occlusion effect 100, the sealing of the ear canal 104 causes the listener to perceive amplified or echo-like sounds 110 of the listener's own voice (e.g., when the listener is talking, etc.) or amplified or echo-like sounds 110 created in the listener's mouth (e.g., sounds created by chewing food, sounds created due to a movement of a listener's body, etc.). Specifically, the occlusion effect 100 is primarily caused by bone and tissue-conducted sound vibrations 108 reverberating off the in-ear speaker 106 filling the ear canal 104. The amplified sounds 110 are caused by the volume of air between the tympanic membrane and the in-ear speaker 106 filling the ear canal 104 becoming excited from bone and tissue conduction.

In addition, the sealing of the ear canal 104 creates an isolation effect 100 that prevents one or more sounds from the ambient environment from entering into the listener's ear canal 104 and reaching the ear drum 112. This isolation effect 100 can be unwanted, especially in situations where the listeners wants to receive sounds generated by the in-ear speaker 106 and also receive one or more sounds from the ambient environment outside the ear 102.

Generally, and as shown in FIG. 1B, the occlusion and isolation effects 100 are not noticeable to most listeners. Specifically, the occlusion effect 100 is not noticeable when listeners are talking or engaged in an activity because the vibrations 108 that cause amplified sounds 110, normally escape through the open ear canal 104 into the ambient environment. Nevertheless, and as shown in FIG. 1A, when the ear canal 104 is sealed by the in-ear speaker 106, the vibrations 108 cannot exit the ear canal 104, and as a result, the sounds 110 become amplified or echo-like because they are reflected back toward the eardrum 112 in the ear 102. Compared to the completely open ear canal 104 in FIG. 1B, the occlusion effect 100 can boost low frequency sound pressure (usually below 500 Hz) in the ear canal 100 by 20 dB or more, as described below in connection with FIGS. 3A-3C. The open ear canal 104 also enables one or more sounds from an ambient environment to perceived by listeners, which in turn reduces or eliminates the isolation effect 100.

Some users of in-ear speakers, such as the in-ear speaker 106, may find the amplified or echo-like sounds created by the occlusion effect 100 or the inability to perceive sound(s) from the ambient environment that results from the isolation effect to be annoying and distracting when they are listening to sound delivered by such in-ear speakers.

Thus, several ways to mitigate or eliminate the occurrence of occlusion and isolation effects are presently utilized. One way to reduce or eliminate the occurrence of an occlusion effect includes combining the in-ear speaker 106 in FIGS. 1A-1B with an active noise control or acoustic noise cancellation ("ANC") digital processor and its associated, error microphone, both of which are not shown in FIGS. 1A-1B. The error microphone can be used to pick up the amplified sounds 110 created by the occlusion effect 100, which are then converted to digital audio signals and processed by the ANC processor into an anti-phase estimate of the unwanted sounds 110; the anti-phase estimate is then converted into a sound field by an acoustic driver of the in-ear speaker 106, in hopes of destructively interfering with and therefore reducing the unwanted sounds 110 created by the occlusion effect 100. Nevertheless, this way of reducing the occlusion effect 100 requires the use of digital signal processing ("DSP"), which can result in a level of power consumption that is not ideal for some types of in-ear speakers (e.g., a size-critical in-ear speaker, a wireless in-ear speaker, etc.).

With regard to isolation effects, one way of reducing these effects includes use of a leaky insertable in-ear speaker (as opposed to sealable insertable in-ear speakers). Leaky insertable in-ear speakers provide better audio transparency than sealable insertable in-ear speakers. Nevertheless, sounds from the ambient environment may be unwanted to a user. To avoid this scenario, sealable insertable in-ear speakers may be used by the user. Thus, the user may have to gain access to both sealable insertable in-ear speakers and leaky insertable in-ear speakers in order to avoid the shortcomings of both.

Figure 2:
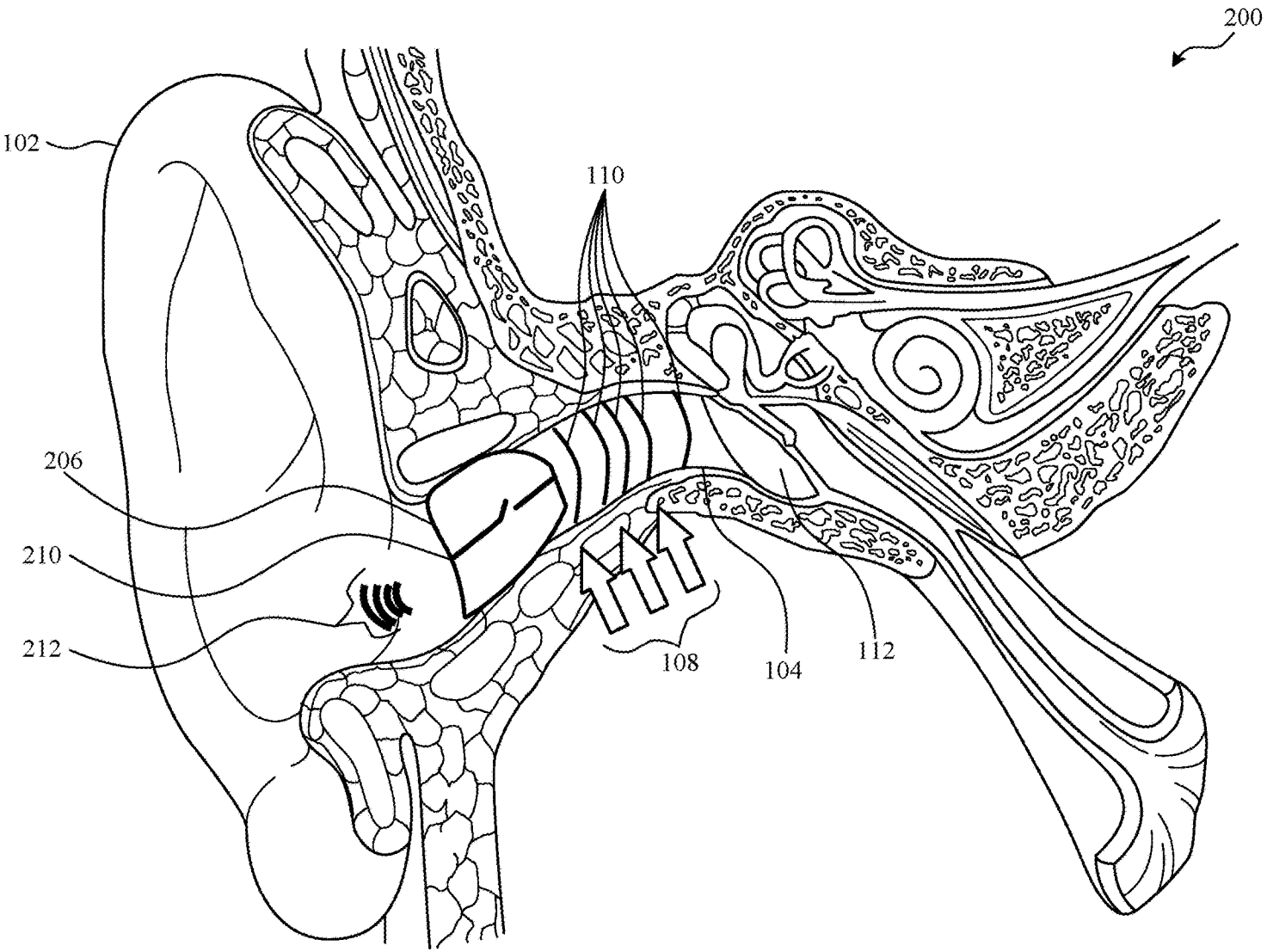
FIG. 2 is an illustration of an in-ear speaker that contains a venting or acoustic pass valve.

FIG. 2 is an illustration of an in-ear speaker 206 including one embodiment of a venting or acoustic pass valve 210 that can assist with mitigating or eliminating an occlusion effect 200 in an ear canal 104. FIG. 2 is a modification of FIGS. 1A-1B, which are described above. In contrast with the in-ear speaker 106 of FIG. 1A, the in-ear speaker 206 includes a venting or acoustic pass valve 210 that acts as a switching valve that can be signaled (switched) open, in order to allow some of the amplified or echo-like sounds 110 to escape (vent or pass) into the ambient environment, instead of being reflected onto eardrum 112. The escaped sounds 212 consequently reduce (or even eliminate) the amplified or echo-like sounds 110 that are perceived by the listener. In this way, the occlusion effect 200 can be reduced or eliminated. The in-ear speaker 206 can include the valve 210 and at least one acoustic driver—e.g., a BA receiver, a moving coil driver/receiver, an electrostatic driver/receiver, an electret driver/receiver, an orthodynamic driver/receiver, etc.

In addition, the valve 210 can be used to improve an isolation effect. The valve 210 can be signaled (switched) closed, to prevent sounds from the ambient environment from entering into the ear canal 104.

For one embodiment, the valve 210 is a bi-stable electrical device or system that consumes a minimal amount of power, when compared with the DSP-based system described above having an ANC processor and an error microphone. Specifically, and for one embodiment, a motor of the BA based valve 210 is designed to be bi-stable, so that the power consumption of the valve 210 occurs only when the valve 210 is moving between its two states, as an open valve or a closed valve. For this embodiment, power is not needed when the valve 210 is not changing from a closed position to an open position and vice versa. In this way, the valve 210 can be used to reduce or eliminate the occlusion effect in an in-ear speaker 206, without the increased levels of power consumption associated with an ANC processor and an error microphone. Additional details about the bi-stable operation of one embodiment of a valve 210 that is BA-based are described below in connection with FIGS. 5A-7B. The valve 210 illustrated in FIG. 2 can be similar to or the same as at least one of the BA based valves described below in connection with at least one of FIGS. 5A-17.

Figure 3A:
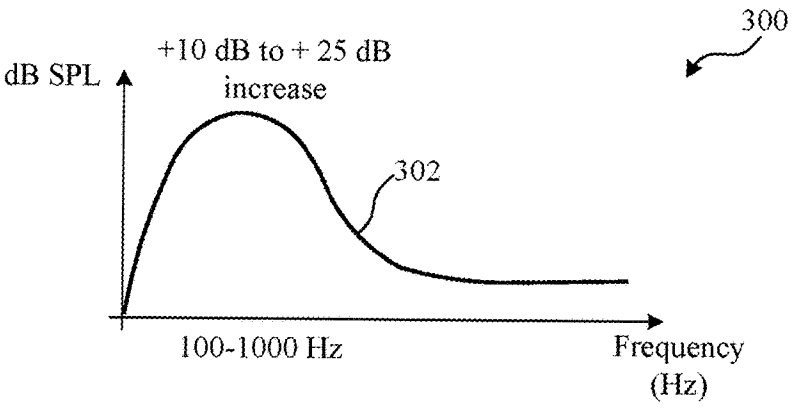
FIGS. 3A-3C are charts illustrating sound levels in an ear canal based on FIGS. 1A, 1B, and 2, respectively.
Figure 3B:
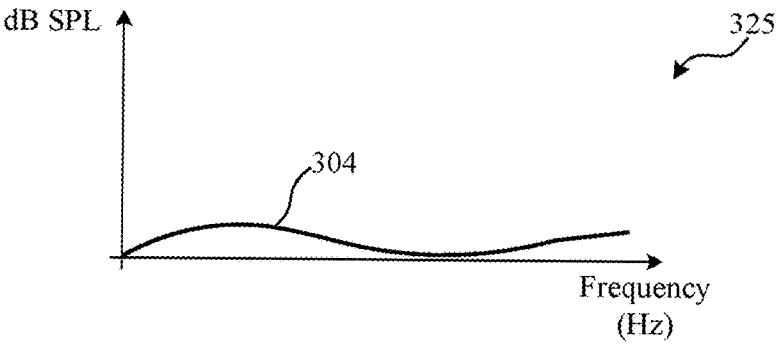
Figure 3C:
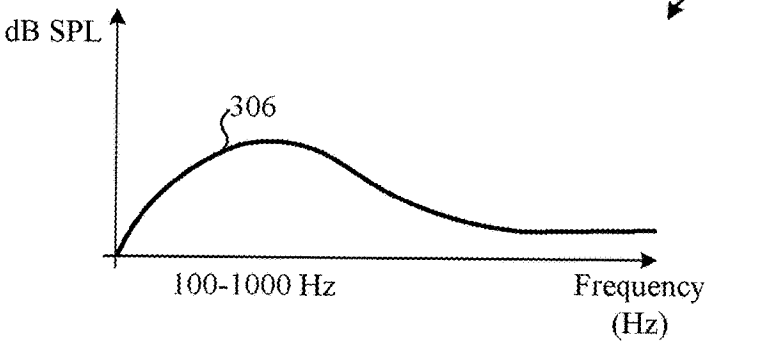

FIGS. 3A, 3B, and 3C are charts illustrating sound levels in a listener's ear canal based on the occlusion effects described above in FIGS. 1A, 1B, and 2, respectively. With regard to FIGS. 3A and 3B, a comparison of curve 302 with curve 304 shows that low frequency sounds between 100 Hz and 1000 Hz that would normally escape from a completely open ear canal 104 become amplified when the occlusion effect 100 is caused by a sealing of the ear canal 104 by the in-ear speaker 106. Specifically, curve 302 shows that low frequency sounds between 100 Hz and 1000 Hz are amplified by as little as 10 dB SPL (sound pressure level) to as much as 25 dB SPL.

With regard to FIG. 3C, curve 306 represents the level of sound amplification attributable to the occlusion effect 200 that is caused when one embodiment of the in-ear speaker 206 seals the ear canal 104. A comparison of curve 306 with curve 304 shows that the low frequency sounds between 100 Hz and 1000 Hz are amplified less severely when the in-ear speaker 206 seals the ear canal 104 than when the in-ear speaker 106 seals the ear canal 104. For one embodiment, the cause of the less severe amplification is due to the BA based valve 210 acting as a switching valve within the in-ear speaker 206.

Figure 4:
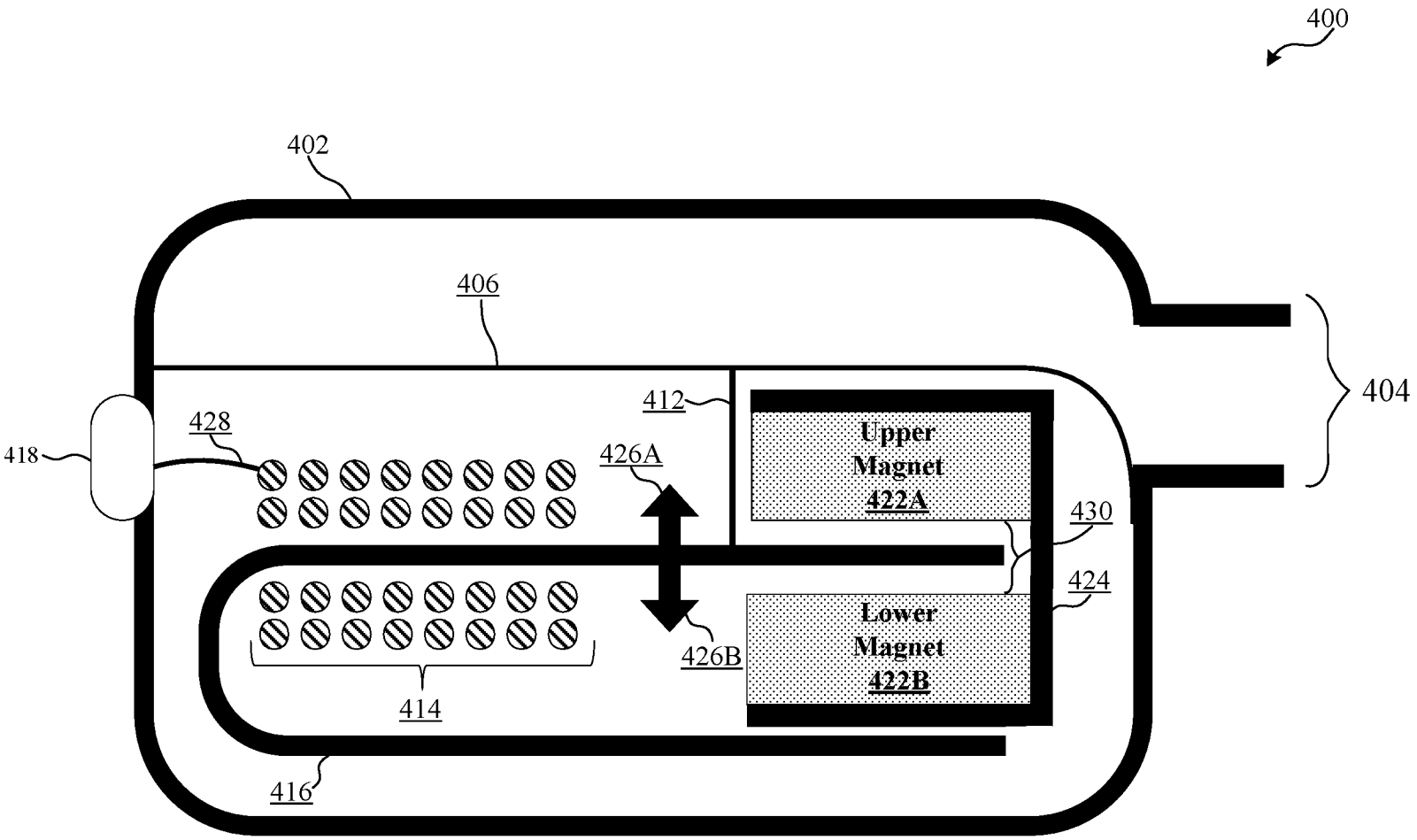
FIG. 4 (PRIOR ART)
FIG. 4 is a cross-sectional side view illustration of an exemplary acoustic driver that is presently utilized.

FIG. 4 is a cross-sectional side view illustration of an exemplary acoustic driver 400 that is presently utilized. The in-ear speaker may contain the acoustic driver 400, thereby enabling its wearer to hear user content such as a telephone call conversation or a musical work (reflected in an audio signal at the input of the acoustic driver 400). The specific type of acoustic driver 400 that is illustrated in FIG. 4 is a balanced armature (BA) receiver. The acoustic driver 400, however, is not so limited. This acoustic driver 400 can be any type of acoustic driver—e.g., a BA receiver, a moving coil driver/receiver, an electrostatic driver/receiver, an electret driver/receiver, an orthodynamic driver/receiver, etc.

The acoustic driver 400 includes a housing 402 that holds, encases, or is attached to one or more of the components of the acoustic driver 400. Furthermore, and for one embodiment, the housing 402 includes a top side, a bottom side, a front side, and a rear side. For one embodiment, the front side of the housing 402 is substantially parallel to the rear side of the housing 402, while the top side of the housing 402 is substantially parallel to the bottom side of the housing 402. When the acoustic driver 400 is part of an in-ear speaker that is placed in a user's ear, the rear side of the housing 402 is further away from the user's ear canal than the front side of the housing 402 and the rear side of the housing 402 is closer to an ambient environment than the front side of the housing 402.

In the illustrated example of the acoustic driver 400, a spout 404A is formed on or attached to the front side of housing 402; a terminal 418 is formed on or attached to the rear side of housing 402; the spout 404A is closer to the top side of housing 502; and the spout 404A is farther from the bottom side of housing 402. The spout 404 is formed on or welded to housing 402 to enable one or more sound waves converted from one or more electrical signals by acoustic driver 400 to be delivered or emitted into an ear of a listener (e.g., ear 102 of FIGS. 1A-2) or an ambient environment. The acoustic driver 400 outputs the sound waves using a membrane or diaphragm (hereinafter "membrane") 406, a drive pin 412, a coil assembly 414, an armature or a reed (hereinafter "armature") 416, a terminal 418, and a magnetic system. The magnetic system of the acoustic driver 400 includes an upper magnet 422A, a lower magnet 422B, a pole piece 424, and an air gap 430. The acoustic driver 400 also includes an electrical cable or connector 428 between the terminal 418 and the coil assembly 414. The terminal 418 is electrically connected to a flex circuit (not shown) that provides an input electrical signal to the acoustic driver 400. The flex circuit (not shown) is used to provide one or more electrical input signals from a crossover circuit (not shown) to the acoustic driver 400. The crossover circuit is electrically connected to one or more external devices that generate the one or more electrical input signals. It is to be appreciated that the crossover circuit is not always necessary, especially when the electrical input signal is not being filtered.

Operation of the acoustic driver 400 begins when the one or more electrical input audio signals are received at the terminal 418 and passed on to the coil assembly 414, via the connector 428. In response to receiving the electrical input audio signal, the coil assembly 414 produces electromagnetic forces that trigger a movement of the armature 416 in the directions 426A and 426B in the air gap 430. Generally, the magnetic system of the acoustic driver 400 (which includes the upper magnet 422A, the lower magnet 422B, the pole piece 424, and the air gap 430) is tuned to prevent the armature 416 from being in contact with either of the magnets 422A-B. In this way, the armature 416 oscillates between the magnets 422A-B while produces the sound waves. The drive pin 412, which is connected to the armature 416 and the membrane 406, moves in proportion to the oscillating movements of the armature 416. The movements of the drive pin 412 cause vibrations or movements of the membrane 406, which create sound waves in the air above the membrane 406, as per the variation in the coil current of the coil assembly 414 dictated by the audio signal.

The coil assembly 414 can, for example, be a coil winding that is wrapped around a bobbin or any other type of coil assembly known in the art. The armature can be placed through the coil assembly 414. The armature 416 can be optimized based on its shape or configuration to enable production of a broad band of sound frequencies (e.g., low, mid-range, high frequencies, etc.). Furthermore, the drive pin 412 can be connected to the membrane 406 using an adhesive or any other coupling mechanism known in the art.

Figure 5A:
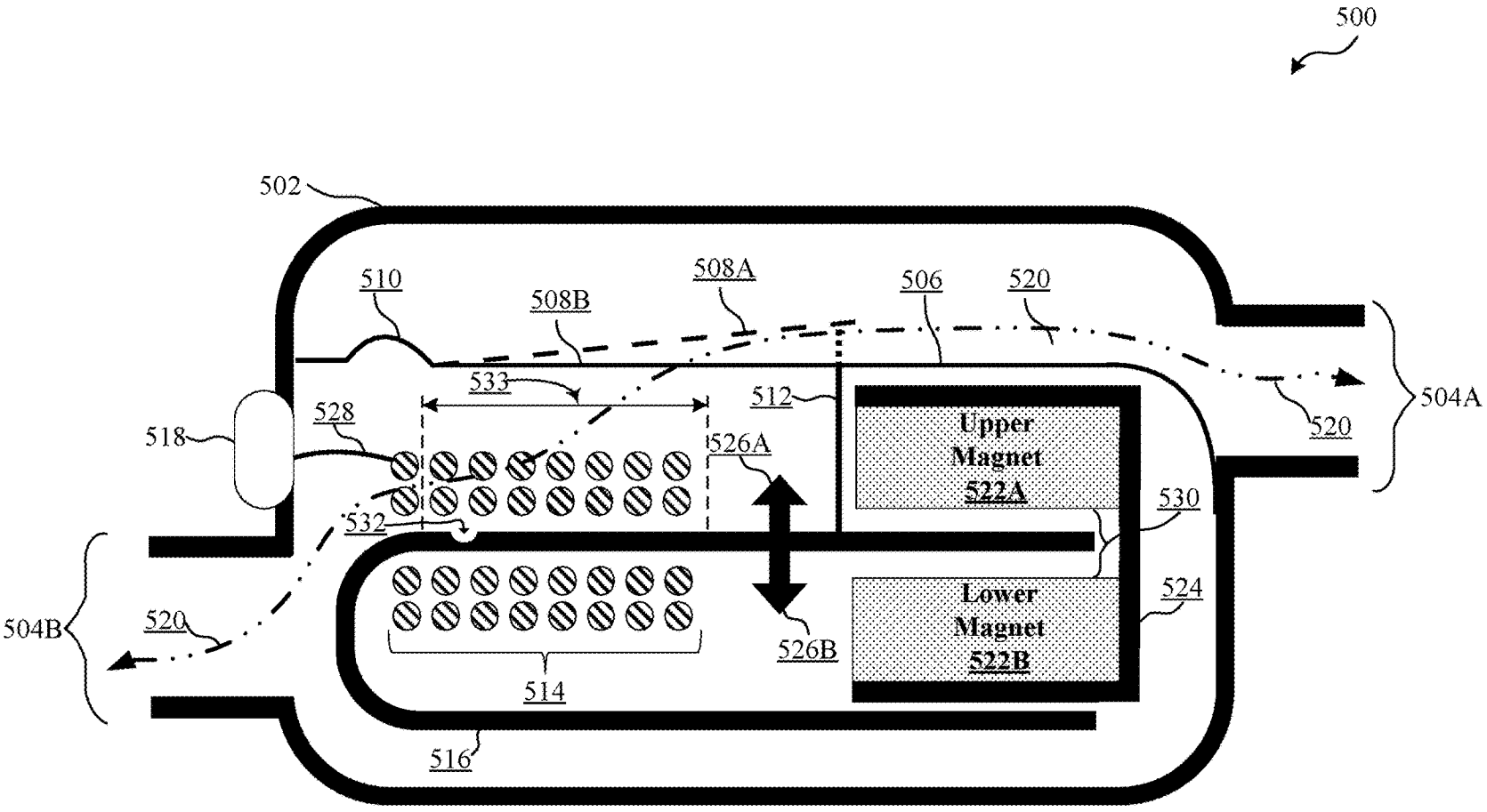
FIG. 5A is a cross-sectional side view illustration of one embodiment of a balance armature based (BA based) valve.

FIG. 5A is a cross-sectional side view illustration of one embodiment of a BA based valve 500. The BA based valve 500 is a modification of the acoustic driver 400 of FIG. 4. For the sake of brevity, only the differences between the acoustic driver 400 (which is described above in connection with FIG. 4) and the BA based valve 500 will be described below in connection with FIG. 5.

Some differences between the example of the acoustic driver 400 depicted in FIG. 4 and the BA based valve 500 relate to the presence of two spouts 504A-B, a membrane 506 (including a valve flap 508 and a hinge 510), an armature 516, a coil assembly 514, two magnets 522A-B, a pole piece 524, and an air gap 530 in the BA based valve 500. For a first example, and for one embodiment, the valve flap 508 of the membrane 506 of the BA based valve 500 can be in an open position 508A or a closed position 508B, while the membrane 406 of the acoustic driver 400 lacks any valve flap or other mechanism capable of being opened or closed. For a second example, and for one embodiment, the membrane 506 of the BA based valve 500 does not vibrate to create sound, while the membrane 406 of the acoustic driver 400 vibrates to create sound.

For one embodiment, the BA based valve 500 includes two spouts 504A and 504B, which may be formed on or coupled to the housing 502 as is known in the art. For the illustrated embodiment of the BA based valve 500, the spout 504A is formed on or coupled to the front side of the housing 502; the spout 504B and a terminal 518 are formed on or attached to the rear side of the housing 502; the spout 504A is closer to the top side of the housing 502; the spout 504A is farther from the bottom side of the housing 502; and the spout 504B is closer to the bottom side of the housing 502.

For one embodiment, the spout 504A is similar to or the same as the spout 404, which is described above in FIG. 4. For one embodiment, the spout 504A works in combination with the spout 504B to diffuse amplified or echo-like sounds that are created by an occlusion effect, outward into an ambient environment or away from a listener's ear canal, so as to mitigate or eliminate the unwanted sounds. For one embodiment, the spout 504B is similar to the spout 404 (which is described above in FIG. 4); however, the spout 504B does not face the ear canal of the listener. For this embodiment, spout 504B faces outward or opens to the ambient environment to enable amplified sound waves created by an occlusion effect to be delivered or emitted into the ambient environment away from the ear canal of the listener.

For one embodiment, the amplified or echo-like sound created by an occlusion effect is diverted into the ambient environment when the valve flap 508 is open. For one embodiment, the sound from the ambient environment is restricted from entering the ear canal when the valve flap 508 is closed. The valve flap 508 of the membrane 506 is open at the position 508A and closed at the position 508B. For one embodiment, the hinge 510 is created as part of the membrane 506 to enable the opening and closing of the valve flap 508. For one embodiment, when the valve flap 508 is in the open position 508A, the spouts 504A-B work together to divert some or all of the amplified or echo-like sounds created by an occlusion effect out away from a listener's ear canal. In this way, the BA based valve 500 can enable a listener to reduce an occlusion effect, when desired.

For one embodiment, an in-ear speaker that includes the BA based valve 500 can enable manipulation of a listener's perceived audio transparency, based on the opening or closing of the valve flap 508. For one embodiment of an in-ear speaker that includes the BA based valve 500, when the valve flap 508 is in the open position 508A, a listener can made aware of auditory stimuli in his surroundings because sound waves from the ambient environment can travel through the housing 502 generally along a sound transmission path 520 that connects the two spouts 504A-B. For this embodiment, the listener is still receiving ambient sounds, and as a result, his perception of audio transparency is enhanced. For one embodiment of an in-ear speaker that includes the BA based valve 500, when the valve flap 508 is in the closed position 508B, the BA based valve 500 acts as an ambient noise blocker, for a listener that does not want to perceive auditory stimuli from his surroundings. For this embodiment, the listener will receive only the sounds that are being actively generated or produced by an acoustic driver of the in-ear speaker, which can be beneficial in certain situations. In this way, the BA based valve 500 can enable a listener to reduce an occlusion effect when desired, become aware of sounds in the ambient environment when desired, or prevent sounds from the ambient environment from reaching the listener's ear canal when desired.

For one embodiment, an in-ear speaker that includes the BA based valve 500 can assist with regulation of ear pressure caused by pressure differences in a listener's ear. The pressure differences can result from pressure changes in the ambient environment, e.g., as the listener using an in ear-speaker moves—such as in an aircraft's cabing from a lower elevation with one level of pressure to a higher elevation that has a different level of pressure, etc. When wearing an in-ear speaker, such ambient pressure changes can be uncomfortable or even painful. For one embodiment, an in-ear speaker that includes the BA based valve 500 can regulate the pressure differences in the listener's ear when he is using the in-ear speaker. For one embodiment of an in-ear speaker that includes the BA based valve 500, when the valve flap 508 is in the closed position 508B, the listener's ear is isolated from ambient pressure changes. The isolation from ambient pressure changes is achieved because air flow from the ambient environment is prevented from traveling through the housing 502, between the two spouts 504A-B. The air pressure above the diaphragm of the in-ear speaker is thus isolated from the air pressure in the ambient environment, and as a result, the listener's inner ear is sealed off from ambient pressure change. When the valve flap 508 is actuated into the open position 508A, however, the listener's ear is no longer isolated from changes in ambient pressure. In this way, the BA based valve 500 can enable a listener to regulate changes in ear pressure that result from ambient pressure changes when desired, reduce an occlusion effect when desired, become aware of sounds in the ambient environment when desired, or prevent sounds from the ambient environment from reaching the listener's ear canal when desired.

For one embodiment, one or more of the control signals that cause the opening or closing of the valve flap 508 can be based on one or more measurements by one or more sensors (not shown) and based on an operating state of an external electronic device (e.g., a smartphone, a computer, a wearable computer system, or other sound source.) The external electronic device may be the source of a user content audio signal that is being delivered using a wired or a wireless link or connection between the external electronic device and the in-ear speaker. For one embodiment, the one or more sensors can include at least one of an accelerometer, a sound sensor, a barometric sensor, an image sensor, a proximity sensor, an ambient light sensor, a vibration sensor, a gyroscopic sensor, a compass, a barometer, a magnetometer, or any other sensor which may be installed within a housing of the in-ear speaker or within a housing of the external electronic device. A purpose of the sensor is to detect a characteristic of one or more environs. For one embodiment, one or more control signals are applied to the coil assembly 514 of the valve that are based on one or more measurements by the one or more sensors. For one embodiment, the one or more sensors are included as part of the BA based valve 500, as part of an in-ear speaker that includes the BA based valve 500 (e.g., within the external housing of the in-ear speaker—not shown), or they may be part of the external electronic device (e.g., a smartphone, a computer, a wearable computer system, etc.) In the latter case, the control signal may be provided from outside of the housing 502, to the BA based valve 500, via the terminal 518.

For one embodiment, the one or more sensors are coupled to logic that determines, based on one or more measurements by the one or more sensors, when one or more of the control signals that cause the opening or closing of the valve flap 508 are to be applied to the coil assembly 514 (or to another valve actuator). The logic circuitry can be included in the housing 502 of the BA based valve 500, in the housing of an in-ear speaker in which the BA based valve 500 is contained, or in the housing of an external electronic device (e.g., a smartphone, a tablet computer, a wearable computer system, etc.) that provides the user content electrical audio signals that are converted to sound for a listener (by the in-ear speaker).

In a first example, and for one embodiment, the one or more sensors include a sound sensor (e.g., a microphone, etc.). In this first example, the BA based valve 500 is included in an in-ear speaker that is connected to an external electronic device that can play audio/video media files and conduct telephony (e.g., a smartphone, a computer, a wearable computer system, etc.). In this first example, the sound sensor may be included inside the housing 502 of the BA based valve 500, or it may be in the housing of the in-ear speaker that includes the BA based valve 500, or in the housing of the external electronic device (e.g., a smartphone, a computer, a wearable computer system, etc.). In this first example, the logic for determining whether the valve flap 508 is to be opened is included in at least one of the BA based valve 500, the in-ear speaker that includes the BA based valve 500, or the external electronic device (e.g., a smartphone, a computer, a wearable computer system, etc.). In this first example, the listener is listening to audio from the external electronic device (e.g., a smartphone, a computer, a wearable computer system, etc.) using an acoustic driver that is in the in-ear speaker. When the sound sensor detects the listener's voice for a threshold amount of time, the logic determines that the listener (with the in-ear speaker in his/her ear) may be engaged in a phone/video call or a conversation with another human. In this first example, the logic provides the one or more control signals that cause the valve flap 508 to be opened, in response to the determination that the listener is on a phone/video call or in a conversation with another human. In this way, the sound sensor, the logic, and the BA based valve 500 assist with a reduction of an occlusion effect that can occur when the listener (with the in-ear speaker in his/her ear) is engaged in a phone/video call or a conversation with another physical human.

In a second example, a software component running on the external electronic device (e.g., a smartphone, a computer, a wearable computer system, etc.) can determine an operating state of a software application (e.g., a media player application, a cellular telephony application, etc.) that is also running in the external device and that may be producing the user content audio signal. Based on this operating state, the software component can determine whether to open or close the valve flap 508 and will then signal the valve actuator (e.g., the coil assembly 514) accordingly. For one embodiment, the software component on the external electronic device can also use data from the one or more sensors (e.g., the sound sensor, an accelerometer, etc.) in addition to the operating state of the software application, to determine whether to open or close the valve flap 508. In this second example, and for one embodiment, the sound sensor initially detects no sound from the listener (e.g., the listener is not talking but is listening to audio from the in-ear speaker) and the software component determines one or more operating states of an application on the external electronic device. In this second example, and for one embodiment, one determined operating state is that a media player application is being used to generate the user content audio signal (that is being converted into sound by the acoustic driver in the in-ear speaker) as the listener is listening to audio; and another determined operating state is that a cellular telephony application is not being used, because no phone/video call has been placed or received. In this case, the software component can, based on the operating state of the applications and the data from the sound sensor, cause one or more control signals to be sent to a valve actuator (e.g., the coil assembly 514) to close the valve flap 508. Shortly after this, the operating state of an application on the external electronic device may change because a phone call begins (e.g., a call is placed or received using the cellular telephony application, etc.), and the sound sensor detects that the listener is speaking. In this further case, based on the change in the operating state of the application and the based on data from the sound sensor, the software component causes a control signal to be sent to the valve actuator to open the valve flap 508.

In a third example, and for one embodiment, the one or more sensors include a sound sensor and an accelerometer. In this third example, as in the second example given above, an acoustic driver of the in-ear speaker is connected to receive a user content audio signal from an external electronic device that can play audio/video media and act as a telecommunications device (e.g., a smartphone, a computer, a wearable computer system, etc.). The sound sensor is included in at least one of the valve 210 (e.g., the BA based valve 500), the in-ear speaker that includes the BA based valve 500, or the external electronic device (e.g., a smartphone, a computer, a wearable computer system, etc.). In this third example, the accelerometer is included in at least one of the BA based valve 500, the in-ear speaker that includes the BA based valve 500, or the external electronic device (e.g., a smartphone, a computer, a wearable computer system, etc.). In this third example, the logic for determining whether the valve flap 508 is to be opened can be included in at least one of the BA based valve 500, the in-ear speaker that includes the BA based valve 500, or the external electronic device (e.g., a smartphone, a computer, a wearable computer system, etc.). In this third example, the listener is watching a video and/or listening to audio from the external electronic device (e.g., a smartphone, a computer, a wearable computer system, etc.) using the in-ear speaker that includes the BA based valve 500. In this third example, the sound sensor does not detect the listener's voice for a threshold period of time, and the logic determines that the listener is not engaged in a phone/video call on the external electronic device and is not engaged in a conversation with another physical person. In addition, and in this third example, the accelerometer detects that the listener has been moving for a threshold period of time, and as a result, the logic determines that the listener is engaged in a physical activity (e.g., walking, running, lifting, etc.). In this second example, the logic in response to detecting physical activity by the listener provides one or more control signals to the terminal 518 that cause the valve flap 508 to open, in response to the determination that the listener is engaged in a physical activity even though the listener is not engaged in a conversation with a physical human and not engaged in a phone/video call. In this way, the sound sensor, the accelerometer, the logic, and the BA based valve 500 assist with manipulation of audio transparency even when the listener (with the in-ear speaker in his/her ear) is not engaged in a phone/video call or a conversation with a physical human.

In a fourth example, and for one embodiment, the one or more sensors include a barometric sensor. In this fourth example, the BA based valve 500 is included in an in-ear speaker that is connected to an external electronic device (e.g., a smartphone, a computer, a wearable computer system, etc.). In this fourth example, the barometric sensor is included in at least one of the BA based valve 500, the in-ear speaker that includes the BA based valve 500, or the external electronic device (e.g., a smartphone, a computer, a wearable computer system, etc.). In this fourth example, logic for determining whether the valve flap 508 is to be opened or closed can be included in at least one of the BA based valve 500, the in-ear speaker that includes the BA based valve 500, or the external electronic device (e.g., a smartphone, a computer, a wearable computer system, etc.). In this fourth example, and for one embodiment, the listener is using the in-ear speaker that includes the BA based valve 500 with the external electronic device to perform an activity (e.g., watching a video, listening to audio, browsing the internet, etc.). In this fourth example, the barometric sensor detects a change in the ambient air pressure by a threshold amount and/or for a threshold period of time. In this fourth example, in response to measurements of the barometric sensor, the logic determines that the pressure changes in the listener's ear could be uncomfortable or painful for the listener. In this fourth example, the logic provides one or more of the signals that cause the closing of the valve flap 508 in order to assist with isolating the listener's ear pressure from the ambient pressure changes. For one embodiment, the logic provides the one or more signals to the terminal 518 in response to the determination that that the pressure changes in the listener's ear may be uncomfortable or painful for the listener. In this way, the barometric sensor, the logic, and the BA based valve 500 assist with regulation of pressure changes in a listener's ear.

For one embodiment, a programmed processor, or a software component being executed by a processor on the external electronic device (e.g., a smartphone, a computer, a wearable computer system, etc.), can analyze and/or gather data provided to or received by one or more software applications (e.g., an atmospheric pressure monitoring application, a weather monitoring application, etc.) that are running on the external electronic device. For one embodiment, based on the analyzed and/or gathered data, the software component determines whether to open or close the valve flap 508 and then sends an appropriate control signal to the coil assembly 514 (that controls the drive pin 512). In a fifth example, and for one embodiment, data is analyzed and/or gathered from a weather monitoring application that is receiving measurements of the atmospheric pressure in the listener's ambient environment from a network. In this fifth example, the software component determines that there has been a change in the atmospheric pressure for a threshold period of time and/or by a threshold amount based on the analyzed and/or gathered data. In this case, the software component can, based on the analyzed and/or gathered data, cause one or more control signals to be sent to the coil assembly 514 to close the valve flap 508. Now, shortly after this, assume that the analyzed and/or gathered data changes (e.g., the software component determines, using data from the weather monitoring application, that the atmospheric pressure has remained stable for a threshold amount of time). In this further case, based on the change in the analyzed and/or gathered data, the software component causes one or more control signals to be sent to the coil assembly to open the valve flap 508. In this way, the logic, the software component of the external electronic device, and the BA based valve 500 assist with regulation of pressure changes in a listener's ear.

Other examples and/or embodiments are also possible. It is to be appreciated that the immediately preceding examples are merely for illustration and are not intended to be limiting. This is because there are numerous types of sensors that cannot be listed or described herein; and because there are numerous ways in which the numerous types of sensors can be used and/or combined to trigger an opening or closing of the valve 210 (e.g., using the valve flap 508 in the case of the BA based valve 500.) It is also to be appreciated that one or more of the examples and/or embodiments described above can be combined or practiced without all of the details set forth in the examples and/or embodiments described above.

For one embodiment, the logic that determines, based on one or more measurements of the one or more sensors, when one or more of the signals that cause the opening or closing of the valve flap 508 are applied to the coil assembly 514 can be manually overridden by the listener, to open or close the valve flap 508 when the listener chooses. For example, and for one embodiment, an external electronic device (which is electrically connected to an in-ear speaker that includes the BA based valve 500) can include one or more input devices that enable a listener to provided one or more direct inputs that cause the logic to directly provide one or more control signals that cause the coil assembly 514 to open or close the valve flap 508 (as indicated by the direct inputs from the listener). For this embodiment, the logic is forced to provide the control signal to the valve actuator based one or more direct inputs that are provided to the external electronic device (containing the logic.) For one embodiment, the external electronic device includes, but is not limited to, the in-ear speaker that includes the BA based valve 500, a smartphone, a computer, and a wearable computer system.

For one embodiment of the BA based valve 500, as depicted in FIG. 5A for example, each of the membrane 506, the valve flap 508, the hinge 510, the armature 516, and the magnetic assembly (which includes the coil assembly 514, the two magnets 522A-B, the pole piece 524, and the air gap 530) is specially designed so that the armature 516 (and by extension, the drive pin 512) is operable in a bi-stable manner. For one embodiment, the bi-stable operation of the armature 516 results from an application of one or more electrical input or control signals, from a low power current source to the coil assembly 514, which in turn creates a magnetic flux that causes the armature to move upward 526A towards the upper magnet 522A or downwards 526B towards the magnet 522B. The magnets 522A-B are of sufficient magnetic strength to cause the armature 516 to make contact with the magnets 522A-B, and this causes the drive pin 512 to either actuate valve 508 into the open position 508A or the closed position 508B. To achieve this bi-stable operation, each of the membrane 506, the valve flap 508, the hinge 510, the armature 516, and the magnetic assembly of the BA based valve 500 are made from materials that result in an opening or a closing of the valve flap based on the low power current provided to the coil assembly 514, via the terminal 518. Additional details about the opening or the closing of the valve flap 508 based on a low power current are described below in connection with FIGS. 7A-7B.

For one embodiment, the membrane 506 has a substantially rectangular shape, is between the top and bottom sides of housing 502, and is approximately parallel or substantially parallel to the top and bottom sides of housing 502. Furthermore, and for one embodiment, each of the coil assembly 514, the armature 516, and the magnetic system of BA based valve 500 are between the membrane 506 and the bottom side of housing 502. For one embodiment, the membrane 506 is approximately 7.5 mm by 3.9 mm. For one embodiment, the membrane 506 is a multi-part assembly comprising a main part of the membrane 506, the valve flap 508, and the hinge 510. For one embodiment, the main part of the membrane 506 is made of one or more materials that do not move or vibrate in response to the movement of the drive pin 512. For this embodiment, the valve flap 508 of the membrane 506 is made of one or more materials that move in compliance with the movement of the drive pin 512. Furthermore, and for this embodiment, the hinge 510 can be at least as immovable as the main part of the membrane 506 to facilitate with the movement of the valve flap 508 by the drive pin 512. In a first example, the main part of the membrane 506 and the hinge 510 are made of at least one of nickel or aluminum; and multi-layered with copper to immobilize those parts of the membrane 506. In this first example, the valve flap 508 is not immobilized with copper. In a second example, the main part of the membrane 506 and the hinge 510 are made of at least one of nickel or aluminum; and a frame of copper is used to encase the main part of the membrane 506 and the hinge 510 so as to immobilize those parts of the membrane 506. In this second example, the valve flap 508 is not encased in copper, and as a result, the valve flap 508 not immobilized. In the two preceding examples, the valve flap is not immobilized to enable its compliance with the movements of the drive pin 512.

For one embodiment, the main part of the membrane 506 is made from at least one of Biaxially-oriented polyethylene terephthalate (hereinafter "BoPET"), aluminum, copper, nickel, or any other suitable material or alloy known in the art. For one embodiment, the valve flap 508 is made from BoPET, aluminum, copper, nickel, or any other suitable material or alloy known in the art. For one embodiment, the hinge 510 is made from BoPET, aluminum, copper, nickel, or any other suitable material or alloy known in the art. For one embodiment, each of the main part of the membrane 506 and the hinge 510 is formed using a metal forming process, e.g., electroforming, electroplating, etc. For one embodiment, the valve flap 508 is formed on the membrane 506 using an etching process, e.g. laser marking, mechanical engraving, chemical etching, etc.

For one embodiment, the valve flap 508 dictates the size of the membrane 506, which includes the size of the main part of membrane 506 and the size of the hinge 510. For one embodiment, the valve flap has a diameter that is between 1.5 mm and 2 mm. For one embodiment, the valve flap 508 is a substantially rectangular or oblong shape with a length of 4 mm and a width of 6 mm. For a first example, and for one embodiment, the valve flap has a cross-sectional area between 1 $mm^2$ and 3 $mm^2$. For a second example, and for one embodiment, the valve flap 508 has a cross-sectional area between 1.75 $mm^2$ and 3.1 $mm^2$. For one embodiment, the size of the valve flap 508 can affect the level of reduction of an occlusion effect and the ability of a listener to manipulate perceived audio transparency. For a first example, and for one embodiment, a valve flap 508 with a size of 1.75 $mm^2$ can assist with improved occlusion reduction. For a second example, and for one embodiment, a valve flap 508 with a size of 3.1 $mm^2$ minimum can assist with improved perception of audio transparency because the opened valve flap 508A enables the BA based valve 500 to match open ear behavior, which occurs at sound frequencies that are approximately less than or equal to 1.0 kHz. For one embodiment, the shape of the valve flap 508 matches the cross sectional area of the connecting pathways to a listener's ear in a medial location and to the ambient environment in a lateral location to minimize acoustic reflections in the transmission line 520. For one embodiment, the shape of the valve flap 508 can be substantially rectangular, substantially circular, substantially oblong, or any variation or combination thereof. For a further embodiment, the shape of the valve flap 508 is dictated by one or more design constraints. For example, the design constraints described herein, the design constraints associated with manufacturing processes, etc.

For one embodiment, the armature 516 is a U-shaped armature or an E-shaped armature, as is known in the art. For one embodiment, the armature 516 is modified U-shaped armature with a crimp or a dimple (hereinafter "dimple") 532, which is illustrated in FIG. 5A. The dimple 532 converts an arm of the armature 516 that is between the magnets 522A-B into a movable arm of the armature 516. As a result, the movable arm of the armature 516 can assist with the bi-stable operation of the armature 516 because the movable arm can move in compliance with one or more forces created by the coil assembly 514 and the magnets 522A-B. For one embodiment, the dimple 532 is located anywhere on the movable arm of the armature 516 that is between the following two points: (i) a tangent point located at or near the beginning of the curved portion of the movable arm of the armature 516; and (ii) a point on the movable arm of the armature 516 that is closer to the drive pin 512 than the tangent point. For a first example, and for one embodiment, the dimple 532 is located anywhere within a portion 533 of the movable arm of the armature 516, as illustrated in FIG. 5A. For a second example, and for one embodiment, the dimple 532 is located within the first twenty-five percent (25%) of the length of the movable arm, as measured from the tangent point located at or near the beginning of the curved portion of the movable arm of the armature 516. For this embodiment, the dimple 532 can assist with reduction in a stiffness of the armature 516 so that the magnets 522A-B can attract or repel the armature 516 easily. For one embodiment, the dimple 532 can be included in any type of U-shaped armature that is used in any of the embodiments of a BA based valve as described herein—e.g., any of the BA based valves described in connection with FIGS. 5A-16. The dimple 532 can also be included in any type of U-shaped armature that is used in any known acoustic driver—e.g., the acoustic driver 400 described above in connection with FIG. 4.

For one embodiment, the armature 516 is an E-shaped armature. For this embodiment, the E-shaped armature 516 can assist with mechanically centering the armature 516 between the magnets 522A-B, which can enable bi-stable operation of the armature 516.

For one embodiment, the thickness, material, and formation process of the armature 516 will be defined to meet an excursion range for which the armature 516 will travel in the air gap 530 so as to move or collapse the armature 516 to either one of magnets 522A-B without causing damage or deformation to the armature 516. For one embodiment, the excursion range is between +0.006 inches and −0.006 inches, i.e., the total excursion range is 0.012 inches. For one embodiment, the excursion range is between +0.008 inches and −0.008 inches, i.e., the total excursion range is 0.016 inches. For one embodiment, the total excursion range is at least 0.012 inches. For one embodiment, the total excursion range is at most 0.016 inches. For one embodiment, the air gap 530 is at least approximately 0.020 inches. For one embodiment, the air gap 530 is at most approximately 0.020 inches. For one embodiment, the thickness of the armature 516 is at least 0.004 inches. For one embodiment, the thickness of the armature 516 is at most 0.008 inches. For one embodiment, the armature 516 is formed from a material that is magnetically permeable, such as a soft magnetic material. For example, and for one embodiment, the armature 516 is formed from at least one of nickel, iron, or any other magnetically permeable material known in the art. For one embodiment, the armature 516 includes multiple layers of magnetically permeable materials. For one embodiment, the armature 516 is formed by at least one of stamping or annealing.

For one embodiment, at least one of the components of the magnetic assembly of BA based valve 500 (which includes the coil assembly 514, the two magnets 522A-B, the pole piece 524, and the air gap 530) is formed from a material that is magnetically permeable, such as a soft magnetic material. For example, and for one embodiment, the pole piece 524 is formed from at least one of nickel, iron, or any other magnetically permeable material known in the art. For one embodiment, the pole piece is a multi-layer pole piece that has at least two layers of magnetically permeable materials. For one embodiment, at least part of the pole piece is formed by at least one of stamping, annealing, or metal injection molding.

For one embodiment, each of the magnets 522A-B includes at least one of aluminum, nickel, cobalt, copper, titanium, or a rare earth magnet (e.g., a samarium-cobalt magnet, a neodymium magnet, etc.). For one embodiment, each of the magnets 522A-B is designed to exhibit a low coercive force. For one embodiment, each of the magnets 522A-B is designed to be easily demagnetized to balance the armature 516 between the magnets 522A-B when necessary. For one embodiment, each of the magnets 522A-B is designed according to standards developed by the Magnetic Materials Producers Association (hereinafter "MMPA") and any other organizations that replaced or superseded the MMPA. Standards developed by the MMPA include, but are not limited to, the MMPA standard for Permanent Magnet Materials (MMPA 0100-00) and the MMPA Permanent Magnet Guidelines (MMPA PMG-88). For one embodiment, each of the magnets 522A-B includes at least one of aluminum, nickel, or cobalt. For one embodiment, each of the magnets 522A-B is an Alnico magnet. In a first example, and for one embodiment, each of the magnets 522A-B is an Alnico 5-7 magnet, which is defined in the MMPA 0100-00 or the MMPA PMG-88. In a second example, and for one embodiment, each of the magnets 522A-B is an Alnico 8 magnet, which is defined in the MMPA 0100-00 or the MMPA PMG-88. One advantage of the magnets 522A-B being Alnico 5-7 magnets is that the magnets 522A-B can be used for low reluctance circuits. One advantage of the magnets 522A-B being Alnico 8 magnets is that the magnets 522A-B can be used for high reluctance circuits.

For one embodiment, each of the terminal 518 and the connector 528 are formed from materials that enable electrical connections, as is known in the art. For one embodiment, the BA based valve 500 is included in an in-ear speaker.

Figure 5B:
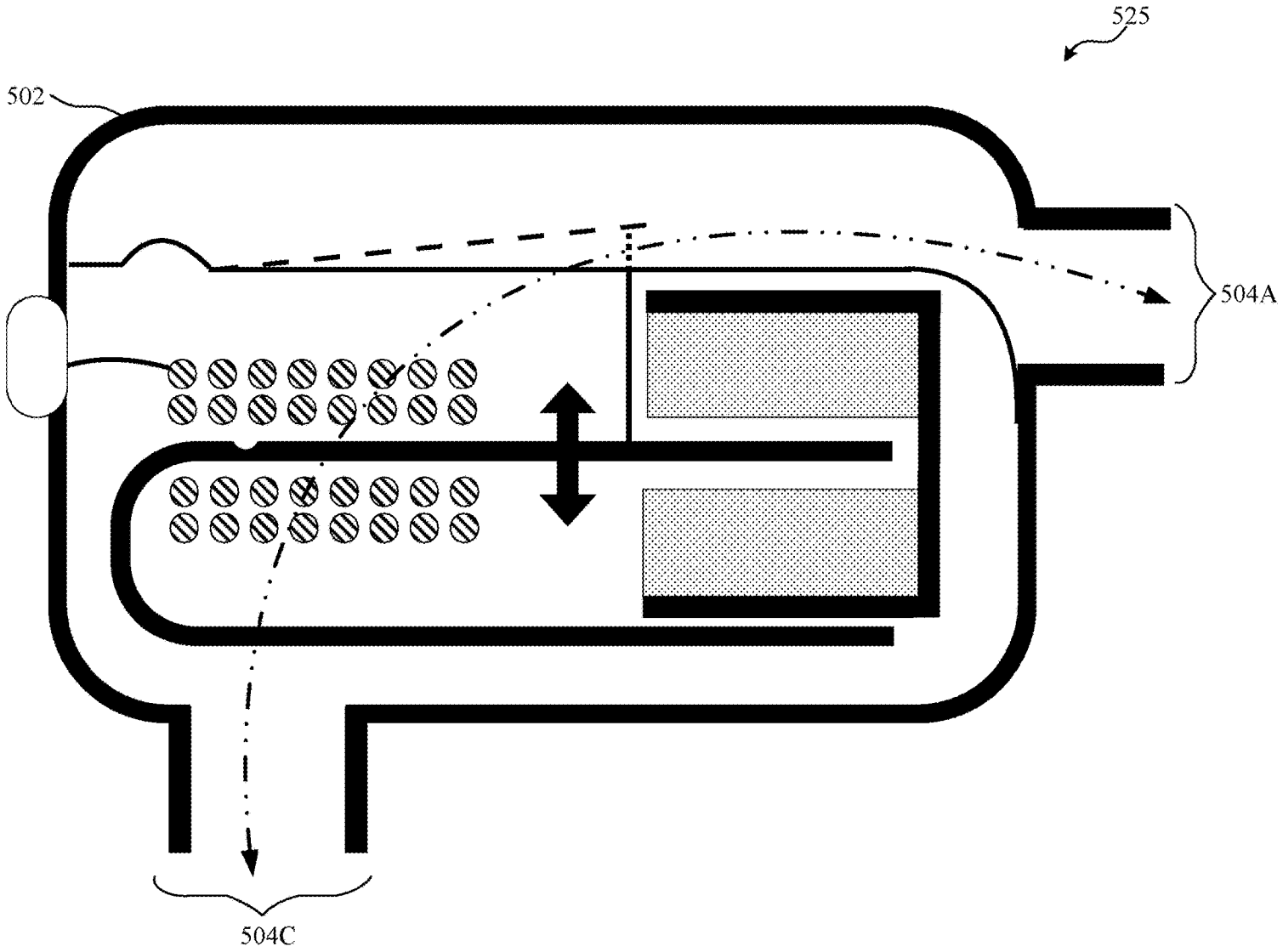
FIG. 5B is a cross-sectional side view illustration of another embodiment of a BA based valve.

FIG. 5B is a cross-sectional side view illustration of another embodiment of a BA based valve 525. The BA based valve 525 is a modification of the BA based valve 500 of FIG. 5B (which is described above in connection with FIG. 5A). For the sake of brevity, only the differences between the BA based valve 525 and the BA based valve 500 (which is described above in connection with FIG. 5A) are described below in connection with FIG. 5B.

One difference between the BA based valve 525 and the BA based valve 500 relates to the placement of the spout 504C. In FIG. 5A, the spout 504B is located on the rear side of housing 502. In contrast, spout 504C of FIG. 5B is located on the bottom side of housing 502. For one embodiment, the spout that is used for assisting with a reduction of an occlusion effect or manipulation of perceived audio transparency (e.g., the spout 504B of FIG. 5A, the spout 504C of FIG. 5B, etc.) can be located anywhere on the rear and bottom sides of housing 502.

For one embodiment, the two spouts of the BA based valves 500 and 525 can be located anywhere on the housing 502. For this embodiment, the membrane is substantially parallel to the top and bottom sides of the housing 502 and the two spouts are separated by the membrane 506. For a first example, and for one embodiment, the spout 504 A of FIGS. 5A and 5B is located anywhere on the housing 502 between the membrane 506 and the top side of the housing 502. In this example, and for this embodiment, the spout 504B of FIG. 5A or the spout 504C of FIG. 5B is located anywhere on the housing 502 between the membrane 506 and the bottom side of the housing 502. In this way, the valve flap 508 can be enabled to assist with mitigation of an occlusion effect or with manipulation of perceived audio transparency. For one embodiment, the BA based valve 525 is included in an in-ear speaker.

Figure 6A:
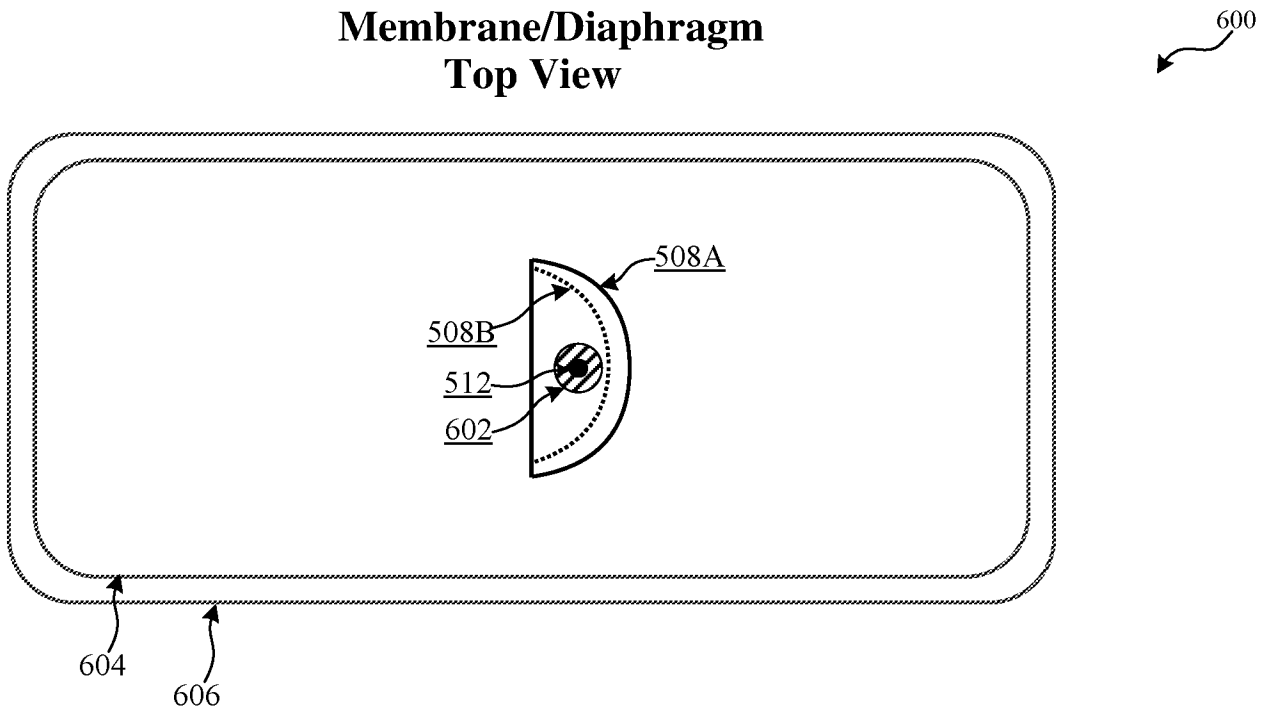
FIG. 6A is a cross-sectional top view illustration of one embodiment of a membrane or diaphragm (hereinafter "membrane") that is included in at least one of the BA based valves illustrated in FIGS. 5A-5B.

FIG. 6A is a cross-sectional top view illustration of one embodiment of a membrane 600 that is included the BA receivers illustrated in FIGS. 5A-5B. For one embodiment, the membrane 600 is similar to or the same as membrane 506, which is described above in connection with FIGS. 5A-5B. In the illustrated embodiment, the membrane 600 includes the valve flap 508 in the open position 508A and the closed position 508B, the drive pin 512, a primary membrane 604, a membrane frame 606, and an adhesive 602 that is used to secure the drive pin 512 to the valve flap 508. For one embodiment, the primary membrane 604 comprises the main part of the membrane 600 and the hinge (not shown), as described above in connection with FIGS. 5A-5B. For one embodiment, each of the valve flap 508, the primary membrane 604, and the membrane frame 606 is formed in accordance with the description provided above in connection at least one of FIGS. 5A-5B. For example, and for one embodiment, each of the valve flap 508 and the primary membrane 604 are made of at least one of nickel or aluminum. In this example, the primary membrane 604 is multi-layered with copper to immobilize the primary membrane 604, while the membrane frame 606 is formed from copper and used to encase the primary membrane 604 so as to further immobilize the primary membrane 604. Furthermore, and in this example, the valve flap 508 is not immobilized with copper, as described above in at least one of FIGS. 5A-5B.

Figure 6B:
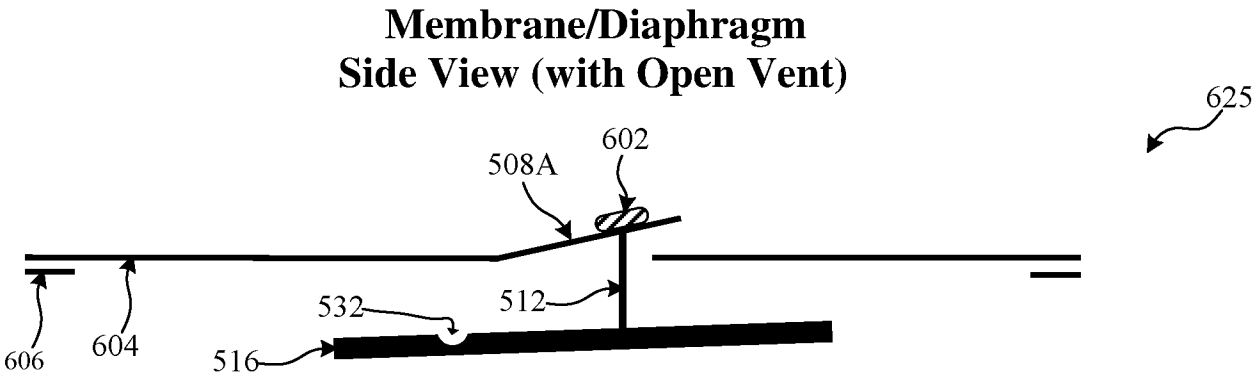
FIG. 6B is a cross-sectional side view illustration of the membrane illustrated in FIG. 6A.

FIG. 6B is a cross-sectional side view illustration of the membrane illustrated in FIG. 6A. For one embodiment, the adhesive 602 is used to secure the drive pin 512 to the valve flap 508. For one embodiment, the adhesive 602 is a polymer material, e.g., a compressed polymer material. For one embodiment, the adhesive 602 secures the drive pin 512 to the valve flap 508 by bonding or other processes known in the art. For one embodiment, a hole is formed in the valve flap 508 to enable the drive pin 512 to be secured to the valve flap 508 using the adhesive 602 or other securing mechanisms known in the art. It is to be appreciated that use of the adhesive 602 to secure the drive pin 512 to the valve flap 508 is merely exemplary. It is to be appreciated that other securing techniques (as known in the art) that are not disclosed herein can be used to secure the drive pin 512 to the valve flap 508.

Figure 7A:
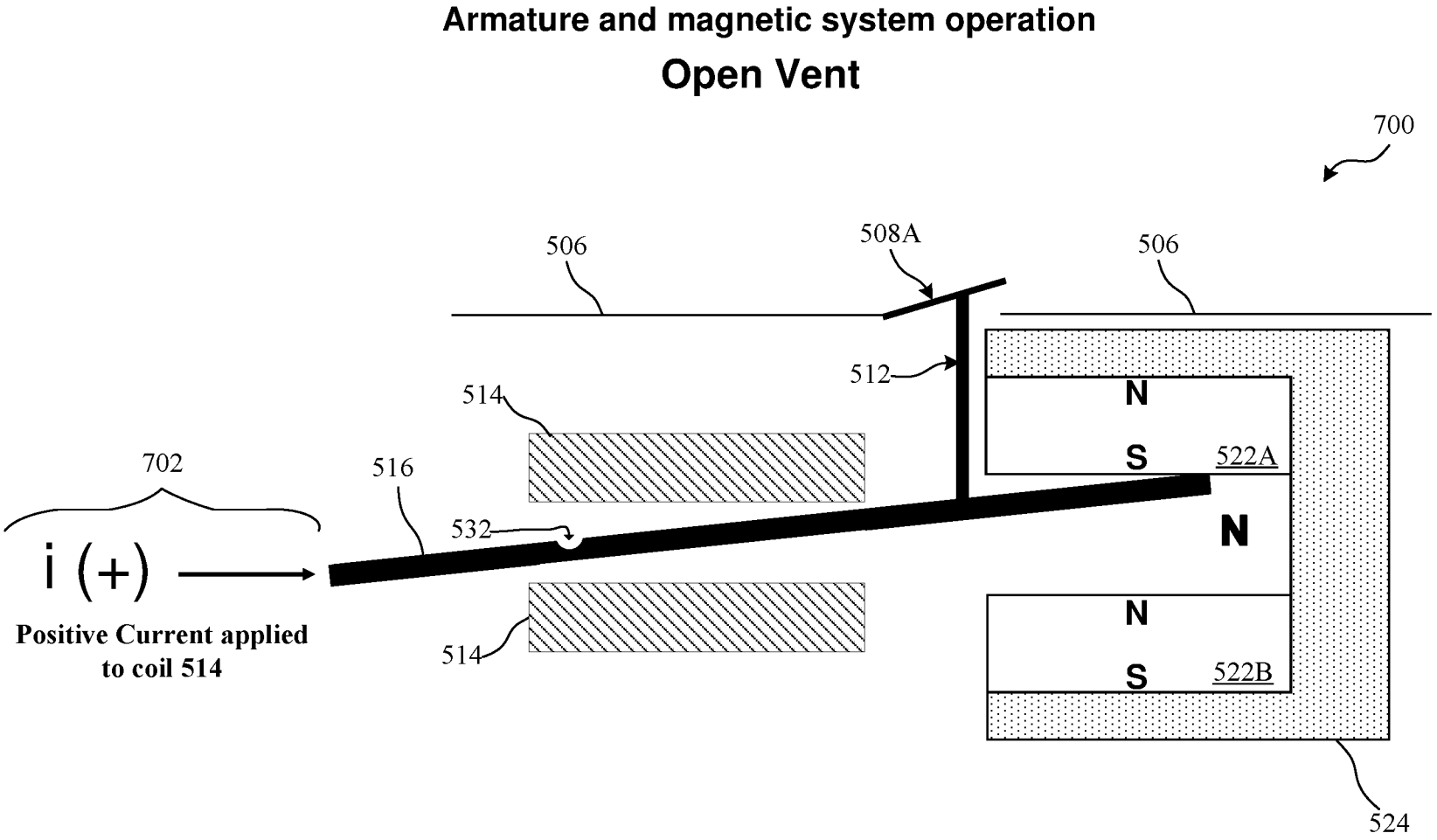
FIG. 7A is a block diagram side view illustration of one embodiment of a bi-stable operation of at least one of the BA based valves illustrated in FIGS. 5A-5B.

FIG. 7A is a block diagram side view illustration of one embodiment of a bi-stable state 700 of at least one of the BA based valves 500 and 525 illustrated in FIGS. 5A and 5B, respectively. In some embodiments of the BA based valves 500 and 525, an electrical input signal 702 is applied (in the form of a positive current, e.g., between +1 mA and +3 mA) to the coil assembly 514. For one embodiment, the coil assembly 514 creates a magnetic flux in response to the applied current and the magnetic flux moves the armature 516 upwards towards upper magnet 522A. For one embodiment, the upper magnet 522A has a magnetic field strength that attracts the upward moving armature 516 and causes the armature 516 to remain in direct contact with the upper magnet 522A. For this embodiment, the drive pin 512 actuates the valve flap 508 into the open position 508A as the armature 516 moves into direct contact with the upper magnet 522A. At this point, the current (electrical input signal 702) through the coil assembly 514 can now be reduced, e.g., down to zero, by a control circuit (not shown) that may be incorporated into the BA based valve 500, 525. In one embodiment, the control circuit accepts a continuous, low power logic control signal via the terminal 518 and connector 528, where the signal may have two stable states, one that commands an open state for the valve flap 508, and another that commands a closed state for the valve flap 508; this logic control signal may originate from an external electronic device (e.g., a smartphone, a computer, a wearable computer system, etc.) The control circuit converts the logic control signal into a short current pulse (electrical input signal 702) having the correct polarity as described below, to operate the coil assembly 514. For one embodiment, the control circuit can also include logic for receiving one or more input signals from the one or more sensors, as described above in connection with at least one of FIGS. 5A-5B.

Figure 7B:
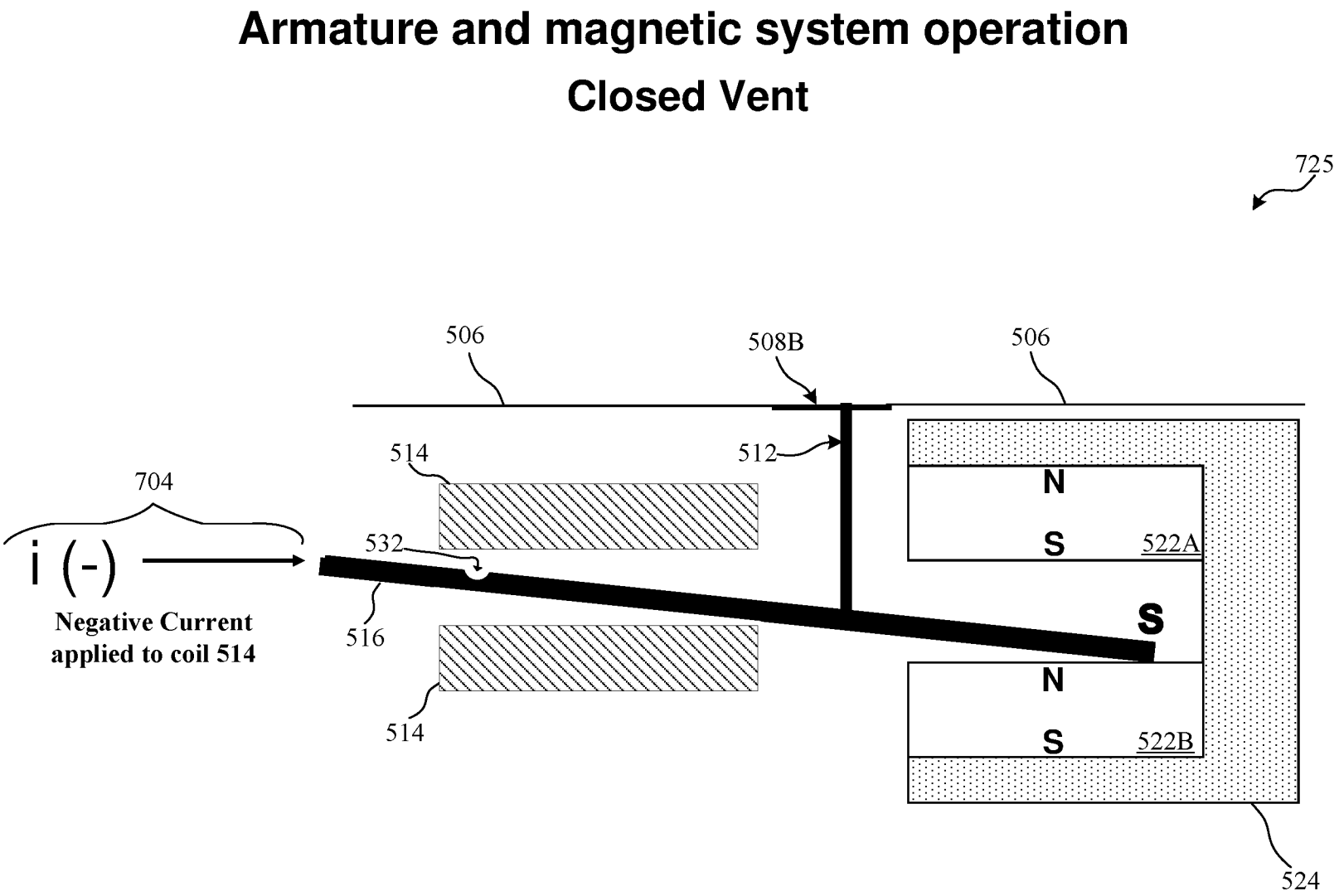
FIG. 7B is a block diagram side view illustration of one embodiment of another bi-stable operation of at least one of the BA based valves illustrated in FIGS. 5A-5B.

FIG. 7B is a block diagram side view illustration of one embodiment of another bi-stable state 725 of at least one of the BA based valves 500 and 525 illustrated in FIGS. 5A and 5B, respectively. For some embodiments of the BA based valves 500 and 525, an electrical input signal 704 is applied (in the form of a negative current, e.g., between −1 mA and −3 mA) to the coil assembly 514. For one embodiment, the coil assembly 514 creates a magnetic flux in response to the applied current and the magnetic flux moves the armature 516 downwards towards the lower magnet 522B. For one embodiment, the lower magnet 522B has a magnetic field strength that attracts the downward moving armature 516 and causes the armature 516 to remain in direct contact with the lower magnet 522B. For this embodiment, the drive pin 512 actuates the valve flap 508 into the closed position 508B as the armature 516 moves into direct contact with the lower magnet 522B. At this point, the coil current (electrical input signal 704) can be reduced from its activation level, down to for example zero, by the control circuit that is incorporated into the BA based valves 500 and 525, as described above in connection with FIG. 7A.

Figure 8:
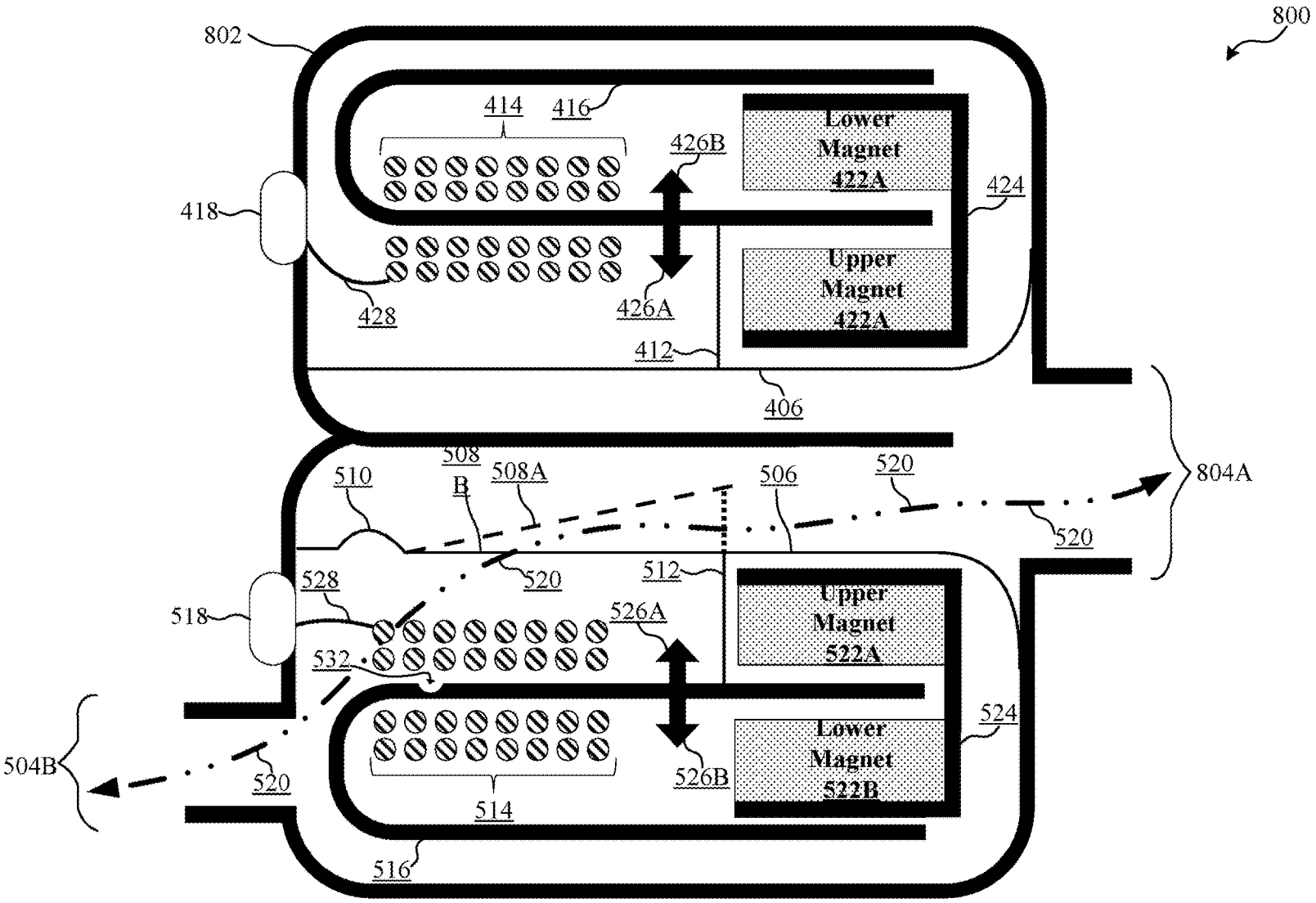
FIG. 8 is a cross-sectional side view illustration of one embodiment of a driver assembly that includes the BA based valve illustrated in FIG. 5A.

FIG. 8 is a cross-sectional side view illustration of one embodiment of a driver assembly 800 of the in-ear speaker, that includes the BA based valve 500 described above in connection with FIG. 5A, and the acoustic driver 400 described above in connection with FIG. 4. The illustrated embodiment of the driver assembly 800 is a combination of the BA based valve 500 and the acoustic driver 400 within a housing 802; however other embodiments are not so limited. For example, and for one embodiment, the driver assembly 800 includes at least one BA based valve 500 and at least one of (i) one or more BA receivers known in the art; or (ii) one or more acoustic drivers that are not BA receivers. For one embodiment, the housing 802 includes a first spout 804A that is to deliver sound that is output/generated by the acoustic drivers of the driver assembly 800 to an ear canal or to an ambient environment. For one embodiment, the housing 802 includes at least one second spout 504B that is to deliver unwanted sound created by an occlusion effect away from an ear canal, as described above in connection with FIG. 5A. For the sake of brevity, only those features, components, or characteristics that have not been described above in connection with FIGS. 1A-7B will be described below in connection with FIG. 8.

The driver assembly 800 includes a housing 802. For one embodiment, the housing 802 holds, encases, or is attached to one or more of the components of the BA receivers in the driver assembly 800. Furthermore, and for one embodiment, the housing 802 includes a top side, a bottom side, a front side, and a rear side. For one embodiment, the front side of the housing 802 is substantially parallel to the rear side of the housing 802. For one embodiment, the top side of the housing 802 is substantially parallel to the bottom side of the housing 802. When the driver assembly 800 is part of an in-ear speaker that is placed in a user's ear, the rear side of the housing 802 is further away from the user's ear canal than the front side of the housing 802 and the rear side of the housing 802 is closer to an ambient environment than the front side of the housing 802.

For one embodiment, the driver assembly 800 includes two spouts 804A and 504B, which may be formed on or coupled to the housing 802 as is known in the art. For one embodiment, the spout 804A performs the functions of the spout 504A of the BA based valve 500 and the functions of the spout 404 of the acoustic driver 400. The spouts 504A-504B are described above in connection with FIGS. 5A-5B. The spout 404 is described above in connection with FIG. 4.

In the illustrated embodiment of the driver assembly 800, the spout 804A is formed on or coupled to the front side of the housing 802; the spout 504B, a terminal 418, a terminal 518 are formed on or attached to the rear side of the housing 802; the spout 804A is equally close to the top and bottom sides of the housing 802; the spout 504B is farther from the top side of the housing 802; the spout 504B is closer to the bottom side of the housing 802; and the terminal 418 is closer to the top side of the housing 802.

For one embodiment, the driver assembly 800 combines an ability of the acoustic driver 400 to create sounds that are delivered to a listener's ear with an ability of the BA based valve 500 to reduce an occlusion effect and an ability of the BA based valve 500 to enable manipulation of perceived audio transparency. For one embodiment, the membrane 406 creates sounds based on an audio signal input or provided as coil current, to the coil assembly 414, as described above in connection with FIG. 4. For one embodiment, the sounds created by the membrane 406 are emitted through the spout 804A into an ear of a listener or an ambient environment. For one embodiment, the valve flap 508 of the membrane 506, the spout 804A, and the spout 504B are used to release at least some of the amplified or echo-like sounds that result from an occlusion effect in the listener's ear, as described above in at least one of FIGS. 5A-7B. For one embodiment, the valve flap 508 of the membrane 506, the spout 804A, and the spout 504B are used to enable manipulation of perceived audio transparency, as described above in at least one of FIGS. 5A-7B. The spout 804A is thus shared as both a primary sound output port for an acoustic driver (producing sound in accordance with an audio signal received at terminal 418) and as a release port for releasing (inteo the ambient environment through the spout 504B) the pressure of the amplified or echo-like sounds in the ear canal. For one embodiment, the reduction of the occlusion effect and the manipulation of the perceived audio transparency is based on one or more sensors, e.g., the sensors described above in at least one or FIGS. 5A-7B. For one embodiment, the driver assembly 800 is included in an in-ear speaker.

Figure 9:
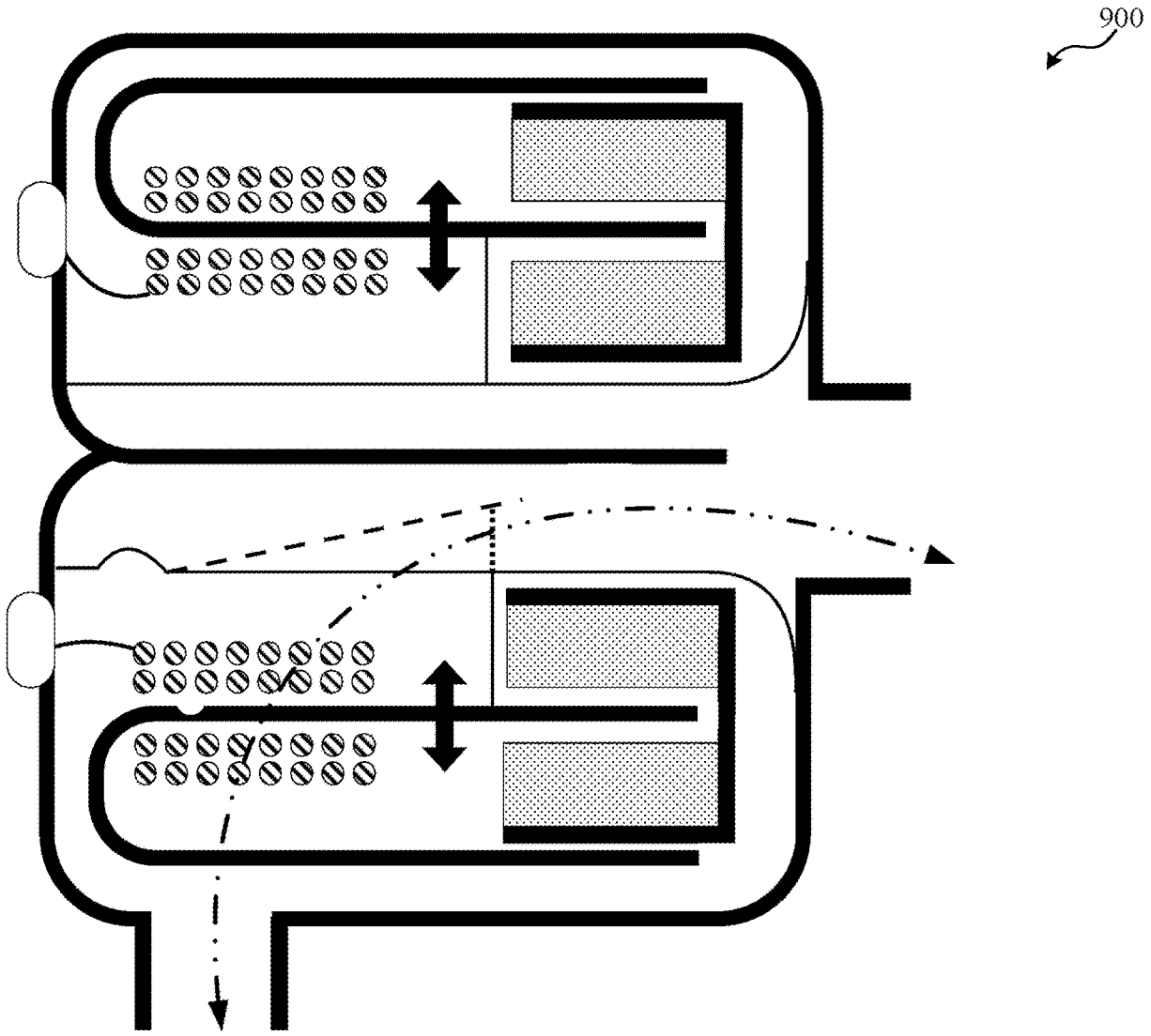
FIG. 9 is a cross-sectional side view illustration of one embodiment of a driver assembly that includes the BA based valve illustrated in FIG. 5B.

FIG. 9 is a cross-sectional side view illustration of one embodiment of a driver assembly 900 that includes the BA based valve 525 described above in connection with FIG. 5B and the acoustic driver 400 described above in connection with FIG. 4. For one embodiment, the driver assembly 900 is a modification of the driver assembly 800 described above in FIG. 8. The illustrated embodiment of driver assembly 900 is a combination of the BA based valve 525 and the acoustic driver 400 in the housing 802; however other embodiments are not so limited. For example, and for one embodiment, the driver assembly 900 includes at least one BA based valve 525 and at least one of (i) one or more BA receivers known in the art; or (ii) one or more acoustic drivers that are not BA receivers. For the illustrated embodiment, the housing 802 includes a first spout 804A and a second spout 504C. The spout 804A is described above in connection with FIG. 8 and the spout 504C is described above in connection with FIG. 5B. For one embodiment, the driver assembly 900 is included in an in-ear speaker. For the sake of brevity, reference is made to the descriptions provided above in connection with at least one of FIG. 4, 5A-5B, or 8.

Figure 10A:
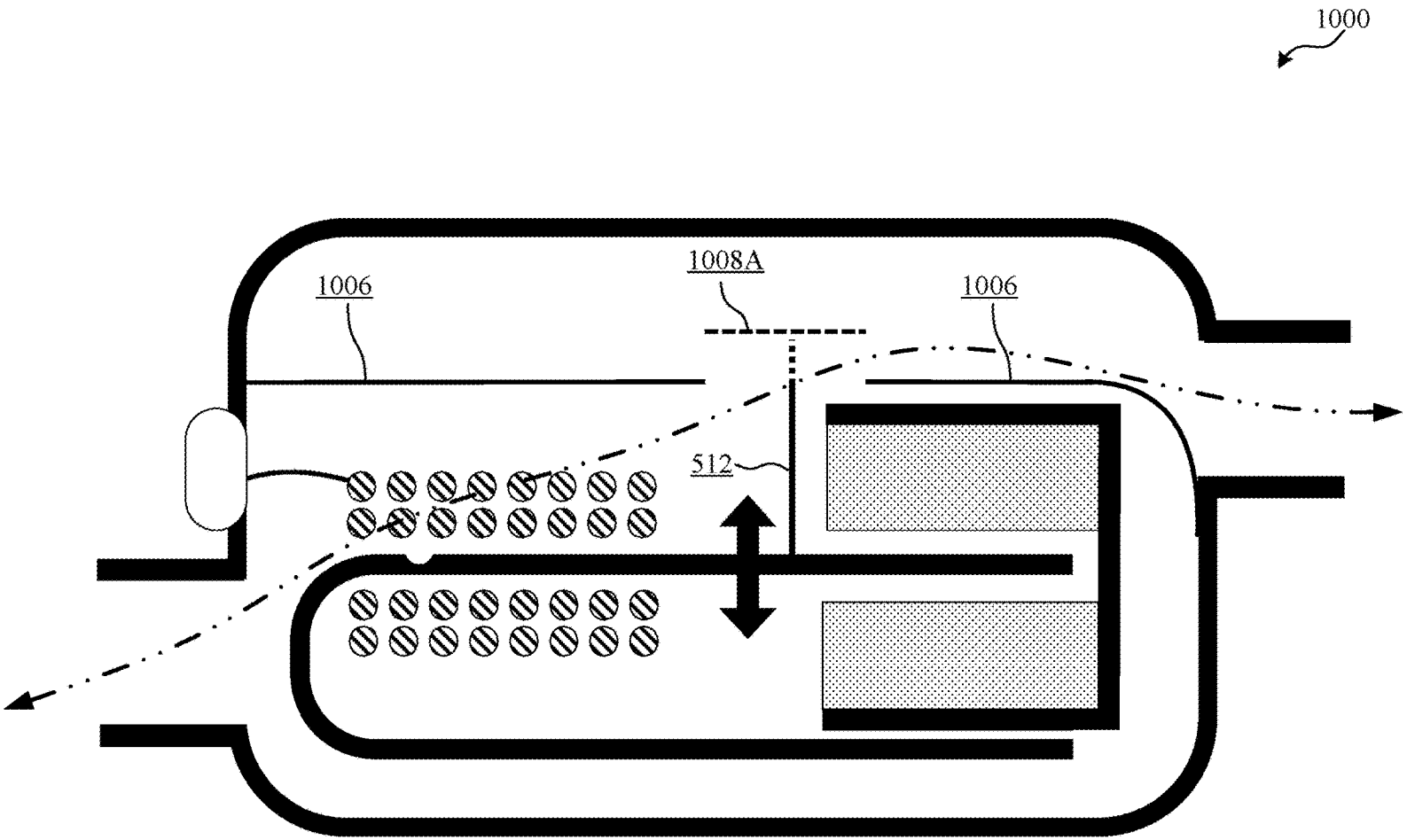
FIG. 10A is a cross-sectional side view illustration of yet another embodiment of a BA based valve.

FIG. 10A is a cross-sectional side view illustration of yet another embodiment of the venting or acoustic pass valve 210, as a BA based valve 1000. BA based valve 1000 is a modification of the BA based valve 500 (which is described above in connection with FIG. 5A). For the sake of brevity, only the differences between the BA based valve 1000 and the BA based valve 500 (which is described above) will be described below in connection with FIG. 10A.

One difference between the BA based valve 1000 and the BA based valve 500 relates to the presence of the membrane 1006 including a detachable valve flap 1008 and without the hinge 510. For one embodiment, the detachable valve flap 1008 of FIG. 10A differs from the valve flap 508 of FIG. 5A because at least one end of the valve flap 508 of FIG. 5A remains coupled to the membrane 506 of FIG. 5A, while the other end of the valve flap 508 is lifted by the driver pin 512 to open the valve flap 508. In contrast, the entirety of the detachable valve flap 1008 of FIG. 10A is lifted by the drive pin 512 so that the valve flap 1008 is completely detached from the membrane 1006. Furthermore, there is no hinge 510 in the membrane 1006, which can reduce the number of components used to make the membrane. For one embodiment, the detachable valve flap 1008 of membrane 1006 is completely detached from the membrane 1006 into an open position 1008A and re-attached to the membrane 1006 into a closed position (not shown) based on a movement of the drive pin 512. For one embodiment, the BA based valve 1000 is included in an in-ear speaker.

Figure 10B:
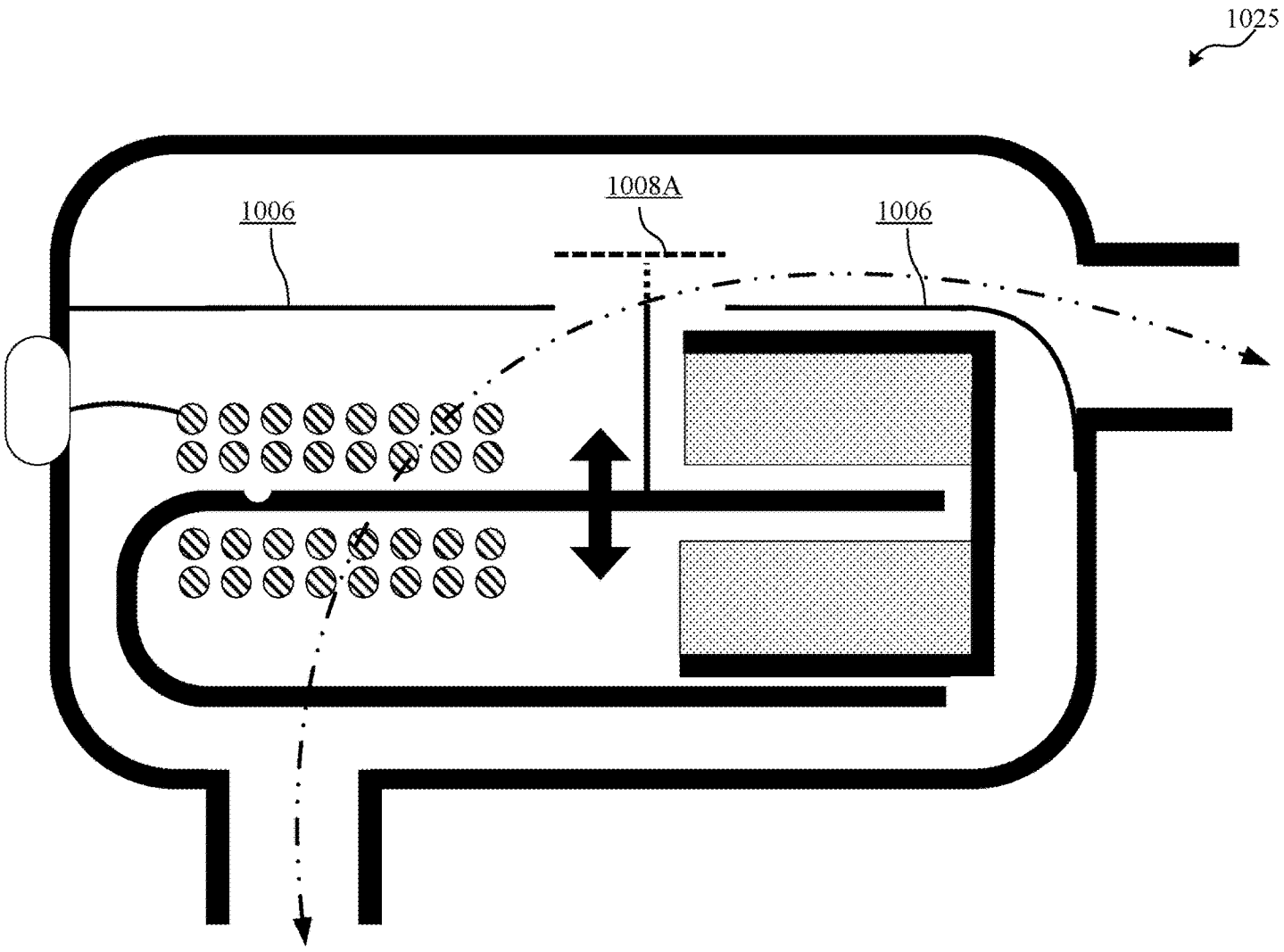
FIG. 10B is a cross-sectional side view illustration of one additional embodiment of a BA based valve.

FIG. 10B is a cross-sectional side view illustration of one additional embodiment of the valve 210, as a BA based valve 1025. BA based valve 1025 is a modification of BA based valve 525 (which is described above in connection with FIG. 5B). For the sake of brevity, only the differences between the BA based valve 1025 and the BA based valve 525 (which is described above) will be described below in connection with FIG. 10B.

One difference between the BA based valve 1025 and the BA based valve 525 relates to the presence of the membrane 1006 (including detachable valve flap 1008 without a hinge 510). The differences between the membrane 1006 and the membrane 506 are described above in connection with FIG. 10A. For one embodiment, the BA based valve 1025 is included in an in-ear speaker.

Figure 11A:
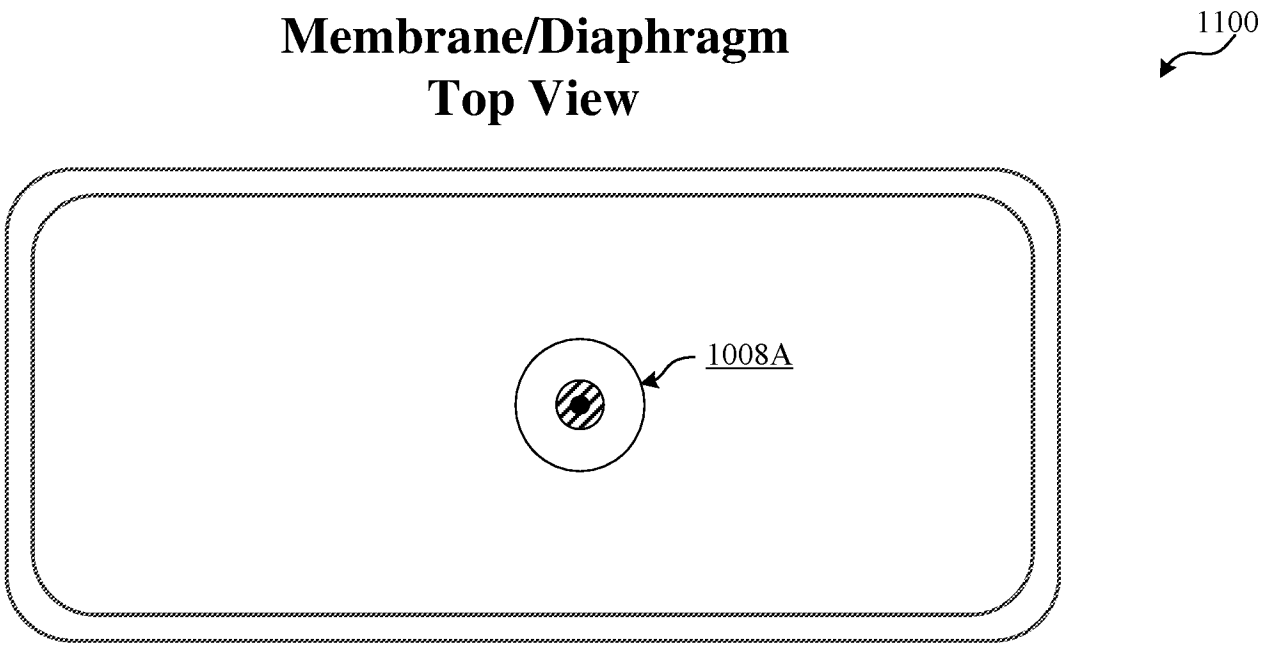
FIG. 11A is a cross-sectional top view illustration of one embodiment of a membrane that is included in at least one of the BA based valves illustrated in FIGS. 10A-10B.

FIG. 11A is a cross-sectional top view illustration of one embodiment of a membrane 1100 that is included in at least one of the BA based valves 1000 and 1025 illustrated in FIGS. 10A and 10B, respectively. For one embodiment, the membrane 1100 is a modification of membrane 600 described above in connection with FIG. 6A. One difference between the membrane 1100 and the membrane 600 relates to the presence of the detachable valve flap 1008 without the hinge 510. The differences between the membrane 1006 and the membrane 506 are described above in connection with FIG. 10A. For one embodiment, membrane 1100 is similar to or the same as membrane 1006, which is described above in connection with FIGS. 10A-10B. For the illustrated embodiment, the membrane 1100 includes the detachable valve flap 1008 in the open position 1008A, the drive pin 512, a primary membrane 604, a membrane frame 606, and an adhesive 602 that is used to secure the drive pin 512 to the detachable valve flap 1008. Each of these components is described above in connection with at least one of FIGS. 6A-10B. For one embodiment, the primary membrane 604 comprises the main part of the membrane without a hinge. For one embodiment, each of the valve flap 508, the primary membrane 604, and the membrane frame 606 is formed in accordance with the description provided above in connection FIGS. 5A-5B except that there is no hinge.

Figure 11B:
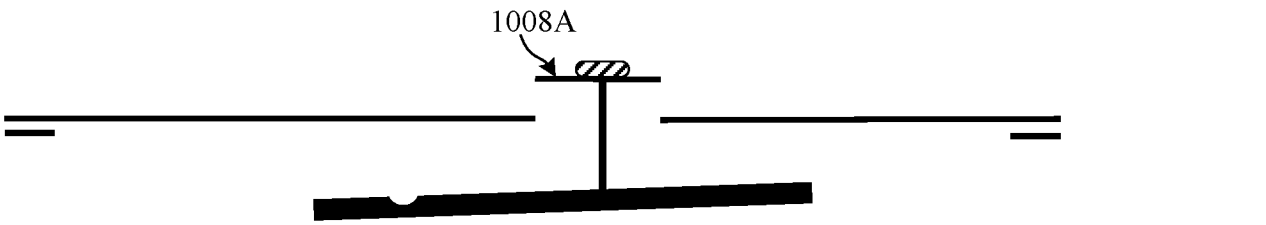
FIG. 11B is a cross-sectional side view illustration of the membrane illustrated in FIG. 11A.

FIG. 11B is a cross-sectional side view illustration of the membrane illustrated in FIG. 11A. The membrane illustrated by FIG. 11B is a modification of the membrane described above in connection with FIG. 6B. One difference between the membrane illustrated by FIG. 11B and the membrane described above in connection with FIG. 6B relates to the presence of the detachable valve flap 1008 without the hinge 510. The differences between the membrane 1006 and the membrane 506 are described above in connection with FIG. 10A. For the sake of brevity, reference is made to the descriptions provided above in connection with at least one of FIGS. 6B and 10A-11A.

Figure 12A:
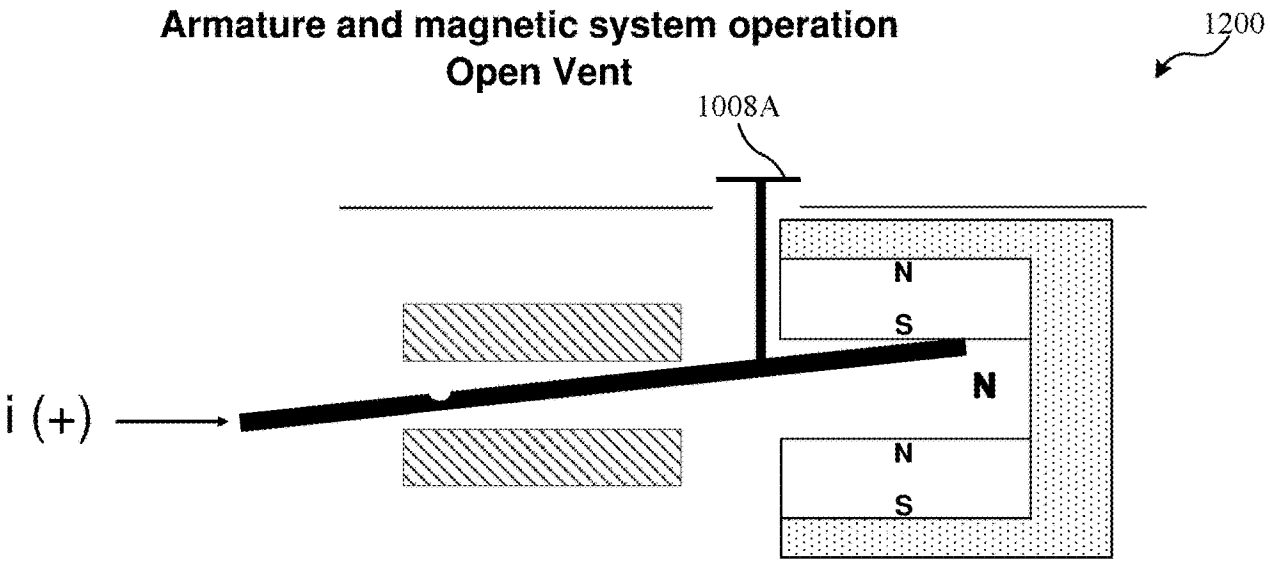
FIG. 12A is a block diagram side view illustration of one embodiment of a bi-stable operation of at least one of the BA based valves illustrated in FIGS. 10A-10B.

FIG. 12A is a block diagram side view illustration of one embodiment of a bi-stable operation 1200 of at least one of the BA based valves 1000 and 1025 illustrated in FIGS. 10A and 10B, respectively. The bi-stable operation 1200 is a modification of the bi-stable operation 700 described above in connection with FIG. 7A. One difference between the bi-stable operation 1200 and the bi-stable operation 700 described above in connection with FIG. 7A relates to the presence of the detachable valve flap 1008 without a hinge 510. The differences between the detachable valve flap 1008 and the valve flap 508 are described above in connection with FIG. 10A. For the sake of brevity, reference is made to the descriptions above in connection with FIGS. 7A and 10A-11B.

Figure 12B:
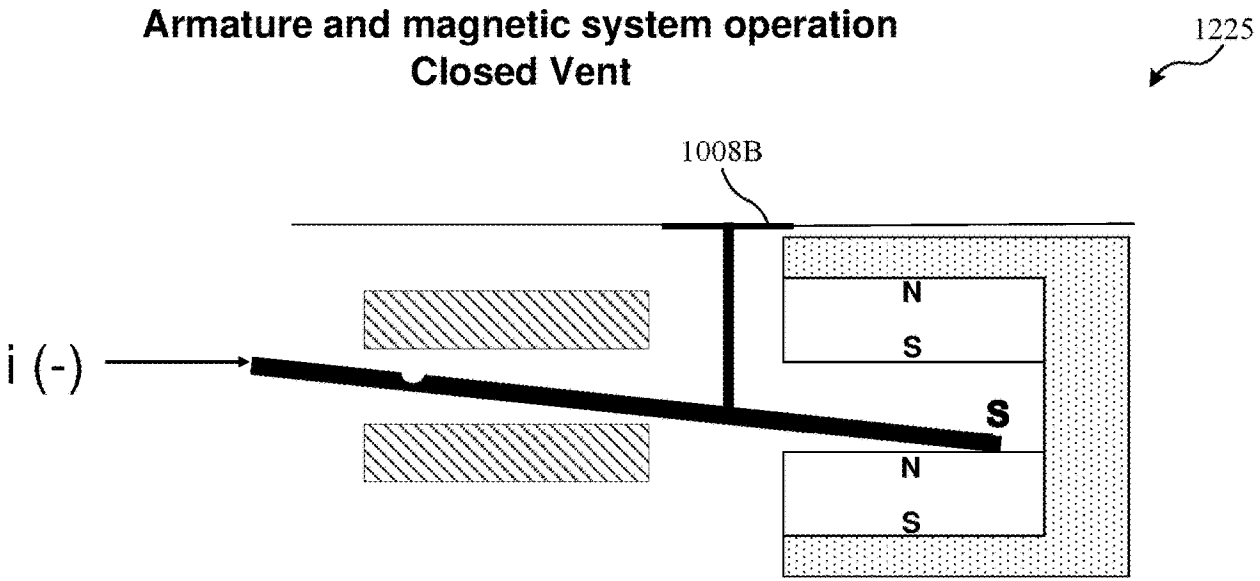
FIG. 12B is a block diagram side view illustration of one embodiment of another bi-stable operation of at least one of the BA based valves illustrated in FIGS. 10A-10B.

FIG. 12B is a block diagram side view illustration of one embodiment of another bi-stable operation 1225 of at least one of the BA based valves 1000 and 1025 illustrated in FIGS. 10A and 10B, respectively. The bi-stable operation 1225 is a modification of the bi-stable operation 725 described above in connection with FIG. 7B. One difference between the bi-stable operation 1225 and the bi-stable operation 725 described above in connection with FIG. 7B relates to the presence of the detachable valve flap 1008 without a hinge 510. The differences between the detachable valve flap 1008 and the valve flap 508 are described above in connection with FIG. 10A. For the sake of brevity, reference is made to the descriptions above in connection with FIGS. 7B and 10A-11B.

Figure 13:
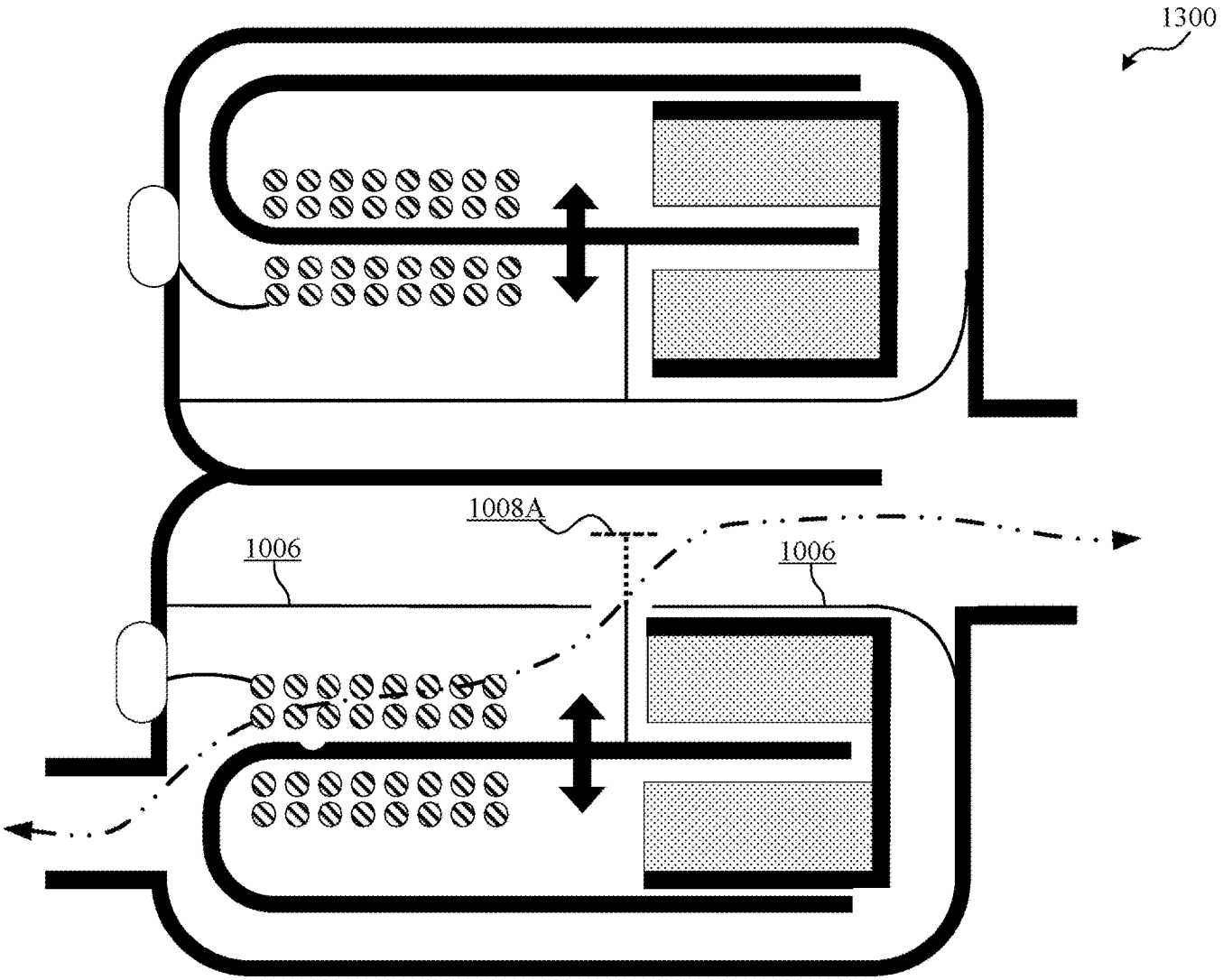
FIG. 13 is a cross-sectional side view illustration of one embodiment of a driver assembly that includes the BA based valve illustrated in FIG. 10A.

FIG. 13 is a cross-sectional side view illustration of one embodiment of a driver assembly 1300 that includes the BA based valve 1000 described above in connection with in FIG. 10A and the acoustic driver 400 described above in connection with FIG. 4. For one embodiment, the driver assembly 1300 is a modification of the driver assembly 800, which is described above in connection with FIG. 8. One difference between the driver assembly 1300 and the driver assembly 800 described above in connection with FIG. 8 relates to the presence of the detachable valve flap 1008 without a hinge 510. The differences between the detachable valve flap 1008 and the valve flap 508 are described above in connection with FIG. 10A. The illustrated embodiment of driver assembly 1300 is a combination of one embodiment of the BA based valve 1000 and the acoustic driver 400 in the housing 802; however other embodiments are not so limited. For example, and for one embodiment, the driver assembly 1300 includes at least one BA based valve 1000 and at least one of (i) one or more BA receivers known in the art; or (ii) one or more acoustic drivers that are not BA receivers. For one embodiment, the driver assembly 1300 is included in an in-ear speaker. For the sake of brevity, reference is made to the descriptions provided above in connection with at least one of FIG. 8 or 10A-12B.

Figure 14:
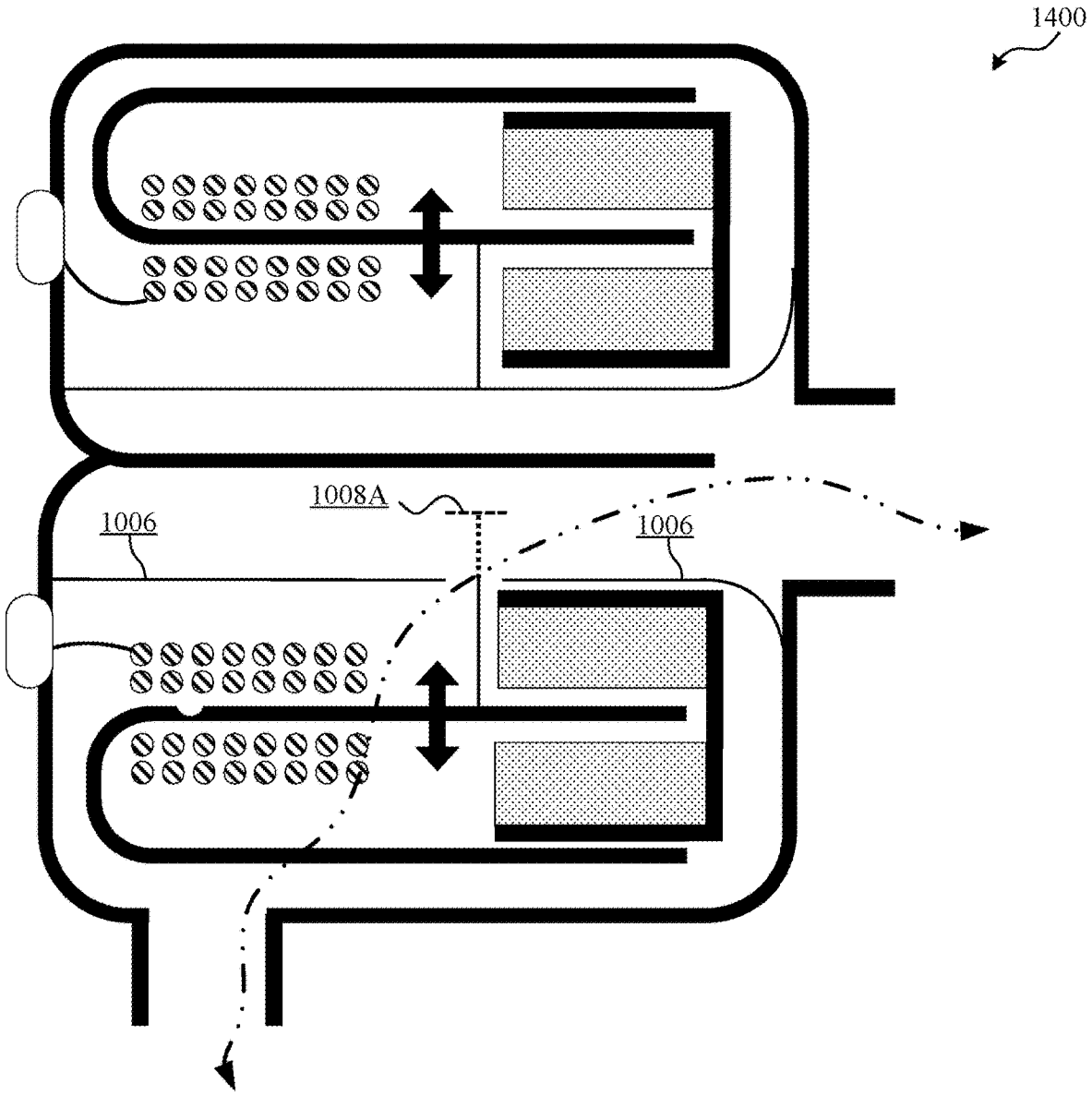
FIG. 14 is a cross-sectional side view illustration of one embodiment of a driver assembly that includes the BA based valve illustrated in FIG. 10B.

FIG. 14 is a cross-sectional side view illustration of one embodiment of a driver assembly 1400 that includes the BA based valve 1025 described above in connection with FIG. 10B and the acoustic driver 400 described above in connection with FIG. 4. For one embodiment, the driver assembly 1400 is a modification of the driver assembly 900 described above in connection with FIG. 9. One difference between the driver assembly 1400 and the driver assembly 900 described above in connection with FIG. 9 relates to the presence of the detachable valve flap 1008 without a hinge 510. The differences between the detachable valve flap 1008 and the valve flap 508 are described above in connection with FIG. 10A. The illustrated embodiment of driver assembly 1400 is a combination of one embodiment of the BA based valve 1025 and the acoustic driver 400 in the housing 802; however other embodiments are not so limited. For example, and for one embodiment, the driver assembly 1400 includes at least one BA based valve 1025 and at least one of (i) one or more BA receivers known in the art; or (ii) one or more acoustic drivers that are not BA receivers. For one embodiment, the driver assembly 1400 is included in an in-ear speaker. For the sake of brevity, reference is made to the descriptions provided above in connection with at least of FIG. 4, 10B, or 13.

Figure 15:
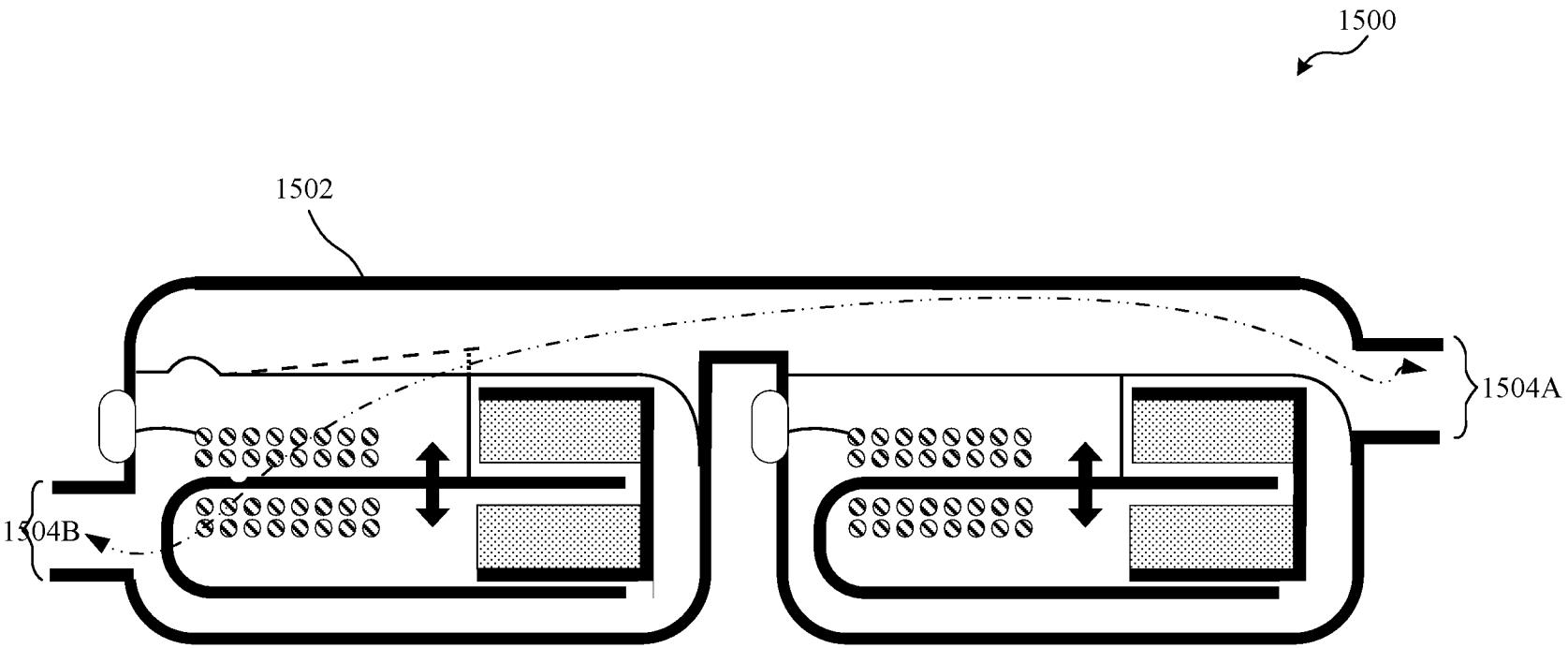
FIG. 15 is a cross-sectional side view illustration of yet another embodiment of a driver assembly that includes the BA based valve illustrated in FIG. 5A.

FIG. 15 is a cross-sectional side view illustration of yet another embodiment of a driver assembly 1500 that includes the BA based valve 500 described above in connection with in FIG. 5A and the acoustic driver 400 described above in connection with FIG. 4. For one embodiment, the driver assembly 1500 is a modification of the driver assembly 800, which is described above in connection with FIG. 8. One difference between the driver assembly 1500 and the driver assembly 800 (which is described above) is that, in the housing 1502 of the driver assembly 1500, the BA based valve 500 and the acoustic driver 400 are adjacently next to each other in an x-direction or a y-direction. This embodiment of the driver assembly 1600 can enable formation of driver assemblies with predetermined or specified z-heights. Accordingly, for one embodiment, the use of the housing 1502 to create the driver assembly 1500 may allow for an overall reduction of the z-height in size-critical applications.

The illustrated embodiment of the driver assembly 1500 is a combination of the BA based valve 500 and the acoustic driver 400 within a housing 1502; however other embodiments are not so limited. For example, and for one embodiment, the driver assembly 1500 includes at least one BA based valve that is described herein (e.g., BA based valve 500 or 525) and at least one of (i) one or more BA receivers known in the art; or (ii) one or more acoustic drivers that are not BA receivers. For one embodiment, the housing 1502 includes a first spout 1504A that is to deliver sound that is output/generated by the acoustic drivers of the driver assembly 1500 to an ear canal or to an ambient environment. For one embodiment, the first spout 1504A is similar to or the same as the spout 804A, which is described above in connection with FIG. 8A. For one embodiment, the housing 1502 includes at least one second spout 1504B that is to deliver unwanted sound created by an occlusion effect away from a listener's ear. For one embodiment, the second spout 1504B is similar to or the same as the spout 504B, which is described above in connection with FIG. 5A. For one embodiment, the driver assembly 1500 is included in an in-ear speaker.

Figure 16:
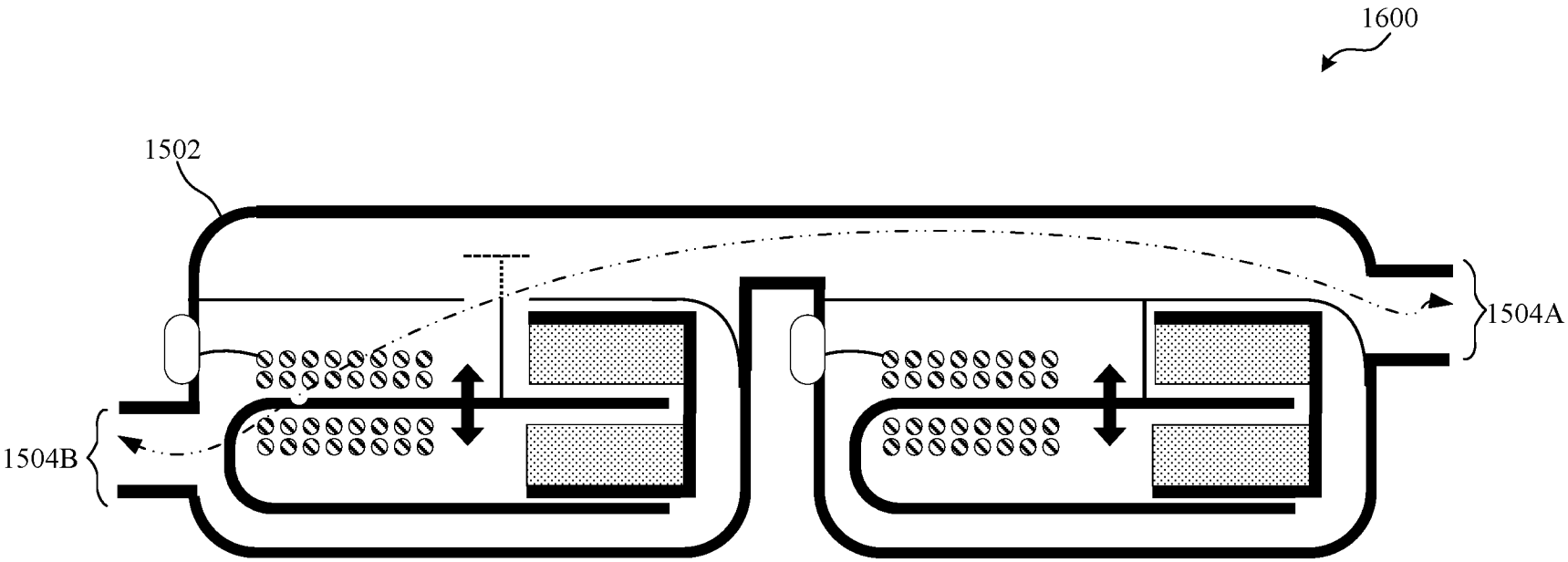
FIG. 16 is a cross-sectional side view illustration of another embodiment of a driver assembly that includes the BA based valve illustrated in FIG. 10A.

FIG. 16 is a cross-sectional side view illustration of another embodiment of a driver assembly 1600 that includes the BA based valve 1000 described above in connection with in FIG. 10A and the acoustic driver 400 described above in connection with FIG. 4. For one embodiment, the driver assembly 1600 is a modification of the driver assembly 1300, which is described above in connection with FIG. 13. One difference between the driver assembly 1600 and the driver assembly 1300 (which is described above) is that, in the housing 1502 of the driver assembly 1600, the BA based valve 1000 and the acoustic driver 400 are adjacently next to each other in an x-direction or a y-direction. This embodiment of the driver assembly 1600 can enable formation of driver assemblies with predetermined or specified z-heights. Accordingly, for one embodiment, the use of the housing 1502 to create the driver assembly 1600 may allow for an overall reduction of the z-height in applications that are size-critical.

The illustrated embodiment of the driver assembly 1600 is a combination of the BA based valve 1000 and the acoustic driver 400 within a housing 1502; however other embodiments are not so limited. For example, and for one embodiment, the driver assembly 1600 includes at least one BA based valve that is described herein (e.g., BA based valve 1000 or 1025) and at least one of (i) one or more BA receivers known in the art; or (ii) one or more acoustic drivers that are not BA receivers. For one embodiment, the housing 1502 of the driver assembly 1600 includes a first spout 1504A that is to deliver sound that is output/generated by the acoustic drivers of the driver assembly 1500 to an ear canal or to an ambient environment. For one embodiment, the first spout 1504A is similar to or the same as the spout 804A, which is described above in connection with FIG. 8A. For one embodiment, the housing 1502 of the driver assembly 1600 includes at least one second spout 1504B that is to deliver unwanted sound created by an occlusion effect away from a listener's ear. For one embodiment, the second spout 1504B is similar to or the same as the spout 504B, which is described above in connection with FIG. 5A. For one embodiment, the driver assembly 1600 is included in an in-ear speaker.

Additional Features for an Active Vent System

Figure 17:
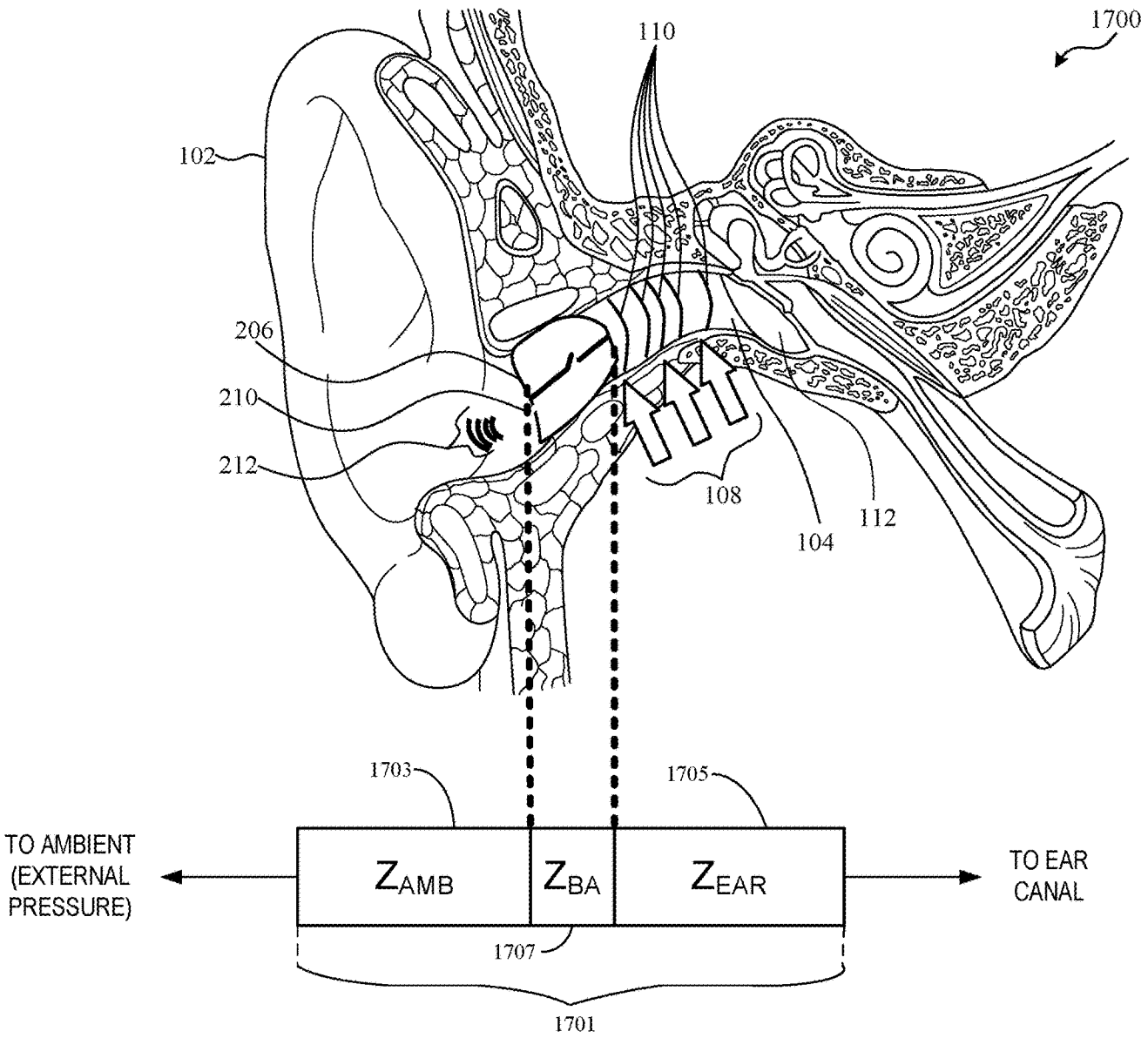
FIG. 17 is an illustration of an in-ear speaker in use, and a model of associated acoustic impedances.

FIG. 17 illustrates how at least one embodiment of the venting or acoustic pass valve 210 described above in connection with at least one of FIGS. 2 and 5A-16 can be used as part of an active vent system 1700 in accordance with one embodiment. The active vent system 1700 includes the in-ear speaker 206 which contains the valve 210, different embodiments of which were described above in connection with FIGS. 2, 5A-16. For the sake of brevity, only the differences between the features of FIG. 2 and FIG. 17 will be described below in connection with FIG. 17.

As explained above in connection with at least one of FIGS. 2 and 5A-16, at least one embodiment of the BA based valve 210 includes at least two spouts, a membrane (including a valve flap and a hinge), an armature, a coil assembly, two magnets, a pole piece, and an air gap. For example, and for one embodiment, the valve flap of the membrane can be in an open position or a closed position to assist with reduction or elimination of amplified or echo-like sounds created by an occlusion effect, as well as, manipulation of perceived audio transparency.

For one embodiment, the active vent system 1700 is an acoustic system that couples an otherwise sealed ear canal to an external ambient environment (outside of an ear or an electronic device) using a pathway 1701. For one embodiment, the pathway 1701 is a network of volumes that include the BA based valve 210. For example, and for one embodiment, the active vent system 1700 requires a minimal pathway 1701 (i.e., a minimal amount of volumes that make up the pathway 1701) that includes a sealed ear canal volume, the BA based valve 210, and a volume representing the external ambient environment outside of an ear or an electronic device.

For one embodiment, a volume of the pathway 1701 is a dynamic air pressure confined within a specified three dimensional space, where this volume is represented as an acoustic impedance. Depending on the geometry of the volume, this acoustic impedance can behave like a compliance, inertance, (also known as "acoustic mass"), or a combination of both. The specified three dimensional space can be expressed in a tangible form as a tubular structure, a cylindrical structure, or any other type of structure with a defined boundary.

For one embodiment, the geometry of the pathway 1701 determines an overall effectiveness of the ability of the system 1700 to assist with reduction or elimination of amplified or echo-like sounds created by an occlusion effect, as well as, manipulation of perceived audio transparency. For example, the pathway 1701 can have a predetermined geometry that assists with reducing an occlusion effect and also with reducing any unwanted energy that builds up in the ear canal due to activity (e.g. running, footfalls, chewing, etc.) Each volume can be designed with a constant cross section and can resemble a structure of various cross section shapes. For one embodiment, the pathway 1701 includes at least three volumes 1703, 1705, and 1707. The first volume 1703 can be embodied in a tubular structure, a cylindrical structure, or any other structure with a defined boundary (not shown) that connects the BA based valve 210 of the in-ear speaker 206 to the ambient environment outside the ear 102. The second volume 1705 can be embodied in a tubular structure, a cylindrical structure, or any other structure with a defined boundary (not shown) that connects the BA based valve 210 of the in-ear speaker 206 to the ear canal 104 inside the ear 102. The third volume 1707 can be embodied as the BA based valve 210 itself.

For an embodiment, the centerline of the pathway 1701 could be circuitous, rectilinear, or any combination of having a simple or complex direction. Furthermore, the BA based valve 210 of the in-ear speaker 206 can be placed anywhere along the pathway 1701, either closer to the ear canal 104 or closer to the ambient environment outside the ear 102. For a specific embodiment, the valve flap of the BA based valve 210 is placed along the centerline of the pathway 1701.

For one embodiment, each of the volumes 1703, 1705, and 1707 of the pathway 1701 is quantified in terms of that specific volume's acoustic impedance (also known as acoustic mass). In this way, the entire pathway 1701 can be quantified using an overall acoustic impedance ($Z_{TOTAL}$). The use of acoustic impedance to describe each of the volumes 1703, 1705, and 1707 of the pathway 1701 is due to the fact that the presence or absence of acoustic impedance dominates the behavior and effectiveness of the active vent system 1700. The volume 1703 (which can be embodied in a structure that is not shown in FIG. 17) is quantified by its acoustic impedance $Z_{AMB}$, which represents the acoustic impedance of the structure connecting the BA based valve 210 to the ambient environment outside the ear 102. The volume 1705 (which can be embodied in a structure that is not shown in FIG. 17) is quantified by its acoustic impedance $Z_{EAR}$, which represents the acoustic impedance of the structure connecting the BA based valve 210 to the ear canal 104 inside the ear 102. The volume 1707 is quantified by its acoustic impedance $Z_{BA}$, which represents the acoustic impedance in the BA based valve 210 itself. For some embodiments, $Z_{BA}$ is considered to be negligible. For other embodiments, $Z_{BA}$ is a factor in the overall acoustic impedance ($Z_{TOTAL}$).

For one embodiment, and with regard to the pathway 1701, the formula for overall acoustic impedance ($Z_{TOTAL}$) is as follows:

$$Z_{TOTAL}=Z_{AMB}+Z_{BA}+Z_{EAR}$$

For one embodiment, the overall acoustic impedance ($Z_{TOTAL}$) is at least 500 $Kg/m^4$. For one embodiment, the overall acoustic impedance ($Z_{TOTAL}$) is at most 800,000 $Kg/m^4$. The concept of acoustic impedance or acoustic mass is well known to those skilled in the art, so a derivation and calculations for the ranges are not provided here.

A Hybrid Transparency System

Figure 18:
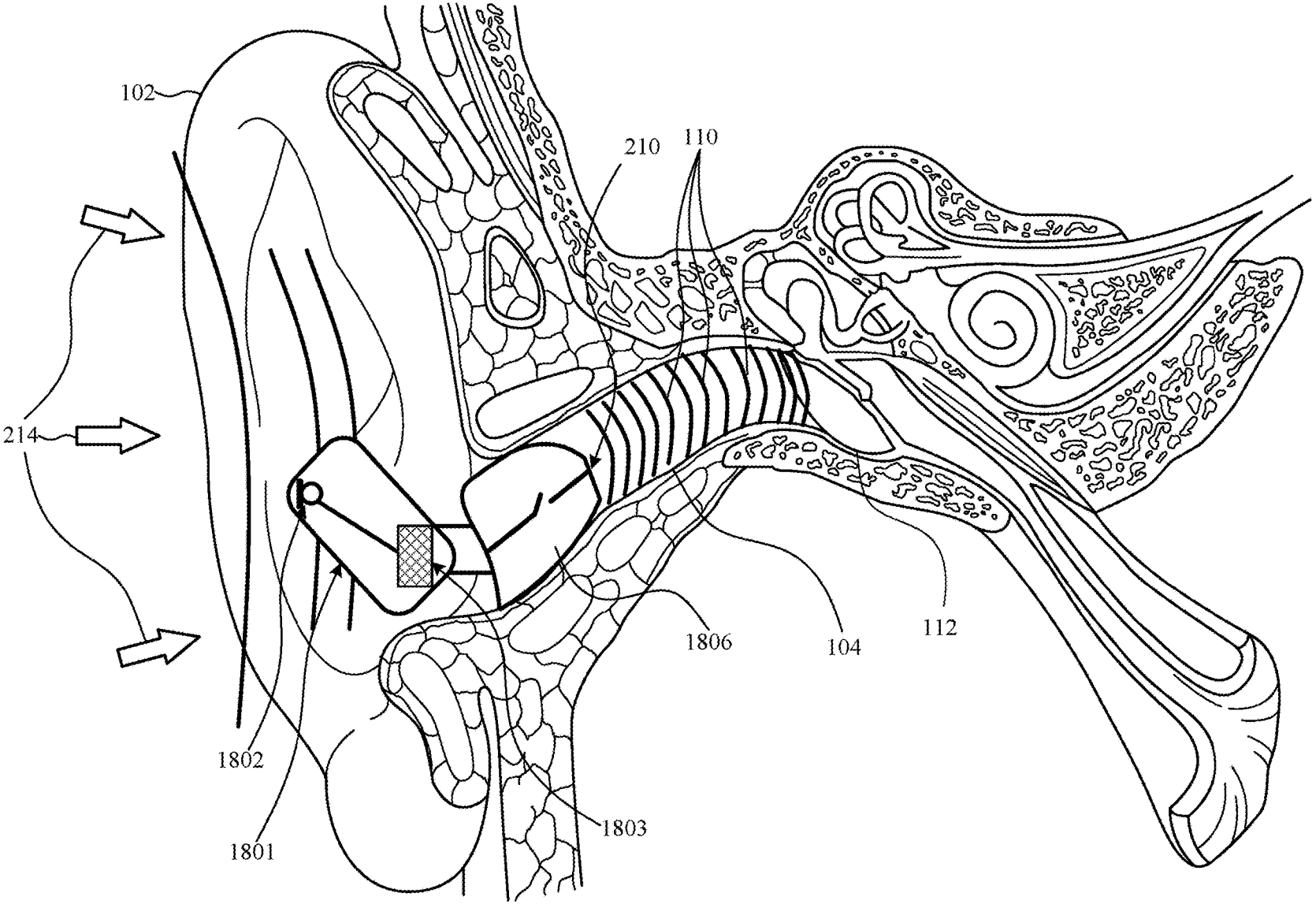
FIG. 18 is an illustration of an in-ear speaker that is configured as a hybrid transparency system in accordance with one embodiment.

FIG. 18 is an illustration of an in-ear speaker 1806, which is configured as a hybrid audio transparency system in accordance with one embodiment. For one embodiment, the in-ear speaker 1806 assists with enabling a user of the in-ear speaker 1806 to achieve (i) isolation from sounds 214 in the ambient environment, by preventing those sounds 214 from entering the user's ear canal 104 using the combination of passive ear canal sealing and closing of the valve 210; and (ii) perception of audio transparency by enabling delivery of the sounds 214 from the ambient environment to the ear canal 104 even while the ear canal is sealed, via the combination of the opening of the valve 210 and activation of an ambient sound augmentation system 1801. In this way, the in-ear speaker 1806 is a hybrid audio transparency system. It should be noted that the description refers to the valve 210 generically, in that venting or acoustic pass valves other than BA based valves can be used, including for example micro electromechanical system (MEMS)-based valves.

The in-ear speaker 1806 includes a user content sound system to receive a user content audio signal, being a recorded audio program signal or a downlink audio signal of a phone call, and convert the user content audio signal into sound for delivery into an ear canal that is sealed by the in-ear speaker. In a simple form, the user content sound system may consist of an electro-acoustic transducer (speaker driver) installed within the housing of the in-ear speaker, with a wired audio connection to an external device from which the user content audio signal is received and that directly drives the signal input of the speaker driver. In other embodiments, the user content sound system may include an audio amplifier within the housing of the in-ear speaker 1806, digital audio signal processing (enhancement) capability, and a wireless digital communication interface through which the user content audio signal may be wirelessly received from some external device.

The in-ear speaker 1806 also includes the valve 210 which may be similar to or the same as any of the valves 210 described above in connection with FIGS. 1-17. A processor 1803 can trigger an opening or closing of the valve 210. Processor 1803 may represent a single microprocessor or multiple microprocessors. Processor 1803, which may be a low power multi-core processor such as an ultra-low voltage processor, may act as a main processing unit and central hub for communication with the various components of the in-ear speaker 1806 (including the user content audio system.) Processor 1803 is to execute instructions stored in memory (or is programmed), for performing the operations discussed herein in connection with at least one of FIGS. 18-22. The processor 1803 may be configured to control or coordinate a functioning of the in-ear speaker 1806, including a functioning of the in-ear speaker 1806 as a hybrid audio transparency system. For one embodiment, the processor 1803 is located outside of the housing of the in-ear speaker, as part of an external data processing system (not shown) that is communicatively coupled to the in-ear speaker 1806 via a wired or a wireless digital communication interface, such as one that is shared by the user content sound system introduced above. For one embodiment, this external data processing system can be part of an external electronic device as described above in connection with at least FIG. 5A.

The in-speaker 1806 also has a sound augmentation system 1801. The sound augmentation system 1801 includes an external microphone 1802, whose output signal is coupled to the processor 1803. The term "external" is used here to differentiate between the microphone 1802 and another microphone 2002, where the latter as described below is designed to pick up sound within the ear canal. The sound augmentation system 1801 uses the external microphone 1802 to electrically pick up sound 214 from the ambient environment (not from the ear canal). This ambient sound is then reproduced into the ear canal 104 for absorption by the eardrum 112, using an acoustic (speaker) driver in the in-ear speaker 1806 (e.g., one that is shared with the user content sound system). The sound 214 is picked up by the external microphone 1802, converted into an electrical audio signal, processed by the processor 1803, and then converted back into acoustic form as delivered into the ear canal 104. For one embodiment, the processor 1803 also implements an equalizer to digitally adjust a frequency component of the sound that has been picked up by the external microphone 1802. For one embodiment, these adjustments are made to provide the reproduced version of the sound 214 with characteristics that assist with enabling a user of the in-ear speaker to perceive the sound 214 as if there was no in-ear speaker 1806 sealing the ear 102 (the concept of audio transparency).

Figure 19:
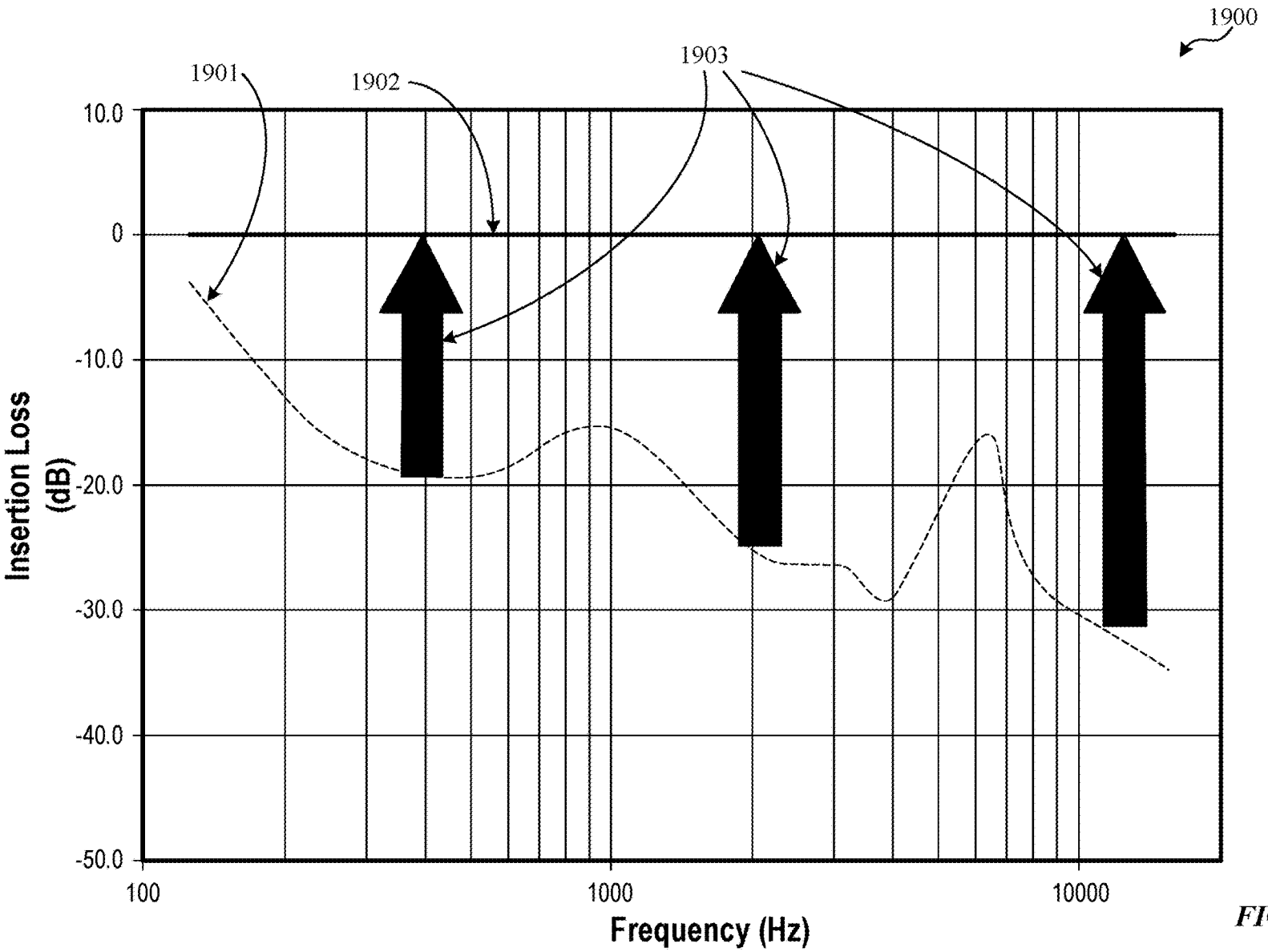
FIG. 19 is a chart illustrating how the in-ear speaker illustrated in FIG. 18 can be used to adjust a characteristic of an audio signal that reflects the sound content from an ambient environment of the in-ear speaker of FIG. 18.

Referring briefly to FIG. 19, a chart 1900 is illustrated to show in part how the sound augmentation system works. The processor 1803 adjusts (1903) the audio signal picked up by the external microphone (ambient sound signal) in order to provide the audio signal (that will be converted into sound) with one or more characteristics that assist with enabling a user of the in-ear speaker to perceive the sound 214 as if there was no in-ear speaker 1806 sealing the ear 102. As shown in FIG. 19, the curve 1901 represents the sound pressure losses in decibels (dB) associated with sealing the ear canal (hereinafter "insertion losses"), as a function of frequency. The curve 1902 represents the sound pressure in an unsealed ear canal that enables a user of the in-ear speaker 1806 to perceive the sounds 214 comfortably. For one embodiment, the processor 1803 implements an equalizer that adjusts 1903 the frequency components (gains) of the sound 214 that is picked up by the microphone 1802. As shown in FIG. 19, the equalizer adjusts 1903 the gains at certain frequencies of the ambient audio signal, to compensate for the insertion losses, so as to give the processed, ambient audio signal effectively a zero decibel (dB) insertion loss.

For one embodiment, the processor 1803 can activate the sound augmentation system 1801 (to reproduce the sounds 214 of the ambient environment as the processed, ambient audio signal) in response to or whenever the valve 210 is being opened to promote a hybrid, audio transparency approach; it may then deactivate the sound augmentation system when the valve 210 is being closed to achieve isolation from the sounds 214 in the ambient environment.

For one embodiment, one or more of the control signals that cause the opening or closing of the valve 210 can be based on one or more measurements of one or more sensors (not shown) and based on an operating state of an external electronic device (e.g., a smartphone, a computer, a wearable computer system, etc.) that is using or electrically connected to the in-ear speaker 1806 to generate user content sound. For example, and for one embodiment, the one or more sensors can include at least one of an accelerometer, a sound sensor, a barometric sensor, an image sensor, a proximity sensor, an ambient light sensor, a vibration sensor, a gyroscopic sensor, a compass, a barometer, a magnetometer, or any other sensor whose purpose is to detect a characteristic of one or more environs. For one embodiment, the one or more control signals are applied to the coil assembly 514 and are based on one or more measurements of the one or more sensors. The one or more sensors may be included as part of the valve 210, as part of the in-ear speaker 1806 that includes the valve 210, or within the housing of an external electronic device (e.g., a smartphone, a computer, a wearable computer system, etc.) that is communicatively coupled to the in-ear speaker 1806 and provides the input user content audio signal to the in-ear speaker 1806.

For one embodiment, the one or more sensors are coupled to logic (not shown) that determines, based on one or more measurements of the one or more sensors, when to activate the control signals that cause the opening or closing of the valve 210. Furthermore, in response to the logic's determination that the valve 210 should be opened, the processor 1803 activates or operates the sound augmentation system 1801 as described above in connection with FIG. 18.

For one embodiment, a software component on an external electronic device (e.g., a smartphone, a computer, a wearable computer system, etc.) that is communicatively coupled to the in-ear speaker 1806 can analyze and/or gather data provided to or received by one or more software applications (e.g., an atmospheric pressure monitoring application, a weather monitoring application, etc.) that are running on the external electronic device. For one embodiment, based on the analyzed and/or gathered data, the software component determines whether to open or close the valve 210. In response to the opening of the valve 210, the processor 1803 can activate or operate the sound augmentation system 1801 as described above in connection with FIG. 18.

For one embodiment, the processor 1803 operates, in conjunction with the examples and embodiments described above in connection with FIG. 5A, to combine use of the valve 210 with the sound augmentation system 1801. In each of those examples and/or embodiments, the processor 1803 operates the sound augmentation system 1801 as described above in connection with FIG. 18 in response to the valve 210 being opened. Other examples and/or embodiments are also possible. It is to be appreciated that the immediately preceding examples are merely for illustration and are not intended to be limiting. This is because there are numerous types of sensors and ways in which the numerous types of sensors can be used and/or combined to operate the sound augmentation system 1801 (in response to an opening or closing of the valve 210.) It is also to be appreciated that one or more of the examples and/or embodiments described above can be combined or practiced without all of the details set forth in the examples and/or embodiments described above.

For one embodiment, the logic that determines, based on one or more measurements of the one or more sensors, when one or more of the control signals that cause the opening or closing of the valve 210 are activated, can be manually overridden by the listener, to open or close the valve 210 when the listener chooses. For this embodiment, and in response to the opening of the valve 210 when there is a listener override, the processor 1803 activates the sound augmentation system 1801 as described above in connection with FIG. 18. In one embodiment, an external electronic device (which is electrically, that is wirelessly or via a wire link, connected to the in-ear speaker 1806 that includes the valve 210) can include one or more input devices that enable a listener to provide an input (as an override by the listener) that causes the logic to provide the control signal that causes the valve 210 to open. For this example, the processor 1803 also responds by operating the sound augmentation system 1801 as described above in connection with FIG. 18 (in response to the valve 210 being opened.) For one embodiment, the external electronic device may be include, but is not limited to, the in-ear speaker 1806 that includes the valve 210, but it may alternatively be a smartphone, a tablet computer, or a wearable computer system.

The use of the combination of the valve 210 and the sound augmentation system 1801 can assist in enabling the listener (wearer) of the in-ear speaker 1806 to improve his perception of audio transparency, by enabling effectively a delivery of the sound 214 from the ambient environment to the ear canal 104 via a combination of both the valve 210 and the sound augmentation system 1801.

For one embodiment, the in-ear speaker 1806 can also include an active noise control or acoustic noise cancellation (ANC) system (not shown) comprised of an acoustic driver, an error microphone (not shown) and the processor 1803, that work together to perform acoustic noise cancellation in order to reduce the occlusion effect (as explained earlier). The use of a processor and an error microphone for ANC is known so it is not discussed in detail, but in one embodiment, the ANC system can, via the error microphone, assist with controlling the adaptation of anti-noise (or anti-phase) that is acoustically combined with unwanted sound inside the ear canal, to cancel out any unwanted sounds (e.g., sounds from the ambient environment that may have leaked into the ear canal, or occlusion effect sounds produced in the ear canal). In this way, the ANC system can assist—in combination with the valve 210 and the sound augmentation system 1801—with improving isolation from the sounds 214 in the ambient environment, by preventing those sounds 214 that have leaked into the user's ear canal 104 from being perceived by the user. For one embodiment, the ANC system is activated or operated to reduce the occlusion effect (as explained above), only in response to a closing of the valve 210; in one embodiment, the ANC system is then deactivated upon the valve 210 being opened.

Figure 20:
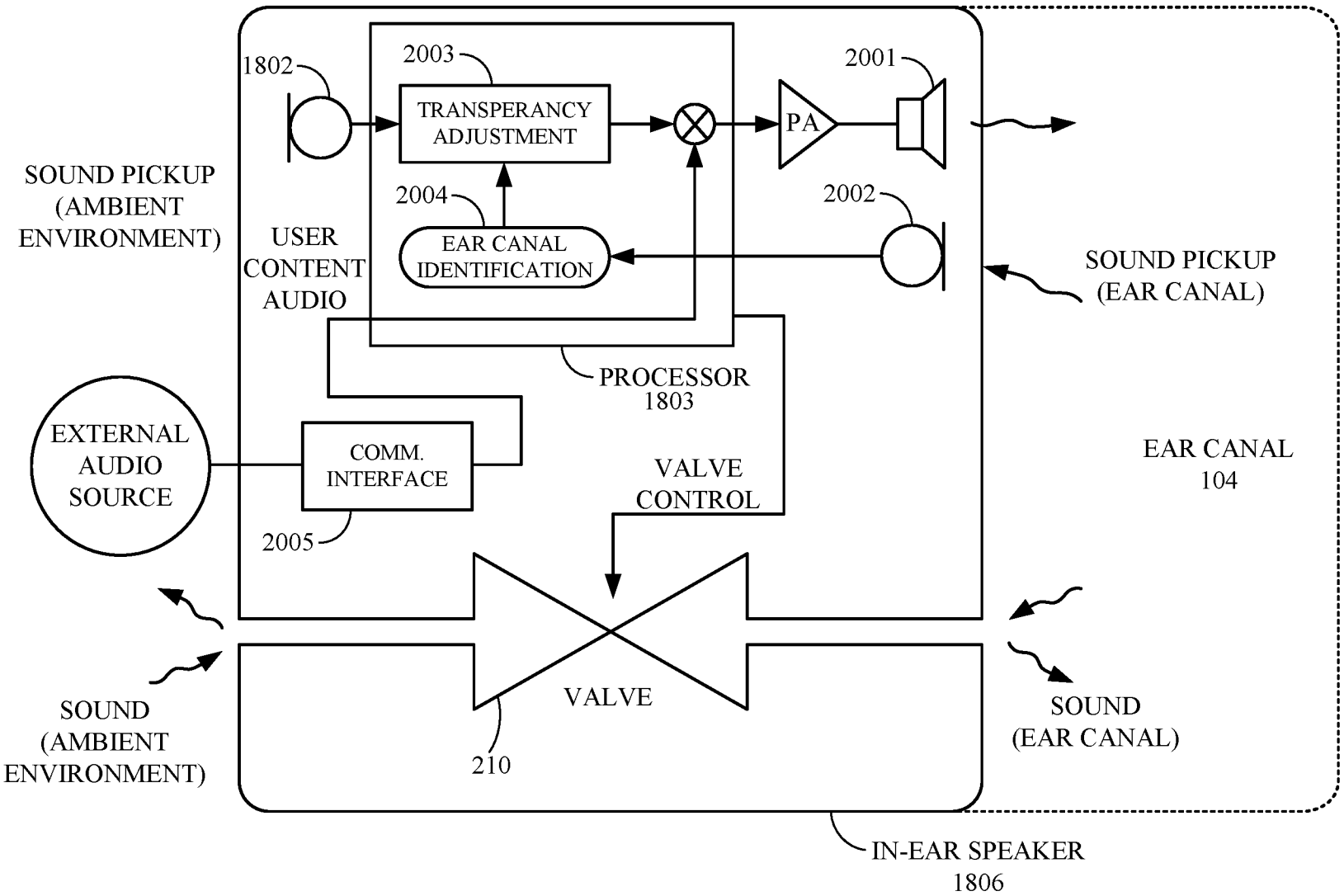
FIG. 20 is a block diagram of the in-ear speaker configured as a hybrid transparency system

FIG. 20 is a block diagram of an embodiment of the in-ear speaker 1806 that is configured as an audio transparency system in accordance with one embodiment. As shown in FIG. 20, the in-ear speaker 1806 is inserted into the ear canal 104 and may form a seal against the wall of the ear canal 104. The in-ear speaker 1806 can be designed as a sealable insertable in-ear speaker or a leaky insertable in-ear speaker, as defined herein. For one embodiment, the processor 1803 may be programmed in accordance with or include a transparency adjustment module 2003 and an ear canal identification module 2004. The transparency adjustment module 2003 may be a variable, spectral shaping filter or equalizer. The ear canal identification module 2004 may serve to determine an equalization profile, based on which it may configure the digital filter coefficients of the spectral shaping filter in the transparency adjustment module 2003. The valve 210 can be opened and closed as described above in connection with at least one of FIGS. 1-17, under control of a program that may be executed by the processor 1803, e.g., during audio playback or during a phone call, that controls at a higher level the audio transparency of the in-ear speaker. Ambient environment sound is picked up by the microphone 1802, which converts the sound into an electrical audio signal that is provided to the processor 1803 for further processing.

For one embodiment, the processor 1803 adjusts the spectrum of the electrical audio signal from the microphone 1802, to compensate for any insertion losses that are due to the in-speaker 1806 being installed in the wearer's ear and therefore at least partially blocking the ear canal and that affect the ambient sound that leaks past the in-ear speaker housing and may be perceived the wearer. For one embodiment, the adjustment is based on an equalization profile of the ear canal. For one embodiment, the profile is a collection of one or more acoustic characteristics associated with the specific ear canal 104 of the wearer. Acoustic characteristics include, but are not limited to, a sound pressure associated with the ear canal; a particle velocity associated with the ear canal; a particle displacement associated with the ear canal; an acoustic intensity associated with the ear canal; an acoustic power associated with the ear canal; a sound energy associated with the ear canal; a sound energy density associated with the ear canal; a sound exposure associated with the ear canal; an acoustic impedance associated with the ear canal; an audio frequency associated with the ear canal; and a transmission loss associated with the ear canal.

Referring back to FIG. 19, the chart 1900 shows an example of how the processor 1803 can adjust 1903 the sounds 214 from the ambient environment that are picked up by the external microphone 1802 in order to provide those sounds with one or more characteristics that assist with enabling a user of the in-ear speaker 1806 to perceive the sounds 214 as if there was no in-ear speaker 1806 sealing the ear 102. As shown in FIG. 19, the curve 1901 represents the sound pressure losses in decibels (dB) associated with sealing the ear canal (hereinafter "insertion losses"). As a specific example, the curve 1901 can be used to represent the insertion losses due to either a sealable or a leaky insertable in-ear speaker 1806, when those sound pressure losses are measured at (or estimated for) the ear drum of a user of the in-ear speaker 1806. The curve 1902 represents the sound pressure in an unsealed ear canal that enables a user of the in-ear speaker 1806 to perceive the sounds 214 comfortably. For one embodiment, the processor 1803 implements an equalizer or spectral shaping filter (transparency adjustment module 2003) that adjusts 1903 the frequency components of the sound 214 that is picked up by the microphone 1802. As shown in FIG. 19, the equalizer of the processor 1803 adjusts (here, boosts) 1903 the gain at certain frequency components of the sound 214, to compensate for the insertion losses, so as to give the sounds 214 a zero decibel (dB) insertion loss.

The adjustments 1903 that are intended to bring the curve 1901 closer to the curve 1902 may be realized by the spectral shaping filter that is part of the transparency adjustment module 2003. The spectral shaping filter (e.g., its digital filter coefficients) may be defined based on the equalization (EQ) profile of the ear canal 104. For one embodiment, the EQ profile is unique to a specific ear canal 104 of the wearer and no other ear canal 104—i.e., each user or wearer has a unique EQ profile, because each user's actual ear canal is unique. The goal of the EQ profile is to define the recovery of any insertion losses attributable to the presence of the in-ear speaker (e.g., insertion losses due to the in-ear speaker 1806 when sound pressure losses are measured or estimated at the ear drum of a user of the in-ear speaker 1806) to a unity match, which is illustrated in FIG. 19 in the form of the curve 1902 as a flat target. Curve 1902, however, is not so limited. For example, the curve 1902 can be measured as a response to an external sound, at the ear drum of a user of the in-ear speaker 1806, when that user's ear canal is not sealed by the in-ear speaker 1806. For this example, the curve 1902 is not flat but includes resonances and other variations due to the ear canal geometry. Various forms of representing the curve 1902 to indicate the sound pressure within an unsealed ear canal are known in the art so they are not discussed in detail.

When the EQ profile is to be unique to each user, the EQ profile can be ascertained using one or more audio test signals that generated by the processor 1803 and used to measure the one or more acoustic properties of the ear canal 104. The test signal is converted into sound, e.g., by an acoustic driver or transducer 2001 of the in-ear speaker 1806, or by another acoustic driver (not shown), that can be picked up by the error microphone 2002 or by the external microphone 1802. The ear canal identification module 2004 can the compute the EQ profile based on those microphone signals and based on other data received from outside of the in-ear speaker, e.g., from the external audio source device, and then on that basis computes the digital filter coefficients of the spectral shaping filter in the transparency adjustment module 2003.

In another embodiment, the equalization profile is not unique to the ear canal 104 of the wearer. For this embodiment, the equalization profile is based on an average of multiple acoustic properties associated with multiple ear canals (e.g., a statistical measure across a number of wearers). In this way, the processor 1803 and in particular the transparency adjustment module 2003 (equalizer filter or spectral shaping filter) can be pre-programmed in accordance with the equalization profile of an "average" ear canal 104; in that case, the ear canal identification module 2004 may not be needed to compute the equalization profile, but may simply retrieve or receive the EQ profile, e.g., from the external source device. For this embodiment, the processor 1803 might not even have to actually compute the digital filter coefficients of the spectral shaping filter, as those could be retrieved from the external source device, which can assist with reducing costs associated with the processing operations performed by the processor 1803.

For one embodiment, the processor 1803 (and in particular the transparency adjustment module 2003) adjusts the frequencies of the ambient sounds detected in the curve 1902 (described above in connection with FIG. 19 that is determined) based on the equalization profile. Specifically, the processor 1803 adjusts the frequencies of the ambient sounds until those sounds exhibits zero decibel insertion losses, as shown in the curve 1902 described above in connection with FIG. 19.

For one embodiment, the adjusted audio signal is converted into sound (after being amplified by a power amplifier, PA) and delivered by the output transducer 2001, to the ear canal 104. The output transducer 2001 can be any kind of transducer capable of converting electrical audio signals into acoustic signals that can be perceived by a user's ear drum. For one embodiment, the output transducer 2001 is also an acoustic driver of the in-ear speaker 1806 that receives as input a user content audio signal produced by an external electronic audio source device (e.g., a smartphone, a portable media player), for delivering user content sounds to the ear canal 104. The in-ear speaker may have a communications interface 2005 (e.g., a wire or cable interface, or a wireless interface such as a Bluetooth transceiver) through with the user content audio signal is received. The processor 1803 may include an audio mixer that combines the user content audio signal with the processed (adjusted) ambient content audio signal (from the transparency adjustment module 2003) into a single signal, before the conversion into sound by the transducer 2001.

Figure 21:
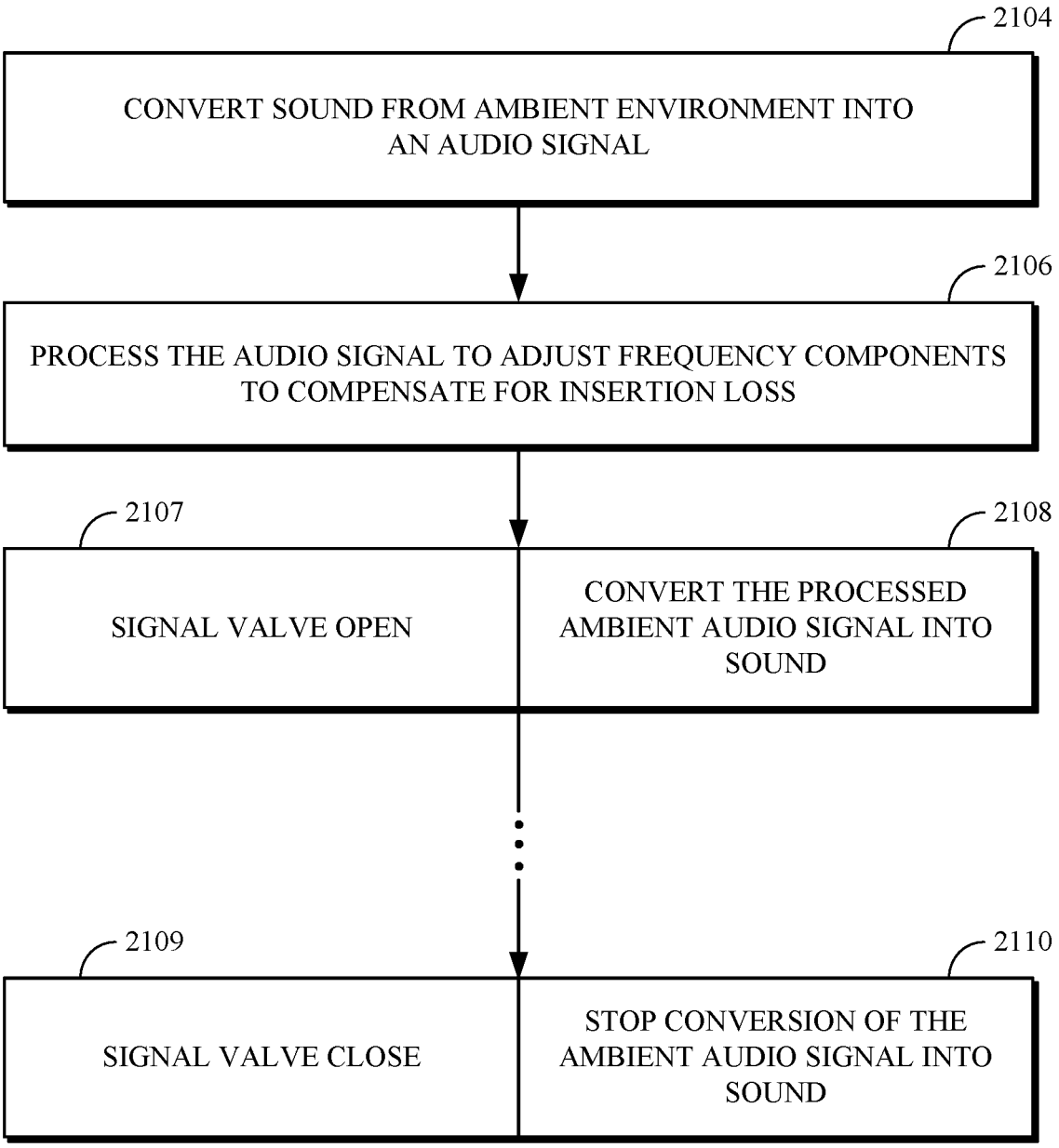
FIG. 21 is a process of using an insertable in-ear speaker as a hybrid transparency system in accordance with one embodiment.

FIG. 21 is a flow diagram of a process for sound augmentation in an in-ear speaker as a hybrid transparency system in accordance with one embodiment. The process can be performed by the electronic and transducer components of an insertable in-ear speaker, such as the in-ear speakers described above in connection with FIGS. 18-20. The process may begin when one or more sounds from the ambient environment are being picked up and converted into one or more electrical audio signals, by an external microphone of the in-ear speaker (operation 2104). In operation 2106, the electrical audio signals are processed to adjust one or more frequency components of sounds, to compensate for the insertion loss. For one embodiment, operation 2106 is performed in accordance with the description provided above in connection with at least one of FIGS. 18-20. When a decision has been made (e.g., by the processor 1803) that audio transparency is needed, the process continues with operation 2108 in which the ambient content audio signal as it has been adjusted to compensate for insertion loss, is converted into sound that is delivered to the wearer's ear canal, and operation 2107 in which the valve 210 (see FIG. 20) is signaled by the processor 1803 to open. The sound augmentation path (from the microphone 1802 to the transducer 2001) may be particularly effective in improving the wearer's ability to hear the ambient content that is above 1 kHz, and more particularly above 1500 Hz, while the valve 210, which is simultaneously open, improves the wearer's ability to hear the ambient content that is below 1 kHz, and more particularly below 1500 Hz.

Figure 22A:
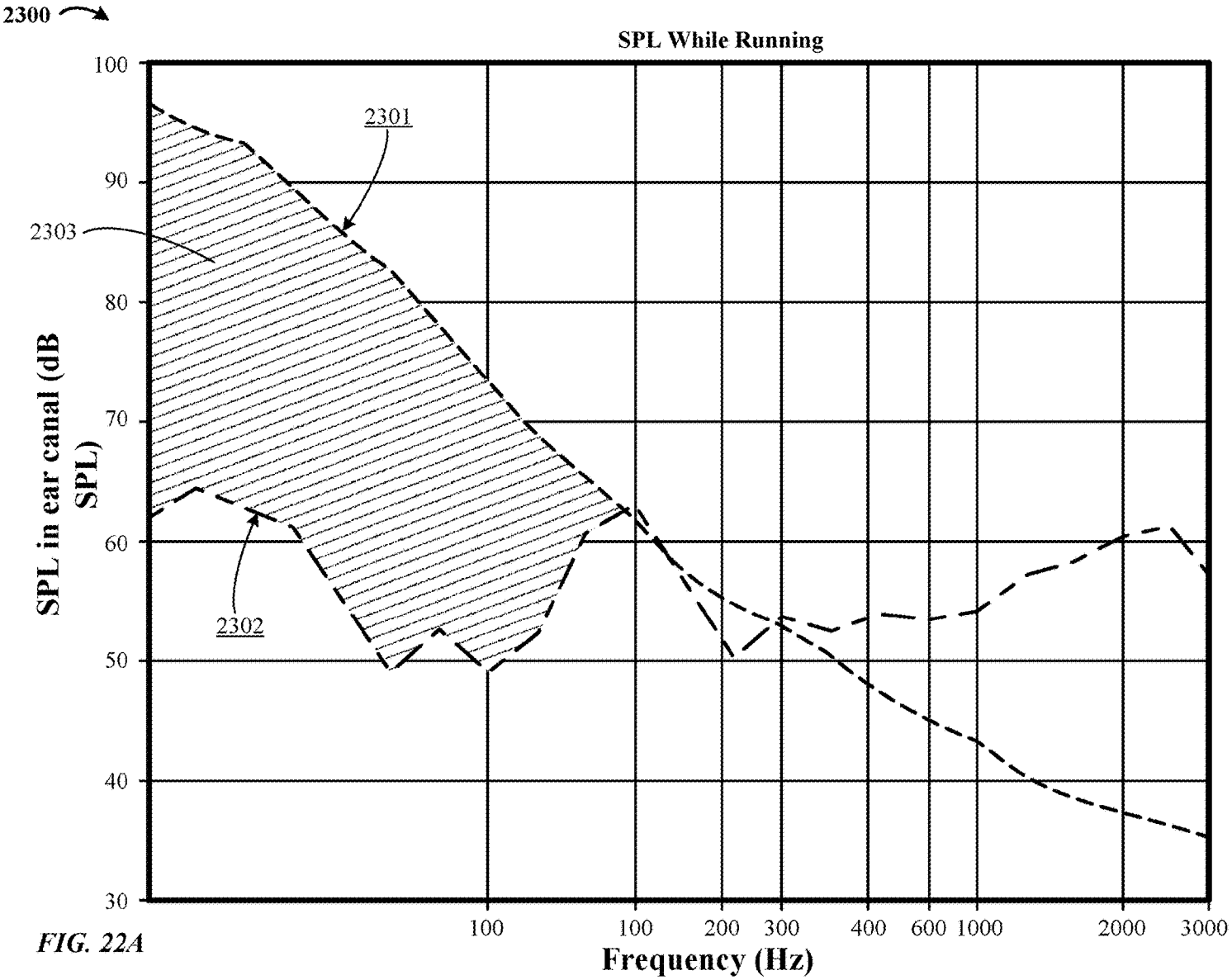
FIGS. 22A-B are charts illustrating at least one benefit of an in-ear speaker that includes at least one of a BA based valve or a sound augmentation system in accordance with one embodiment.
Figure 22B:
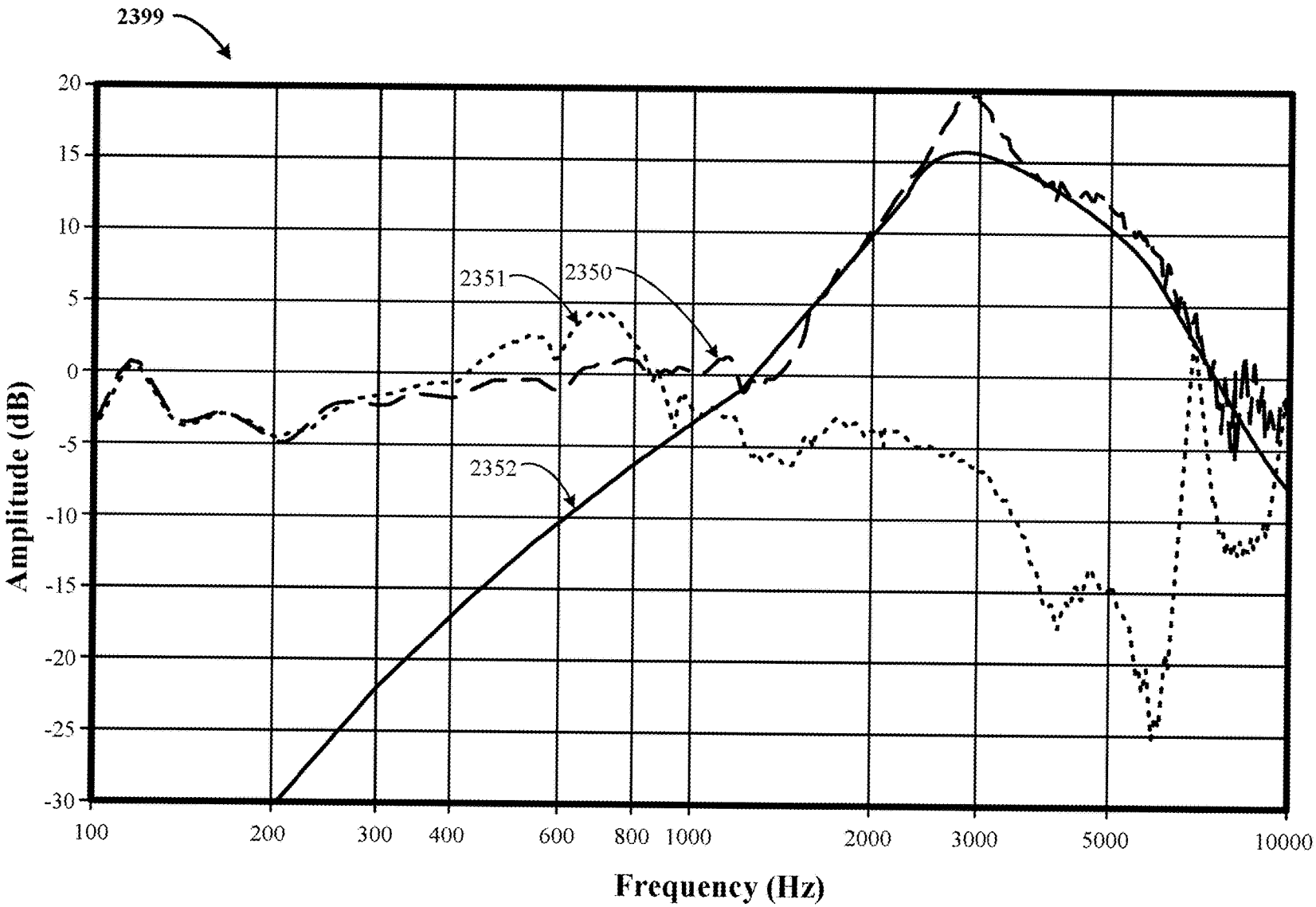

FIGS. 22A-B are charts illustrating at least one benefit of an in-ear speaker that includes the valve 210 and the sound augmentation system in accordance with one embodiment. Referring to FIG. 22A, the chart 2300 illustrates a curve 2301, a curve 2302, and a region 2303 created by an overlap of the curves 2301 and 2302. The curve 2301 represents unwanted energy in an occluded ear canal that is produced due to footfalls (e.g., running, walking, etc.) The curve 2302 represents energy in an open ear canal that is produced due to footfalls (e.g., running, walking, etc.). The energy represented by the curve 2302 is at a level that is comfortable for a user's perception of audio inside his ear canal. The energy in region 2303 represents the energy that should be mitigated or removed from an occluded ear that is sealed by any of in-ear speakers described above in connection with FIGS. 5A-21. For one embodiment, an in-ear speaker that includes the valve 210 and the sound augmentation system described above in connection with FIGS. 5A-21 can assist with mitigating the energy represented by the curve 2301 to be closer to the energy represented by the curve 2302, by reducing the unwanted energy represented by the region 2303.

Referring now to FIG. 22B, a chart 2399 illustrates how an in-ear speaker that includes the valve 210 and the sound augmentation system (e.g., any one of the in-ear speakers described above in connection with FIGS. 18-21) contributes to reducing an occlusion effect and to improving audio transparency experienced by a user of such an in-ear speaker. The chart 2399 includes a curve 2350, a curve 2351, and a curve 2352. The curve 2350 represents energy within an open ear that is not occluded or sealed. The curve 2351 represents energy within a sealed ear when the valve 210 (e.g., any one of the BA based valves described above in connection with FIGS. 5A-21) is functioning and is open but while the sound augmentation is inactive. The ear is sealed with an in-ear speaker that includes the valve 210 and a sound augmentation system (e.g., any one of the in-ear speakers described above in connection with FIGS. 18-21). The curve 2352 represents energy within the sealed ear when the sound augmentation system is active and the valve is closed. As can be recognized from FIG. 22B, the valve 210 by itself can assist with mitigating unwanted energy from a sealed ear, at frequencies that are approximately below 1500 Hz but not at frequencies above 1500 Hz. At frequencies above 1500 Hz, the sound augmentation system can assist with increasing the desired energy in the sealed ear, while the valve 210 is open. In this way, the in-ear speaker is a hybrid transparency system that includes both the valve 210 and the sound augmentation system working simultaneously to assist with reducing occlusion effects and improving audio transparency.

Each of FIGS. 22A-B are illustrative charts used to show at least one benefit of an in-ear speaker that includes an acoustic pass valve and a sound augmentation system. It is to be appreciated that the values in the charts are approximate or ideal values (not exact or real values).

Returning to the flow diagram of FIG. 21, the process may continue with the processor 1803 deciding at some point that audio transparency is not needed. In that case, the process continues with operation 2110 in which conversion of the ambient audio signal into sound is halted, by the processor 1803 (the sound augmentation system is deactivated), and simultaneously the valve 210 is signaled to close (operation 2109). This returns the in-ear speaker to its state in which it aims to prevent the ambient sounds from being heard by the wearer of the in-ear speaker.

Figure 23:
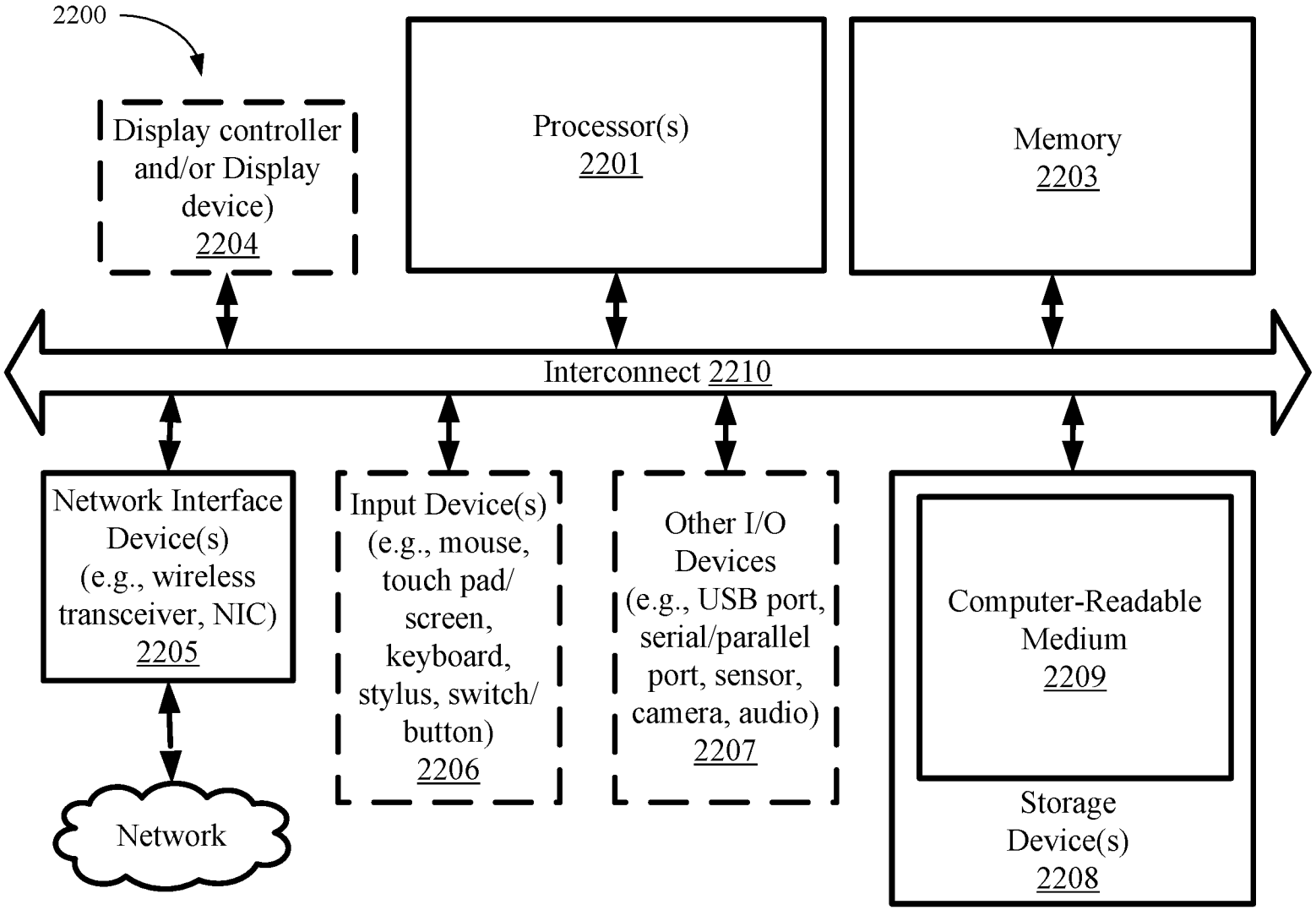
FIG. 23 illustrates an exemplary data processing system according to one or more of the embodiments described herein.

FIG. 23 is a block diagram illustrating an example of a data processing system 2200 that may be used with one embodiment. For a first example, system 2200 may represent any of data processing systems described above performing any of the processes or methods described above. For a second example, system 2200 may represent any of data processing systems used to generate music that is provided to any one of the embodiments of an in-ear speaker as described above in connection with at least one of FIGS. 1-21. For a third example, system 2200 may represent any of in-ear speakers used to deliver music to an ear canal as described above in connection with at least one of FIGS. 1-21.

System 2200 can include many different components. These components can be implemented as integrated circuits (ICs), portions thereof, discrete electronic devices, or other modules adapted to a circuit board such as a motherboard or add-in card of the computer system, or as components otherwise incorporated within a chassis of the computer system. Note also that system 2200 is intended to show a high-level view of many components of the computer system. Nevertheless, it is to be understood that additional components may be present in certain implementations and furthermore, different arrangement of the components shown may occur in other implementations. System 2200 may represent a desktop, a laptop, a tablet, a server, a mobile phone, a media player, a personal digital assistant (PDA), a personal communicator, a gaming device, a network router or hub, a wireless access point (AP) or repeater, a set-top box, an in-ear speaker, or a combination thereof. Further, while only a single machine or system is illustrated, the term "machine" or "system" shall also be taken to include any collection of machines or systems that individually or jointly execute a set (or multiple sets) of instructions to perform any one or more of the methodologies discussed herein.

In one embodiment, system 2200 includes processor 2201, memory 2203, and devices 2205-1508 via a bus or an interconnect 2210. Processor 2201 can be programmed to execute instructions for performing any of the digital processing operations described above. System 2200 may further include a graphics interface that communicates with optional graphics subsystem 2204, which may include a display controller, a graphics processor, and/or a display device. Processor 2201 may communicate with memory 2203, which in one embodiment can be implemented via multiple memory devices to provide for a given amount of system memory. System 2200 may further include 10 devices such as devices 2205-1508, including network interface device(s) 2205, optional input device(s) 2206, and other optional 10 device(s) 2207. Network interface device 2205 may include a wireless transceiver and/or a network interface card (NIC). The wireless transceiver may be a WiFi transceiver, an infrared transceiver, or a Bluetooth transceiver (e.g. used to communicate with the in-ear speaker.) Input device(s) 2206 may include a mouse, a touch pad, a touch sensitive screen (which may be integrated with display device 2204), a pointer device such as a stylus, and/or a keyboard (e.g., physical keyboard or a virtual keyboard displayed as part of a touch sensitive screen). IO devices 2207 may include an audio device. An audio device may include a speaker and/or a microphone to facilitate voice-enabled functions, such as voice recognition, digital recording, telephony functions and for producing test sounds. Other IO devices 2207 may include universal serial bus (USB) port(s), sensor(s) (e.g., a motion sensor such as an accelerometer, gyroscope, a magnetometer, a light sensor, compass, a proximity sensor, etc.), or a combination thereof. Devices 2207 may further include an imaging processing subsystem (e.g., a camera), which may include an optical sensor, such as a charged coupled device (CCD) or a complementary metal-oxide semiconductor (CMOS) optical sensor, utilized to facilitate camera functions. Certain sensors may be coupled to interconnect 2210 via a sensor hub (not shown), while other devices such as a keyboard or thermal sensor may be controlled by an embedded controller (not shown), dependent upon the specific configuration or design of system 2200.

Note that while system 2200 is illustrated with various components of a data processing system, it is not intended to represent any particular architecture or manner of interconnecting the components; such details may not be germane to embodiments of the present invention. It will also be appreciated that network computers, handheld computers, mobile phones, servers, and/or other data processing systems, which have fewer components or perhaps more components, may also be used with embodiments of the invention.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilising terms such as those set forth in the claims below, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Embodiments of the invention also relate to an apparatus for performing the operations herein. Such a computer program is stored in a non-transitory computer readable medium. A machine-readable medium includes any mechanism for storing information in a form readable by a machine (e.g., a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices).

The processes or methods depicted in the preceding figures may be performed by logic or logic circuitry (also referred to as processing logic) that comprises hardware (e.g. circuitry, dedicated logic, etc.), software (e.g., stored or embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

In the foregoing specification, embodiments of the invention have been described with reference to specific exemplary embodiments thereof. It will be evident that various modifications may be made thereto without departing from the broader spirit and scope of the invention as set forth in the following claims. Also, it is to be appreciated that each of the devices, components, or objects illustrated in FIGS. 1-23 are not necessarily drawn to scale and that the sizes of these components are not necessarily identical. For example, the coil assembly 414 illustrated in FIG. 8 may or may not be identical in size and/or shape to the coil assembly 514 illustrated in FIG. 8.

The specification and drawings are, accordingly, to be regarded in an illustrative sense rather than a restrictive sense.

What is claimed is:

1. An insertable in-ear speaker configured as a hybrid transparency system, the insertable in-ear speaker comprising:

a user content sound system to receive an audio signal, and convert the audio signal into sound for delivery into an ear in which the in-ear speaker has been inserted;

an ambient sound augmentation system having an external microphone which is configured to pick up sound in the ambient environment of the in-ear speaker, as a microphone audio signal, wherein the system is activated to process the microphone audio signal before converting the microphone audio signal into sound for delivery into the ear, and to increase a gain of a plurality of frequency components of the microphone audio signal in accordance with a profile comprising a plurality of acoustic characteristics associated with the ear;

a valve that can be configured between i) an open state and a closed state;

an active noise control (ANC) subsystem that is activated to produce anti-noise for delivery into the ear; and logic to signal the valve into the open state while activating the sound augmentation system, and then signal the valve into the closed state while activating the ANC subsystem.

2. The insertable in-ear speaker of claim 1, wherein the valve is an active, venting or acoustic valve, and the logic is to activate the ambient sound augmentation system in response to signaling the valve into the open state.

3. The insertable in-ear speaker of claim 1, wherein the profile comprises an equalization profile comprising two or more of the plurality of acoustic characteristics.

4. The insertable in-ear speaker of claim 3, wherein the two or more of the plurality of acoustic characteristics are selected from the following:

a sound pressure associated with the ear;
a particle velocity associated with the ear;
a particle displacement associated with the ear;
an acoustic intensity associated with the ear;
an acoustic power associated with the ear;
a sound energy associated with the ear;
a sound energy density associated with the ear;
a sound exposure associated with the ear;
an acoustic impedance associated with the ear;
an audio frequency associated with the ear; or
a transmission loss associated with the ear.

5. The insertable in-ear speaker of claim 1, wherein the ambient sound augmentation system includes an electro-acoustic transducer or speaker driver that is shared by the user content sound system, to convert the microphone audio signal and the audio signal.

6. The insertable in-ear speaker of claim 1, wherein the external microphone is located in a concha when the in-ear speaker has been inserted into the ear.

7. The insertable in-ear speaker of claim 1 wherein the plurality of acoustic characteristics associated with the ear includes two or more of the following:

a sound pressure associated with the ear;
a particle velocity associated with the ear;
a particle displacement associated with the ear;
an acoustic intensity associated with the ear;
an acoustic power associated with the ear;
a sound energy associated with the ear;
a sound energy density associated with the ear;
a sound exposure associated with the ear;
an acoustic impedance associated with the ear;
an audio frequency associated with the ear; or
a transmission loss associated with the ear.

8. A method for operating an insertable in-ear speaker as a hybrid transparency system, comprising:

converting a user content audio signal into user content sound that is delivered into an ear of a wearer of the in-ear speaker;

signaling an acoustic or venting valve in the in-ear speaker to open, so that sound inside the ear canal is allowed to travel out into an ambient environment through the valve, while converting an ambient content audio signal into ambient content sound that is delivered into the ear, so that both the user content sound and the ambient content sound are heard by the wearer; and while the valve is open and the ambient content audio signal is being converted into ambient content sound in the ear, digitally processing the ambient content audio signal so that a plurality of its frequency components are gain boosted, and while the valve is closed, an acoustic noise cancellation (ANC) system is producing an anti-noise into the ear.

9. The method of claim 8 wherein conversion of the ambient content audio signal into sound is signaled in response to signaling the valve to open.

10. The method of claim 8 wherein the ambient content audio signal is digitally processed in accordance with an equalization profile being a plurality of acoustic characteristics associated with the ear and that includes two or more of the following:

a sound pressure associated with the ear;
a particle velocity associated with the ear;
a particle displacement associated with the ear;
an acoustic intensity associated with the ear;
an acoustic power associated with the ear;
a sound energy associated with the ear;
a sound energy density associated with the ear;
a sound exposure associated with the ear;
an acoustic impedance associated with the ear;
an audio frequency associated with the ear; or
a transmission loss associated with the ear.

11. The method of claim 8 wherein signaling the acoustic or venting valve in the in-ear speaker to open is in response to a measurement by a sensor.

12. The method of claim 11 wherein the sensor comprises at least one of an accelerometer, a sound sensor, a barometric sensor, an image sensor, a proximity sensor, an ambient light sensor, a vibration sensor, a gyroscopic sensor, a compass, a barometer, or a magnetometer.

13. An insertable in-ear speaker configured as a hybrid transparency system, the insertable in-ear speaker comprising:

a user content sound system to receive a user content audio signal, being a recorded audio program signal or a downlink audio signal of a phone call, and convert the user content audio signal into sound for delivery into an ear in which the in-ear speaker has been inserted;

an ambient sound augmentation system having a microphone which is configured to pick up sound in the ambient environment of the in-ear speaker as a microphone audio signal, wherein the system is activated to process the microphone audio signal before converting the microphone audio signal into sound;

a valve that can be configured into a first state that allows sound inside the ear to travel out into the ambient environment through the valve, and into a second state that restricts sound inside the ear from traveling out into the ambient environment through the valve;

an active noise control (ANC) subsystem that is activated to produce anti-noise for delivery into the ear; and logic to signal the valve into the first state while activating the sound augmentation system, and then signal the valve into the second state while activating the ANC subsystem, and wherein the signaling of the valve into the first state is in response to a measurement by a motion sensor.

14. The in-ear speaker of claim 13 wherein the logic is configured to signal the valve based on an operating state of an external electronic device that is providing the user content audio signal.

15. The in-ear speaker of claim 13 wherein the motion sensor comprises an accelerometer installed within a housing of the in-ear speaker, and wherein the signaling of the valve into the first state or into the second state is in response to a measurement by the accelerometer.

16. The in-ear speaker of claim 13 wherein the ambient sound augmentation system includes an electro-acoustic transducer or speaker driver that is shared by the user content sound system, to convert the microphone audio signal and the user content audio signal.

17. The in-ear speaker of claim 13 wherein signaling of the valve into the first state or into the second state is in response to a measurement by the motion sensor, and the logic is configured to use the motion sensor to detect physical activity by a wearer of the in-ear speaker, and in response signal the valve into the first state.

18. The in-ear speaker of claim 17 wherein the motion sensor comprises an accelerometer, and the logic is configured to use the accelerometer to detect physical activity by a wearer of the in-ear speaker, and in response signal the valve into the first state while the wearer is not engaged in a conversation and while the wearer is not engaged in a phone/video call.

19. The insertable in-ear speaker of claim 13 wherein the motion sensor comprises an accelerometer, a gyroscope, a magnetometer, a light sensor, a compass, or a proximity sensor.

* * * * *